US009537221B2

(12) United States Patent
Maruyama et al.

(10) Patent No.: US 9,537,221 B2
(45) Date of Patent: Jan. 3, 2017

(54) REFLECTARRAY

(71) Applicant: NTT DOCOMO, INC., Chiyoda-ku (JP)

(72) Inventors: Tamami Maruyama, Chiyoda-ku (JP); Yasuhiro Oda, Chiyoda-ku (JP); Jiyun Shen, Chiyoda-ku (JP); Ngoc Hao Tran, Chiyoda-ku (JP)

(73) Assignee: NTT DOCOMO, INC., Chiyoda-ku (JP)

( * ) Notice: Subject to any disclaimer, the term of this patent is extended or adjusted under 35 U.S.C. 154(b) by 93 days.

(21) Appl. No.: 14/428,102

(22) PCT Filed: Sep. 20, 2013

(86) PCT No.: PCT/JP2013/075527

§ 371 (c)(1),
(2) Date: Mar. 13, 2015

(87) PCT Pub. No.: WO2014/054444

PCT Pub. Date: Apr. 10, 2014

(65) Prior Publication Data

US 2015/0229029 A1 Aug. 13, 2015

(30) Foreign Application Priority Data

Oct. 1, 2012 (JP) ..... 2012-219061
Feb. 1, 2013 (JP) ..... 2013-018926

(51) Int. Cl.
*H01Q 15/02* (2006.01)
*H01Q 15/00* (2006.01)
*H01Q 15/14* (2006.01)

(52) U.S. Cl.
CPC ..... *H01Q 15/008* (2013.01); *H01Q 15/14* (2013.01)

(58) Field of Classification Search
CPC ..... H01Q 15/14; H01Q 15/008
(Continued)

(56) References Cited

U.S. PATENT DOCUMENTS 7,911,386 B1 * 3/2011 Itoh ..... H01Q 9/0407 343/700 MS
2009/0146907 A1 * 6/2009 Brown ..... H01Q 15/14 343/912

(Continued)

FOREIGN PATENT DOCUMENTS

JP 6-77726 A 3/1994
JP 2010-226695 A 10/2010

(Continued)

OTHER PUBLICATIONS

Extended European Search Report issued Apr. 13, 2016 in Patent Application No. 13844308.0.

(Continued)

*Primary Examiner* — Dameon E Levi
*Assistant Examiner* — Hasan Islam
(74) *Attorney, Agent, or Firm* — Oblon, McClelland, Maier & Neustadt, L.L.P.

(57) ABSTRACT

A reflectarray having multiple elements arranged in an array, each element having a H-shaped patch provided in separation from a ground plate, the H-shaped patch formed by four outer vertices defined by two rectangular outer patches and four inner vertices defined by an inner patch. A length of the inner patch with respect to a first direction is determined to change the reflection phase of an electric field incoming in parallel to the first direction while keeping positions of the four outer vertices and sizes of the outer patches constant. The first direction is determined by positions of the four inner vertices, and a length of the H-shaped patch with respect to a second direction is determined to change the (Continued)

reflection phase of an electric field incoming in parallel to the second direction, wherein the second direction is determined by positions of the four outer vertices.

7 Claims, 50 Drawing Sheets

(58) Field of Classification Search
USPC ..... 343/909, 912, 913
See application file for complete search history.

(56) References Cited

U.S. PATENT DOCUMENTS

| | | | | |
|---|---|---|---|---|
| 2010/0019976 | A1* | 1/2010 | Sakiyama | H01Q 9/0442 343/700 MS |
| 2010/0039343 | A1 | 2/2010 | Uno et al. | |
| 2010/0085272 | A1* | 4/2010 | Legay | H01Q 3/46 343/913 |
| 2010/0220036 | A1 | 9/2010 | Maruyama et al. | |
| 2010/0328161 | A1* | 12/2010 | Tiezzi | H01Q 21/00 343/700 MS |
| 2012/0105305 | A1 | 5/2012 | Maruyama et al. | |

FOREIGN PATENT DOCUMENTS

| | | |
|---|---|---|
| JP | 2012 34331 | 2/2012 |
| JP | 2012 34332 | 2/2012 |
| WO | WO 2010/137713 A1 | 12/2010 |

OTHER PUBLICATIONS

Japanese Office Action issued Apr. 5, 2016 in Japanese Application No. 2013-018926 (with English Translation).

Maurizio Bozzi et al. "Performance Comparison of Different Element Shapes Used in Printed Reflectarrays", IEEE Antennas and Wireless Propagation Letters, vol. 2, 2003, pp. 219-222.

Yang, F. et al., "Single-Layer Multi-band Circularly Polarized Reflectarray Antenna: Concept, Design, and Measurement", URSI General Assembly, (Aug. 7-16, 2008), Total 4 Pages.

Pozar, D. et al., "Design of Millimeter Wave Microstrip Reflectarrays",IEEE Transactions on Attennas and Propagation, vol. 45, No. 2, (Feb. 1997), pp. 287-296.

Murayama, T. et al., "Dual Frequency Selective Reflectarray for Propagation Improvement", IEEE, (2010), Total 4 Pages.

Li, L. et al., "Frequency Selective Reflectarray Using Crossed-Dipole Elements With Square Loops for Wireless Communication Applications", IEEE Transactions on Antennas and Propagation, vol. 59, No. 1, (Jan. 2011), pp. 89-99.

Maruyama, T. et al., "Capacitance Value Control for Metamaterial Reflectarray using Multi-layer Mushroom Structure with Parasitic Patches", ACES Journal, vol. 27, No. 1, (Jan. 2012), pp. 28-41.

Maruyama, T. et al., "Multi-band Reflectarray using Mushroom Structure", IEEE, (2012), Total 4 Pages.

Maruyama, T. et al., "Design of Wide Angle Reflection Reflectarray Using Multi-layer Mushroom Structure to Improve Propagation", IEEE, (2011), Total 4 Pages.

Shen, J. et al., "A Novel Approach for Capacity Improvement of 2×2 MIMO in LOS Channel Using Reflectarray", IEEE, (2011), Total 5 Pages.

Nayeri, P. et al., "Single-Feed Multi-Beam Reflectarray Antennas", IEEE, (2010), Total 4 Pages.

International Search Report Issued Oct. 29, 2013 in PCT/JP13/075527 Filed Sep. 20, 2013.

Japanese Office Action Issued Nov. 12, 2013 in Application No. JP 2012-219061 Filed Oct. 1, 2012 (with English translation).

* cited by examiner

FIG.15

| ELEMENT NUMBER | $g_y$ [mm] | REFLECTION PHASE TO TM WAVE [DEGREE] | $g_x$ [mm] | REFLECTION PHASE TO TE WAVE [DEGREE] | $W_y$ [mm] | $W_x$ [mm] |
|---|---|---|---|---|---|---|
| 1 | 0.590342 | 0 | 0.1 | −145.753 | 3.509658 | 4 |
| 2 | 0.480175 | −36 | 0.2 | −181.753 | 3.619825 | 3.9 |
| 3 | 0.378703 | −72 | 3.4 | 142.2467 | 3.721297 | 0.7 |
| 4 | 0.271468 | −108 | 1.5 | 106.2467 | 3.828532 | 2.6 |
| 5 | 0.151164 | −144 | 1 | 70.24665 | 3.948836 | 3.1 |
| 6 | 1.755547 | −180 | 0.55 | 34.24665 | 2.344453 | 3.55 |
| 7 | 1.626202 | 144 | 0.45 | −1.75335 | 2.473798 | 3.65 |
| 8 | 1.243743 | 108 | 0.42 | −37.7533 | 2.856257 | 3.68 |
| 9 | 0.89318 | 72 | 0.35 | −73.7533 | 3.20682 | 3.75 |
| 10 | 0.711992 | 36 | 0.3 | −109.753 | 3.388008 | 3.8 |

FIG.23

| ELEMENT NUMBER | REFLECTION PHASE TO TM WAVE [DEGREE] | $g_y$ [mm] | REFLECTION PHASE TO TE WAVE [DEGREE] | $g_x$ [mm] | $W_y$ [mm] | $W_x$ [mm] |
|---|---|---|---|---|---|---|
| 1 | 0 | 0.6 | 0 | 2.2 | 3.5 | 1.9 |
| 2 | −36 | 0.5 | 27 | 0.1 | 3.6 | 4 |
| 3 | −72 | 0.4 | 54 | 0.1 | 3.7 | 4 |
| 4 | −108 | 0.3 | 81 | 0.1 | 3.8 | 4 |
| 5 | −144 | 0.2 | 108 | 0.12 | 3.9 | 3.98 |
| 6 | −180 | 1.8 | 135 | 0.1 | 2.3 | 4 |
| 7 | 144 | 1.6 | 162 | 0.1 | 2.5 | 4 |
| 8 | 108 | 1.2 | 189 | 0.1 | 2.9 | 4 |
| 9 | 72 | 0.9 | 216 | 0.158 | 3.2 | 3.942 |
| 10 | 36 | 0.7 | 243 | 0.2 | 3.4 | 3.9 |
| 11 | 0 | 0.6 | 270 | 0.3 | 3.5 | 3.8 |
| 12 | −36 | 0.5 | 297 | 0.56 | 3.6 | 3.54 |
| 13 | −72 | 0.4 | 324 | 1.2 | 3.7 | 2.9 |
| 14 | −108 | 0.3 | 351 | 2.1 | 3.8 | 2 |
| 15 | −144 | 0.2 | 18 | 0.1 | 3.9 | 4 |
| 16 | −180 | 1.8 | 45 | 0.1 | 2.3 | 4 |
| 17 | 144 | 1.6 | 72 | 0.1 | 2.5 | 4 |
| 18 | 108 | 1.2 | 99 | 0.1 | 2.9 | 4 |
| 19 | 72 | 0.9 | 126 | 0.1 | 3.2 | 4 |
| 20 | 36 | 0.7 | 153 | 0.15 | 3.4 | 3.95 |
| 21 | 0 | 0.6 | 180 | 0.14 | 3.5 | 3.96 |
| 22 | −36 | 0.5 | 207 | 0.18 | 3.6 | 3.92 |
| 23 | −72 | 0.4 | 234 | 0.25 | 3.7 | 3.85 |
| 24 | −108 | 0.3 | 261 | 0.31 | 3.8 | 3.79 |
| 25 | −144 | 0.2 | 288 | 0.4 | 3.9 | 3.7 |
| 26 | −180 | 1.8 | 315 | 0.5 | 2.3 | 3.6 |
| 27 | 144 | 1.6 | 342 | 2 | 2.5 | 2.1 |
| 28 | 108 | 1.2 | 9 | 2 | 2.9 | 2.1 |
| 29 | 72 | 0.9 | 36 | 0.1 | 3.2 | 4 |
| 30 | 36 | 0.7 | 63 | 0.12 | 3.4 | 3.98 |
| 31 | 0 | 0.6 | 90 | 0.1 | 3.5 | 4 |
| 32 | −36 | 0.5 | 117 | 0.1 | 3.6 | 4 |
| 33 | −72 | 0.4 | 144 | 0.15 | 3.7 | 3.95 |
| 34 | −108 | 0.3 | 171 | 0.15 | 3.8 | 3.95 |
| 35 | −144 | 0.2 | 198 | 0.19 | 3.9 | 3.91 |
| 36 | −180 | 1.8 | 225 | 0.1 | 2.3 | 4 |
| 37 | 144 | 1.6 | 252 | 0.12 | 2.5 | 3.98 |
| 38 | 108 | 1.2 | 279 | 0.1 | 2.9 | 4 |
| 39 | 72 | 0.9 | 306 | 0.5 | 3.2 | 3.6 |
| 40 | 36 | 0.7 | 333 | 2.2 | 3.4 | 1.9 |

FIG.40

| ELEMENT INTERVAL | 4.1mm | |
|---|---|---|
| | $\theta$ | $\phi$ |
| INCIDENT DIRECTION | 20.0 | 0.0 |
| REFLECTION DIRECTION | −38 | −56 |
| FIRST FREQUENCY [GHz] | 11 | |
| PHASE DIFFERENCE BETWEEN ELEMENT OF FIRST FREQUENCY | 36 DEGREES | |
| SECOND FREQUENCY [GHz] | 14.3 | |
| PHASE DIFFERENCE BETWEEN ELEMENT OF SECOND FREQUENCY | 28 | |

REFLECTARRAY

TECHNICAL FIELD

The present invention generally relates to a reflectarray for use in radio communication.

BACKGROUND ART

In the technical field of radio communication, it is discussed that a reflectarray for implementing scattering of an incident wave toward an arbitrary direction is applied to ensure a communication area or for other purposes. Also, the reflectarray may be used to form multiple paths in a line-of-sight propagation environment where a direct wave is dominant to improve throughput and/or reliability in a Multiple Input Multiple Output (MIMO) scheme.

In addition, there are some cases where two mutually orthogonally polarized waves are used in communication as polarization diversity or polarization MIMO for implementation of higher speed and larger capacity of communication. In these cases, the polarization is linear polarization and may be referred to as an electric wave (Transverse Electric wave: TE wave) having an electric field component vertical to a plane of incidence and an electric wave (Transverse Magnetic wave: TM wave) having an electric field component in parallel to the plane of incidence, for example. Alternatively, the polarization may be referred to as a vertical polarization wave having an electric field component vertical to the ground and a horizontal polarization wave having an electric field component in parallel to the ground. Also, an electric field rotates in various directions in an outdoor location due to affection of propagation environment. In this case, the electric field may be considered to have two components, that is, a vertical component and a horizontal component. In any of the cases, two planar waves, amplitude directions of whose electric fields are mutually orthogonal, are available in communication. However, conventional reflectarrays are difficult to reflect two polarized waves arriving from a certain direction to respective different directions as desired.

On the other hand, according to a radio communication system such as a LTE (Long Term Evolution) Advanced scheme, multiple frequency bands or carriers are used in communication as needed. Accordingly, it is desirable that a reflectarray for reflecting a wave for use in communication also corresponds to the multiple frequency bands (multiband). Some conventional reflectarrays supporting the multiband are described in Non-Patent Document 1. A reflectarray as described in Non-Patent Document 1 has a broken circular element for Ka band (32 GHz), a broken rectangular linear element for X band (8.4 GHz) and a cross dipole element for C band (7.1 GHz). However, this reflect array is targeted to circular polarization and is unavailable for direct polarization without modification. In addition, the reflectarray as described in Non-Patent Document 1 must be processed to have a complicated element shape such that it can operate appropriately in Ka, X and C bands, which can increase the cost.

A conventional reflectarray uses an about ½ wavelength element such as a macrostrip element as described in Non-Patent Document 2. By changing the size of this element, the reflection phase can be changed with misalignment of a resonant frequency. Thus, the phase of each array element may be determined such that the planar wave is oriented to a desired direction. It has been reported that a cross dipole can be used to implement such a reflectarray for associating ½ wavelength elements with multiple polarized waves and reflecting two polarization waves arriving from a certain direction to respective desired directions (see Non-Patent Documents 3 and 4).

Meanwhile, a reflectarray using a mushroom structure much smaller than the wavelength has been reported as a method for controlling the reflection direction with a wider angle than a reflectarray using conventional ½ wavelength elements (Non-Patent Document 5). However, no mushroom structure available in dual use for orthogonally polarized waves has existed. Accordingly, no mushroom structure that can achieve wide angle control in dual polarization has existed.

In a radio communication system such as the LTE-Advanced scheme, on the other hand, multiple frequency bands or carriers are used in communication as needed. Accordingly, it is desirable that a reflectarray for reflecting waves for use in communication also supports multiple frequency bands (multiband). Some conventional reflectarrays supporting the multiband are described in Non-Patent Documents 1 and 3 below. A reflectarray as described in Non-Patent Document 1 has a broken circular element for Ka band (32 GHz), a broken rectangular linear element for X band (8.4 GHz) and a cross dipole element for C band (7.1 GHz). A reflectarray as described in Non-Patent Document 3 uses a cross dipole as an element to determine the reflection phase by changing the length of the cross dipole element with respect to the X direction for an incident wave of a first frequency $f_1$ having an electric field in parallel to the X-axis and determine the reflection phase by changing the length of the cross dipole element with respect to the Y direction for an incident wave of a second frequency $f_2$ having an electric field in parallel to the Y-axis.

However, the conventional structure is based on a ½ wavelength element and is difficult to apply for angle control wider than 40 degrees due to occurrence of grating lobe and influence of mutual coupling between elements.

In order to overcome these problems, reflectarrays having mushroom structures as described in Non-Patent Documents 5 and 6 have been proposed. However, these are not dual polarization elements. Accordingly, it is difficult to design the reflectarray independently for individual polarization waves. Thus, it can be seen that when a Y directional gap gy between mushrooms changes, the reflection phase value would also change for a X directional gap gx between the mushrooms.

RELATED ART DOCUMENT

Patent Document

Patent document 1: JP Application Publication 2012-34331

Non-Patent Document

Non-Patent Document 1: Fan Yang, Ang Yu, Atef Elsherbeni and John Huang, "Single-Layer Multi-band Circularly Polarized Reflect array Antenna: Concept, Design and Measurement", URSI General Assembly, Chicago, Ill., Aug. 7-16, 2008.

Non-Patent Document 2: D. M. Pozar, T. S. Targonsky, and H. D. Syrigos, "Design of millimeter wave microstrip reflectarrays", IEEE Trans. Antennas Propagat., vol. AP-45, no. 2, pp. 287-295, 1997.

Non-Patent Document 3: T. Maruyama, T. Furuno, T. Ohya, Y. Oda, Q. Chen, and K. Sawaya, "Dual Frequency Selective Reflectarray for Propagation Improvement", IEEE iWAT, 2010, pp. 1-4, 5464764, March 2010.

Non-Patent Document 4: L. Li, Q. Chen, Q. Yuan, K. Sawaya, T. Maruyama, T. Furuno, and S Uebayashi, "Frequency Selective Reflectarray using Crossed-Dipole Elements with Square Loops for Wireless Communication Applications," *IEEE Trans. Antennas Propagat.*, vol. AP-59, no. 1, pp. 89-99, 2011.

Non-Patent Document 5: T. Maruyama, T. Furuno, Y. Oda, J. Shen, and T. Ohya, "Capacitance value control for metamaterial reflectarray using multi-layer mushroom structure with parasitic patches," ACES JOURNAL, vol. 27, no. 1, pp. 28-41, January 2012.

Non-Patent Document 6: T. Maruyama, J. Shen, N. Tran and Y. Oda "Multi-band Reflectarray using Mushroom Structure," IEEE ICWITS 2012.

Non-Patent Document 7: T. Maruyama, Y. Oda, J. Shen, N. Tran and H. Kayama, "Design of wide angle reflection reflectarray using multi-layer mushroom structure to improve propagation," IEEE URSI General Assembly and Scientific Symposium, 2011 XXXth URSI, August, 2011.

Non-Patent Document 8: J. Shen, Y. Oda, T. Furuno, T. Maruyama, and T. Ohya, "A novel approach for capacity improvement of 2×2 MIMO in LOS channel using reflectarray," VTC2011 spring, 10.1109/VETECS.2011.5956339, May 2011.

Non-Patent Document 9: PayamNayeri, Fan Yang, and Atef Z. Elsherbeni, "Single-Feed Multi-Beam Reflectarray Antennas, IEEE AP-S 2010.

SUMMARY OF INVENTION

Problem to be Solved by the Invention

One object of the present invention is to provide a reflectarray having mushroom elements and arranged as a simple structure where a first polarized wave having an electric field component in parallel to a substrate surface and a second polarized wave having an electric field component vertical to the substrate surface can be reflected in desired directions.

Other objects of the present invention address difficult conventional problems and are to implement a reflectarray that achieves all or any of:

(1) provision of a reflectarray that can change the reflection phase of TE incidence and the reflection phase of TM incidence independently;

(2) wide-angle control;

(3) provision of a method for causing a Y directional capacitance value to be unchanged when a X directional gap size changes to change the reflection phase with respect to the X direction; and (4) dual use in multiple frequencies.

Means for Solving the Problem

In order to solve the above-stated problems, one aspect of the present invention relates to a reflectarray having multiple elements arranged in an array, wherein each of the elements has a H-shaped patch provided in separation from a ground plate, the H-shaped patch is formed by four outer vertices defined by two rectangular outer patches and four inner vertices defined by an inner patch, a length of the inner patch with respect to a first direction is determined to change the reflection phase of an electric field incoming in parallel to the first direction while keeping positions of the four outer vertices and sizes of the outer patches constant, wherein the first direction is determined by positions of the four inner vertices, and a length of the H-shaped patch with respect to a second direction is determined to change the reflection phase of an electric field incoming in parallel to the second direction, wherein the second direction is determined by positions of the four outer vertices.

Another aspect of the present invention relates to a reflectarray having multiple reflection elements arranged in an array, wherein each of the reflection elements has a H-shaped patch in separation from a ground plate, the H-shaped patch has two rectangular outer patches having a uniform size and one rectangular inner patch, the two outer patches are coupled to the inner patch to sandwich the inner patch such that the H-shaped patch is symmetric with respect to a first direction defined by one side of a rectangle and a second direction orthogonal to the first direction, a length of the inner patch with respect to the first direction is determined for polarization of an electric field incoming in parallel to the first direction while keeping a length of the outer patches of each of reflection elements with respect to the first direction constant, the reflection elements arranged in the second direction, and a length of the H-shaped patch with respect to the second direction is determined for polarization of an electric field incoming in parallel to the second direction.

Advantage of the Invention

According to the above aspects of the present invention, it is possible to provide a reflectarray having mushroom elements and arranged as a simple structure where a first polarized wave having an electric field component in parallel to a substrate surface and a second polarized wave having an electric field component vertical to the substrate surface can be reflected in desired directions.

Also, according to the above aspects of the present invention, it is possible to provide a reflectarray that can change the reflection phase of TE incidence and the reflection phase of TM incidence independently and also provide a reflectarray that can be used for multiple frequencies.

BRIEF DESCRIPTION OF DRAWINGS

FIG. 15 is a view for illustrating various parameter values for each of ten elements in FIGS. 13 and 14;

FIG. 23 is a view for illustrating various parameter values of each of 40 elements in FIG. 22;

FIG. 40 is a view for illustrating exemplary design values of a reflectarray having H-shaped mushroom elements according to the first embodiment of the present invention;

EMBODIMENTS OF THE INVENTION

Figure 1:
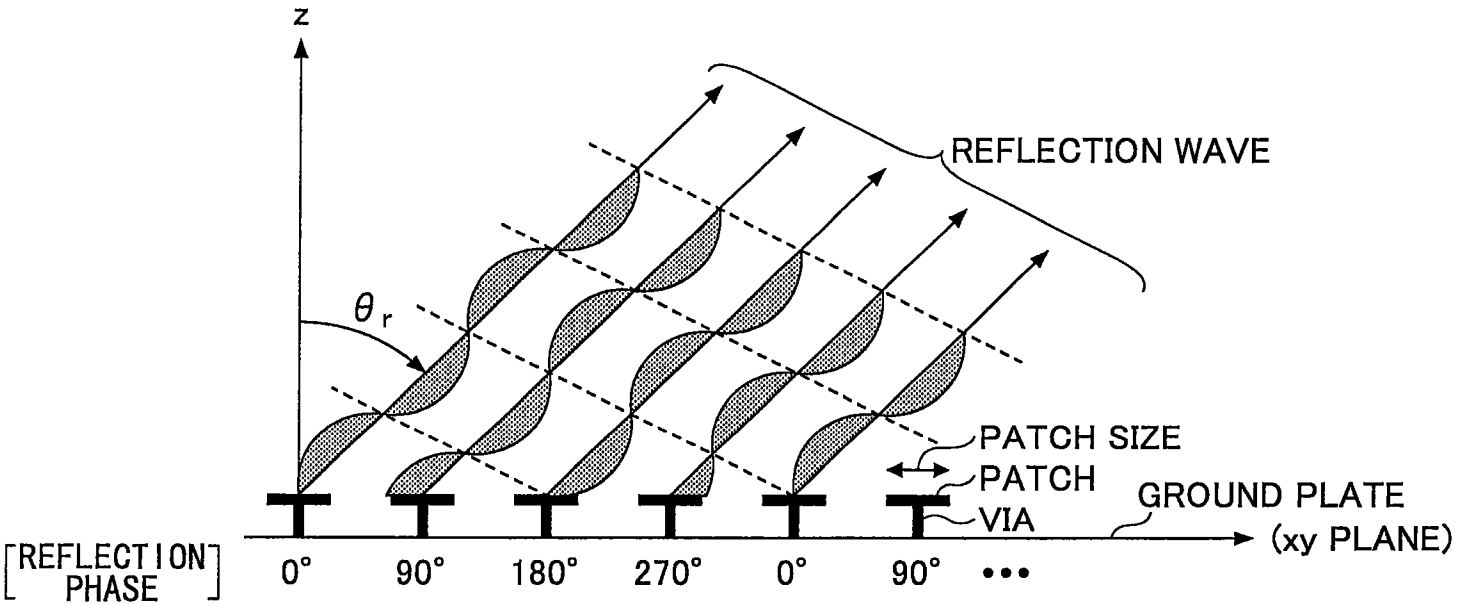
FIG. 1 is an illustrative view for illustrating principle of a reflectarray.

Embodiments are described with reference to the accompanying drawings from viewpoints below. In the drawings, the same reference numerals or reference symbols are assigned to similar elements.

In embodiments below, a reflectarray having multiple elements arranged in an array is disclosed. Each of the multiple elements arranged in an array has a H-shaped patch which is provided in separation from a ground plate. The H-shaped patch is formed by four outer vertices of an outer portion of the H-shaped patch including two rectangular outer patches and four inner vertices of an inner portion of the H-shaped patch including an inner patch. In the disclosed reflectarray, the length of the inner patch with respect to a first direction determined by positions of the four inner vertices is determined while keeping positions of the four outer vertices of the outer patches and the size of the outer patches constant in order to change the reflection phase of an electric field incoming in parallel to the first direction. Also, the length of the H-shaped patch with respect to a second direction determined by positions of the four outer vertices is determined in order to change the reflection phase of an electric field incoming in parallel to the second direction.

In another embodiment, each of multiple reflection elements arranged in an array has a H-shaped patch which is provided in separation from a ground plate. The H-shaped patch has two rectangular outer patches with a same size and one rectangular inner patch. The two outer patches are coupled to the inner patch by sandwiching the inner patch such that the H-shaped patch is symmetric with respect to a first direction defined by one side of the rectangle and a second direction orthogonal to the first direction. In the disclosed reflectarray, the length of the inner patch with respect to the first direction is determined while keeping the length of the outer patch of each reflection element arranged in the second direction with respect to the first direction constant for polarization of an electric field incoming in parallel to the first direction. Also, the length of the H-shaped patch with respect to the second direction is determined for polarization of an electric field incoming in parallel to the second direction.

At the outset, a reflectarray according to a first embodiment of the present invention is described.

1. Reflectarray
2. Dual polarized single band
3. Dual polarized multiband
3.1. Dual resonant
3.2. Periodic boundary
3.3. Reflection direction
4. Variations Separation of these items is not essential to the present invention, and some features described in two or more items may be used in combination as needed, or a feature described in a certain item may be applied to a feature described in another item (as long as they do not contradict.)

<1. Reflectarray>

FIG. 1 is an illustrative view for illustrating a principle of a reflectarray. As illustrated, it is assumed that the phase of reflection waves by respective elements aligned on a ground plate gradually changes between adjacent elements. In the illustrated case, the phase difference of reflection waves by adjacent elements is 90 degrees. Since the electric waves travel in a direction vertical to equiphase surfaces (illustrated in dotted lines), a reflectarray can be formed by adjusting the reflection phase from individual elements appropriately and arranging elements two-dimensionally to reflect an incoming wave in a desired direction.

Figure 2:
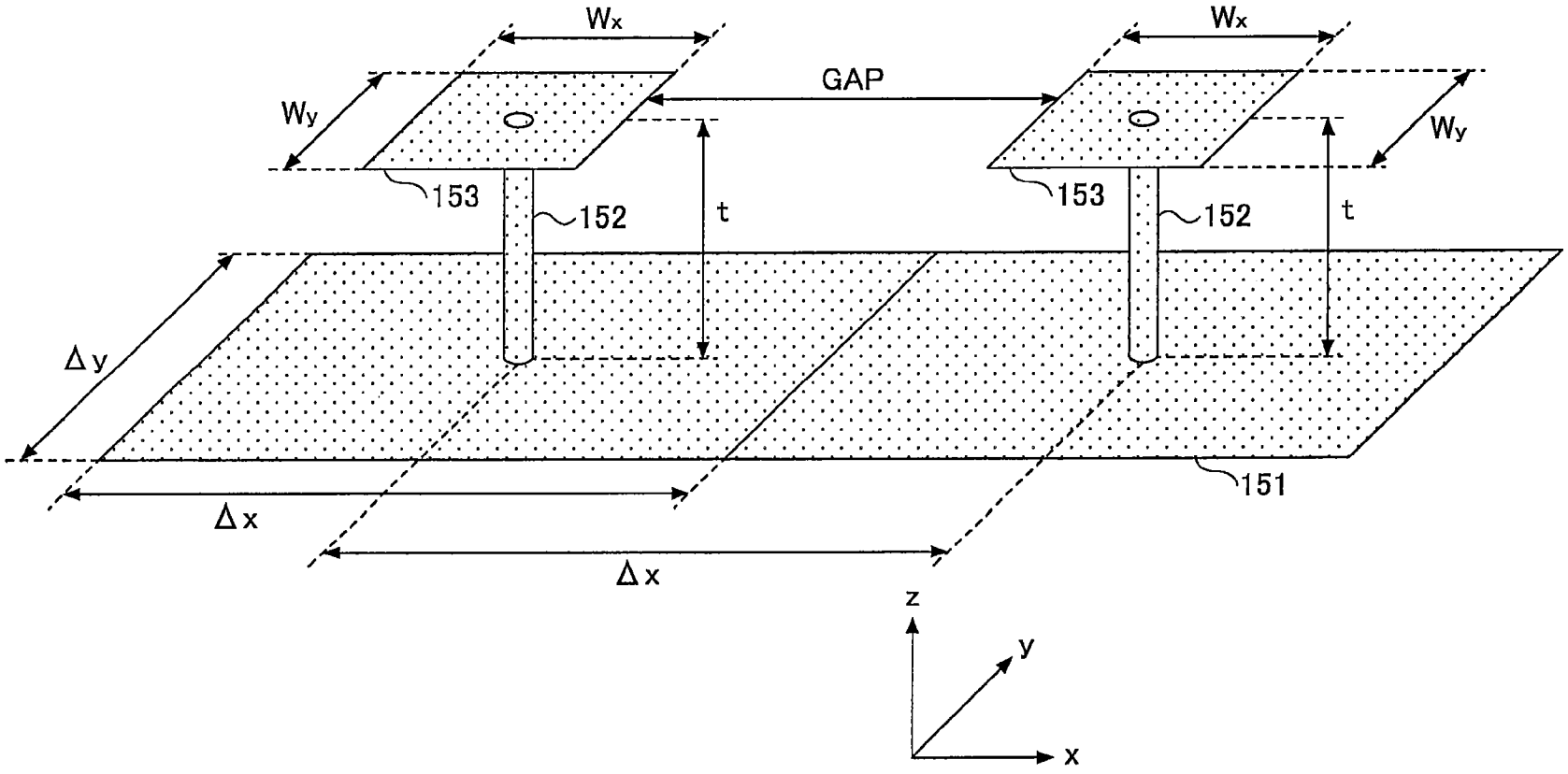
FIG. 2 is a view for illustrating formation of an element with mushroom structures.

FIG. 2 illustrates mushroom structures available as elements for a reflectarray. The mushroom structure has a ground plate 151, a via 152 and a patch 153. The ground plate 151 is a conductor for supplying a common potential to many mushroom structures. Δx and Δy represent intervals between vi as in adjacent mushroom structures with respect to a x-axis direction and a y-axis direction, respectively. Accordingly, Δx and Δy will represent a size of the ground plate 151 corresponding to one mushroom structure. In general, the ground plate 151 is as large as an array where many mushroom structures are arranged. The via 152 is provided for an electrical shortcut between the ground plate 151 and the patch 153. The patch 153 has a length Wx with respect to the x-axis direction and a length Wy with respect to the y-axis direction. The patch 153 is provided in separation in parallel from the ground plate 151 by a distance t and is shortcut from the ground plate 151 through the via 152. For illustrative simplicity, only the two mushroom structures are illustrated, but a large number of such mushroom structures may be provided in a reflectarray in the x-axis and y-axis directions.

Figure 3:
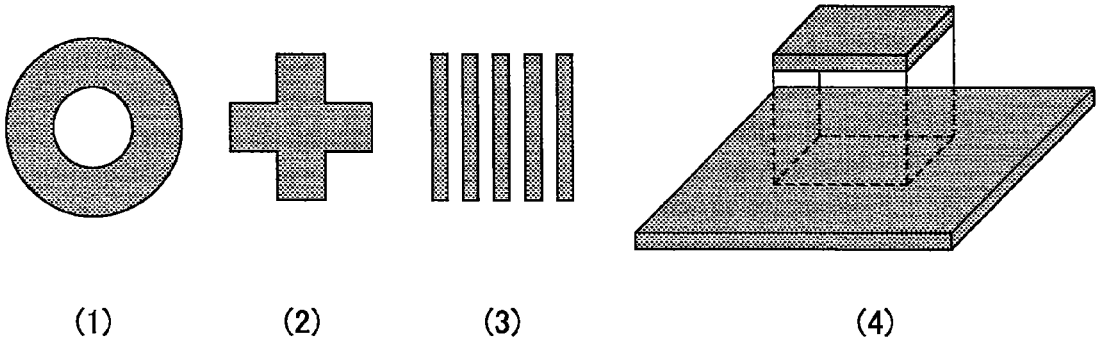
FIG. 3 is a view for illustrating an exemplary alternate structure of an element.

In the case as illustrated in FIG. 2, an individual element composing a reflectarray is formed as a mushroom structure. However, it is not essential to it. A reflectarray may be formed of any element for reflecting an electric wave. For example, instead of a square patch, an element having a ring-shaped conductive pattern (FIG. 3(1)), a cross-shaped conductive pattern (FIG. 3(2)), multiple parallel conductive patterns (FIG. 3(3)) and so on may be used. Also, a structure (FIG. 3(4)) without any via for connecting a patch to a ground plate may be used in a mushroom structure. However, it is preferable that mushroom structures with the above elements be used to design a small reflection element in a simple manner or others.

Figure 4:
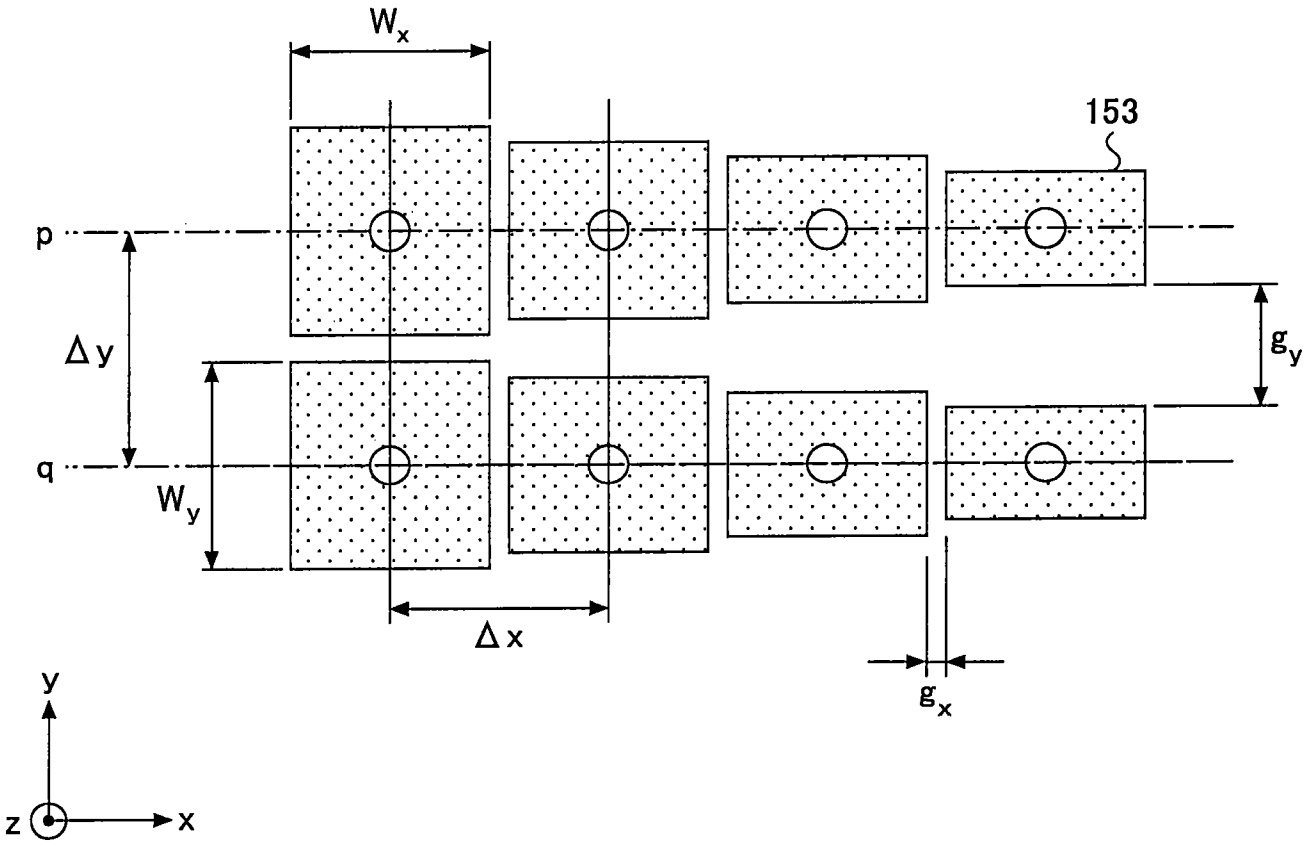
FIG. 4 is an enlarged plan view of a reflectarray.
Figure 5:
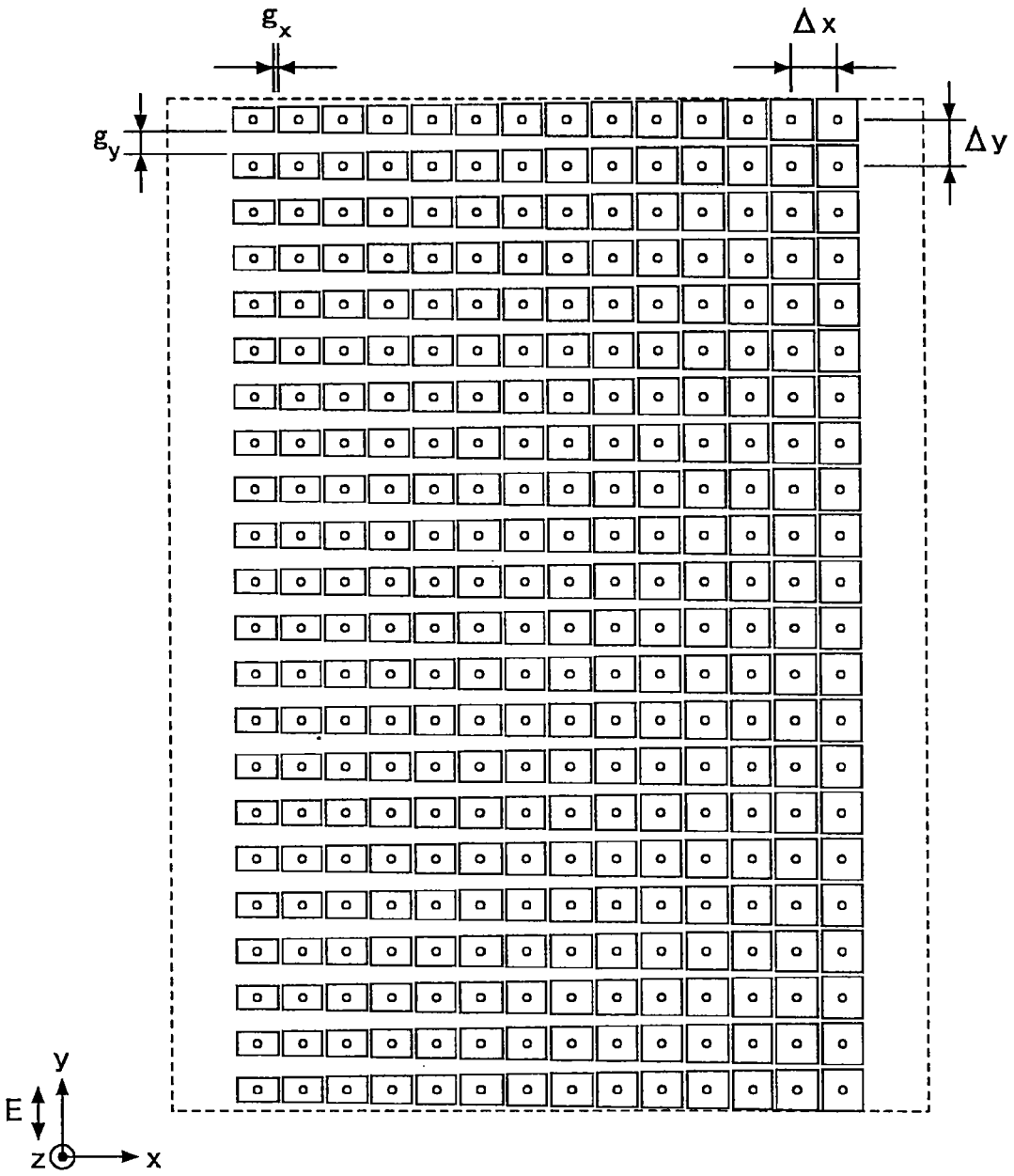
FIG. 5 is a plan view of a reflectarray.

FIG. 4 is an enlarged plan view of a reflectarray as illustrated in FIG. 2. Four patches 153 linearly aligned along a line p and four patches 143 linearly aligned along an adjacent line q are illustrated. However, an arbitrary number of patches may be used. FIG. 5 illustrates formation of a reflectarray where a large number of the elements as illustrated in FIGS. 2 and 4 are arranged on a xy plane.

Figure 6:
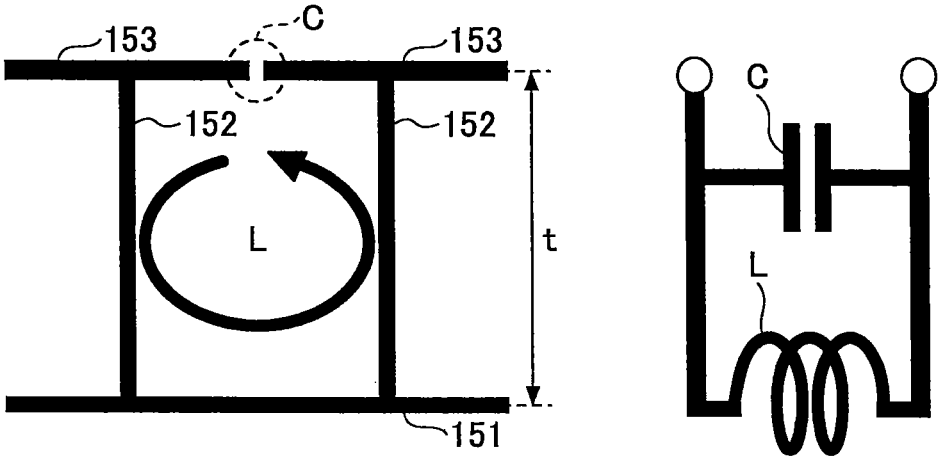
FIG. 6 is an equivalent circuit diagram of a mushroom structure element.

FIG. 6 illustrates an equivalent circuit of mushroom structures as illustrated in FIGS. 2, 4 and 5. Due to a gap between the patch 153 in a mushroom structure aligned along the line p and the patch 153 in a mushroom structure aligned along the line q in FIG. 4, a capacitance C arises. In addition, due to the via 152 in a mushroom structure aligned along the line p and the via 152 in a mushroom structure aligned along the line q, an inductance L arises. Accordingly, the equivalent circuit of adjacent mushroom structures will be a circuit as illustrated in the right side in FIG. 6. In other words, the inductance L and the capacitance C are coupled in parallel in the equivalent circuit. The capacitance C, the inductance L, a surface impedance Zs and a reflection coefficient Γ can be represented as follows.

$$C = \frac{\varepsilon_0(1+\varepsilon_r)W_y}{\pi}\operatorname{arccosh}\left(\frac{\text{element interval}}{\text{gap}}\right) \tag{1}$$

$$L = \mu \cdot t \tag{2}$$

$$Z_s = \frac{j\omega L}{1-\omega^2 LC} \tag{3}$$

$$\Gamma = \frac{Z_s - \eta}{Z_s + \eta} = |\Gamma|\exp(j\phi) \tag{4}$$

where in formula (1), $\in_0$ represents a permittivity of a vacuum, and $\in_r$ represents a relative permittivity of a material lying between patches. In the illustrated case, an element interval is equal to a via interval Δy in the y-axis direction. The gap $g_y$ is a space between adjacent patches and is equal to $g_y$=Δy−Wy in the above case. Wy represents the length of a patch with respect to the y-axis direction. In other words, the argument of the arc cos h function represents a ratio between the element interval and the gap. In formula (2), μ represents a permeability of a material lying between vias, and t represents a height of the patch 153 (the distance between the ground plate 151 and the patch 153). In formula (3), ω represents an angular frequency, and j represents an imaginary unit. In formula (4), η represents a free space impedance, and ϕ represents a phase difference.

Figure 7:
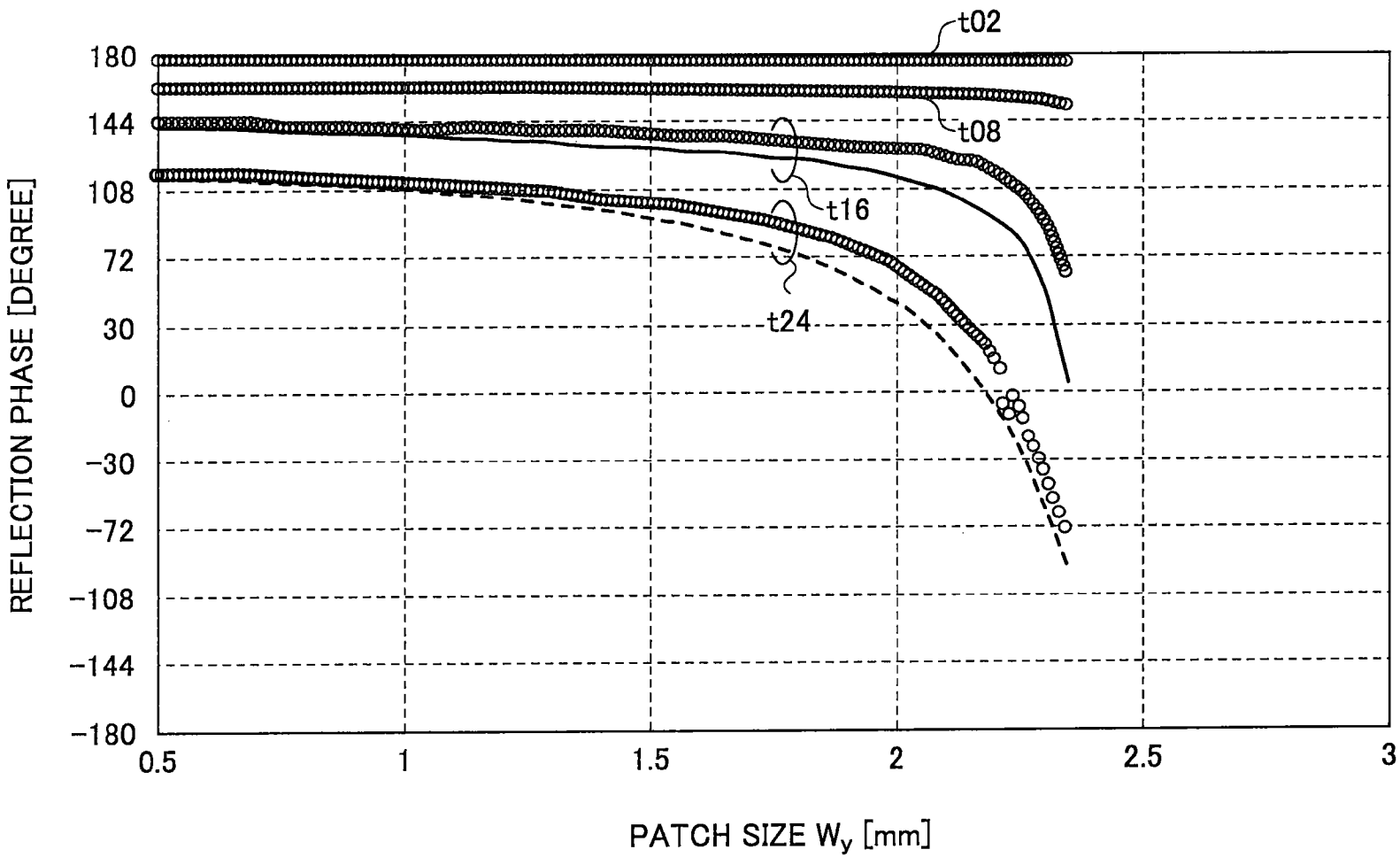
FIG. 7 is a view for illustrating a relationship between patch size Wy and a reflection phase of a mushroom structure element.

FIG. 7 illustrates a relationship between patch size Wy and the reflection phase of a mushroom structure as illustrated in FIGS. 2, 4 and 5. In general, the reflection phase of the mushroom structure (element) is 0 in a certain resonant frequency. The reflection phase for the reflection of an electric wave having a resonant frequency by an element can be adjusted, by adjusting the capacitance C and/or the inductance L of the element. In designing a reflectarray, the reflection phase of an individual element must be appropriately set by the capacitance C and/or the inductance L such that an electric wave of a resonant frequency can be reflected in a desired direction. In the illustration, solid lines represent theoretical values, and circular plots represent simulation values under finite element method based analyses. FIG. 7 illustrates a relationship between the patch size Wy and the reflection phase for each of the height of four types of vias or a substrate thickness t. t02 represents a graph for a case where the distance t is equal to 0.2 mm. t08 represents a graph for a case where the distance t is equal to 0.8 mm. t16 represents a graph for a case where the distance t is equal to 1.6 mm. t24 represents a graph for a case where the distance t is equal to 2.4 mm. As one example, the via interval or the element interval Δx and Δy are 2.4 mm.

According to the graph t02, it can be seen that the reflection phase can be around 175 degrees by setting the thickness to 0.2 mm. However, even if the patch size Wy changes from 0.5 mm to 2.3 mm, the reflection phase difference will be less than or equal to 1 degree, which does not cause the reflection phase value to significantly change. According to the graph t08, the phase can be around 160 degrees by setting the thickness to 0.8 mm. Then, when the patch size Wy changes from 0.5 mm to 2.3 mm, the reflection phase will change from about 162 degrees to 148 degrees, but the variation range will be 14 degrees, which is smaller. According to the graph t16, the phase will be less than or equal to 145 degrees by setting the thickness to 1.6 mm. If the patch size Wy changes from 0.5 mm to 2.1 mm, the reflection phase will decrease from 144 degrees to 107 degrees slowly. However, once the size Wy becomes greater than 2.1 mm, the reflection phase will decrease drastically. In the case where the size Wy is equal to 2.3 mm, the reflection phase will reach 54 degrees for the simulation value (circle) and 0 degree for the theoretical value (solid line). According to the graph t24, if the patch size Wy changes from 0.5 mm to 1.7 mm, the reflection phase will decrease from 117 degrees to 90 degrees slowly. However, once the size Wy becomes greater than 1.7 mm, the reflection phase will decrease drastically. If the size Wy is equal to 2.3 mm, the reflection phase will reach −90 degrees.

In the case where an element is formed as a mushroom structure as illustrated in FIGS. 2, 4 and 5, the patch size Wx with respect to the x-axis direction is uniform over all elements, and the patch size Wy with respect to the y-axis direction is different depending on the position of the element. However, it is not essential that the patch size Wx is uniform over all elements, and the patch size Wx may be designed to be different for different elements. However, if a reflectarray is designed by using mushroom structures whose patch size Wx is uniform over all elements, it would be sufficient to determine only the patch size Wy with respect to the y-axis direction corresponding to the element position, which can design it in a simpler manner. Specifically, a graph to be used for design (for example, t24) from various heights of vias or various substrate thicknesses t is selected, and the respective sizes of aligned multiple patches are determined depending on the reflection phase required at the patch position. For example, in the case where t24 is selected, if the reflection phase required at a certain patch position is 72 degrees, the patch size Wy will be about 2 mm. Similarly, the size is determined for other patches. Ideally, the patch size is preferably designed such that a variation of the reflection phase by a whole element aligned in a reflectarray can be 360 degrees.

Figure 8:
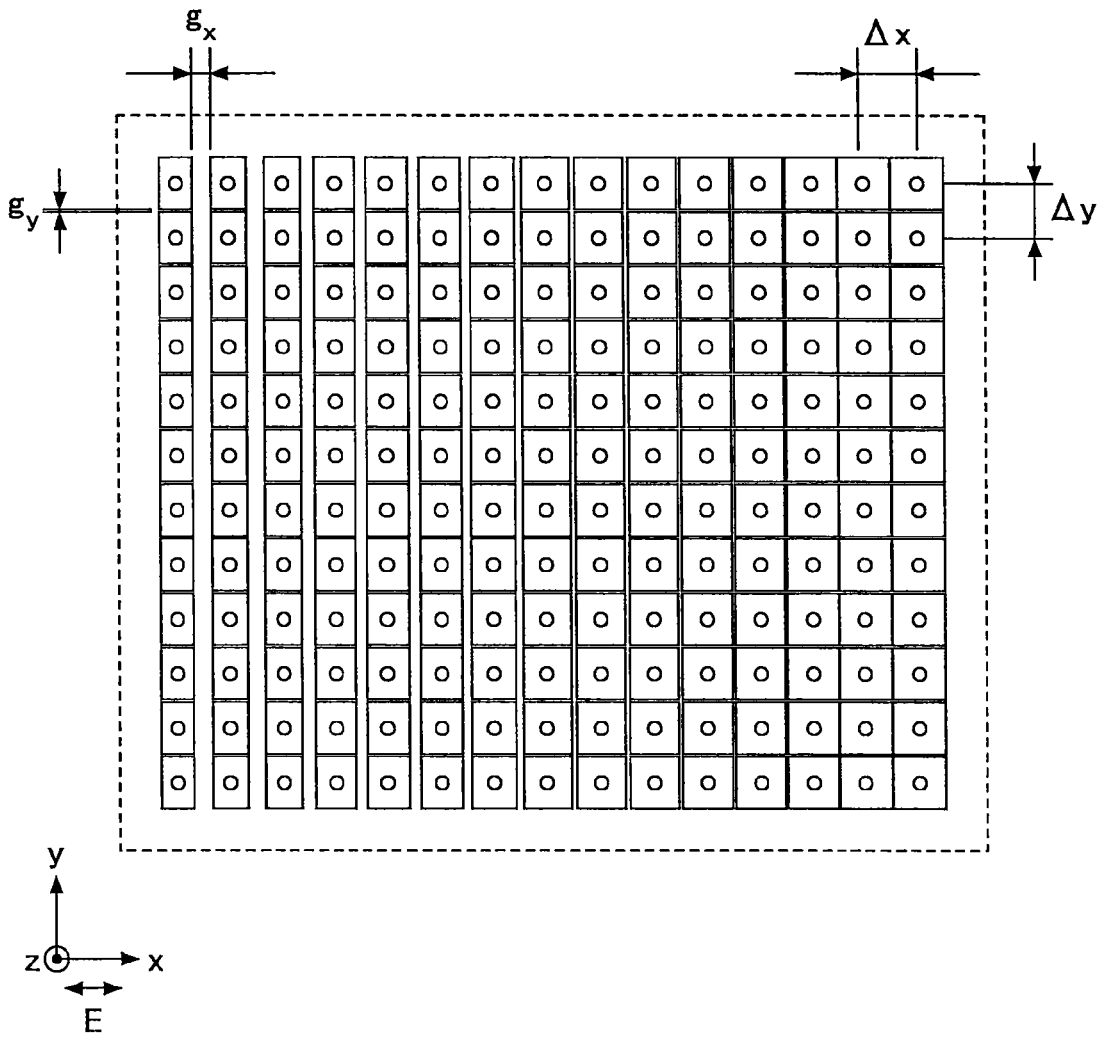
FIG. 8 is a plan view of a reflectarray in vertical control case.
Figure 9:
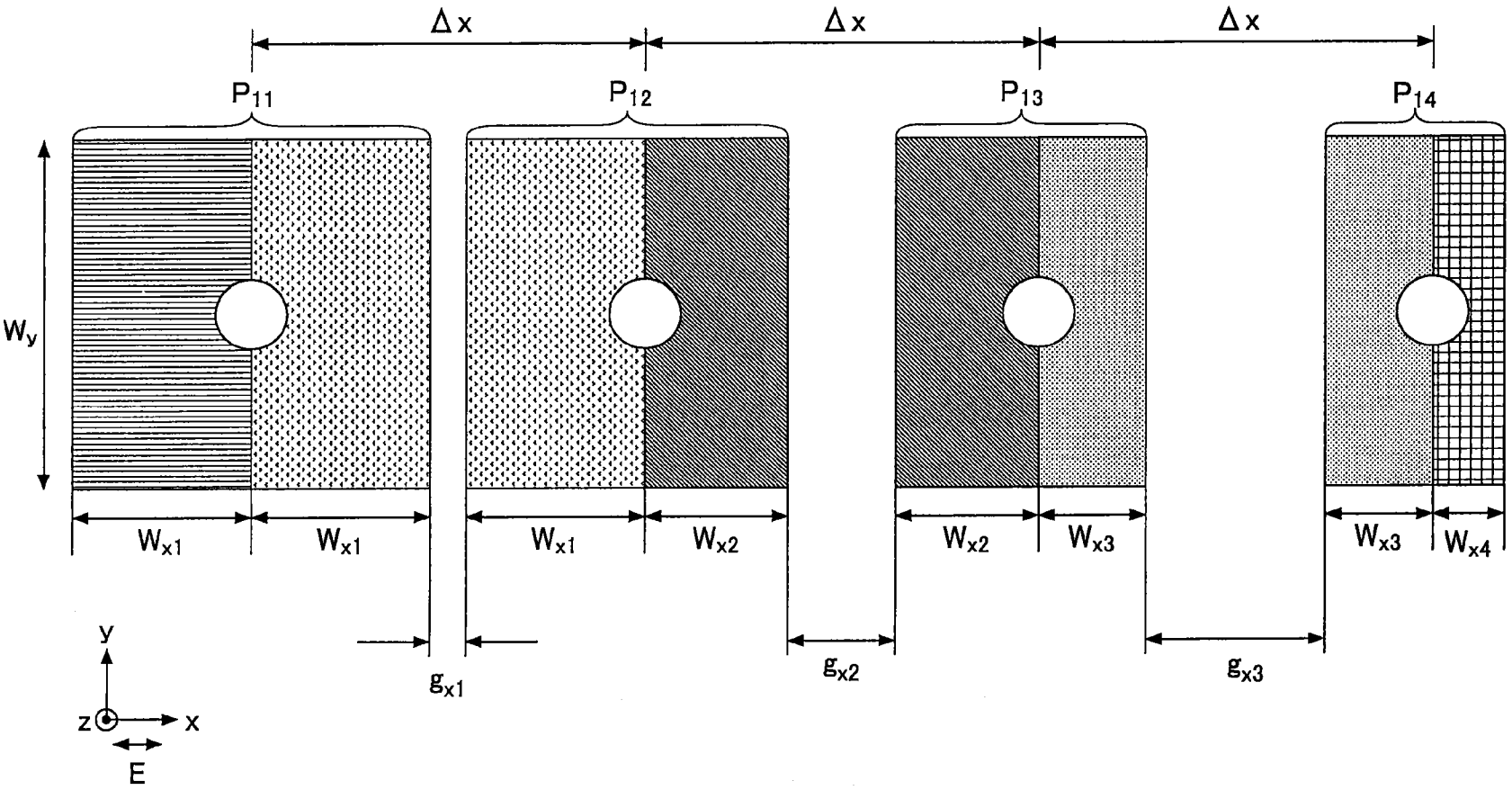
FIG. 9 is a view for illustrating an exemplary patch for vertical control.
Figure 10:
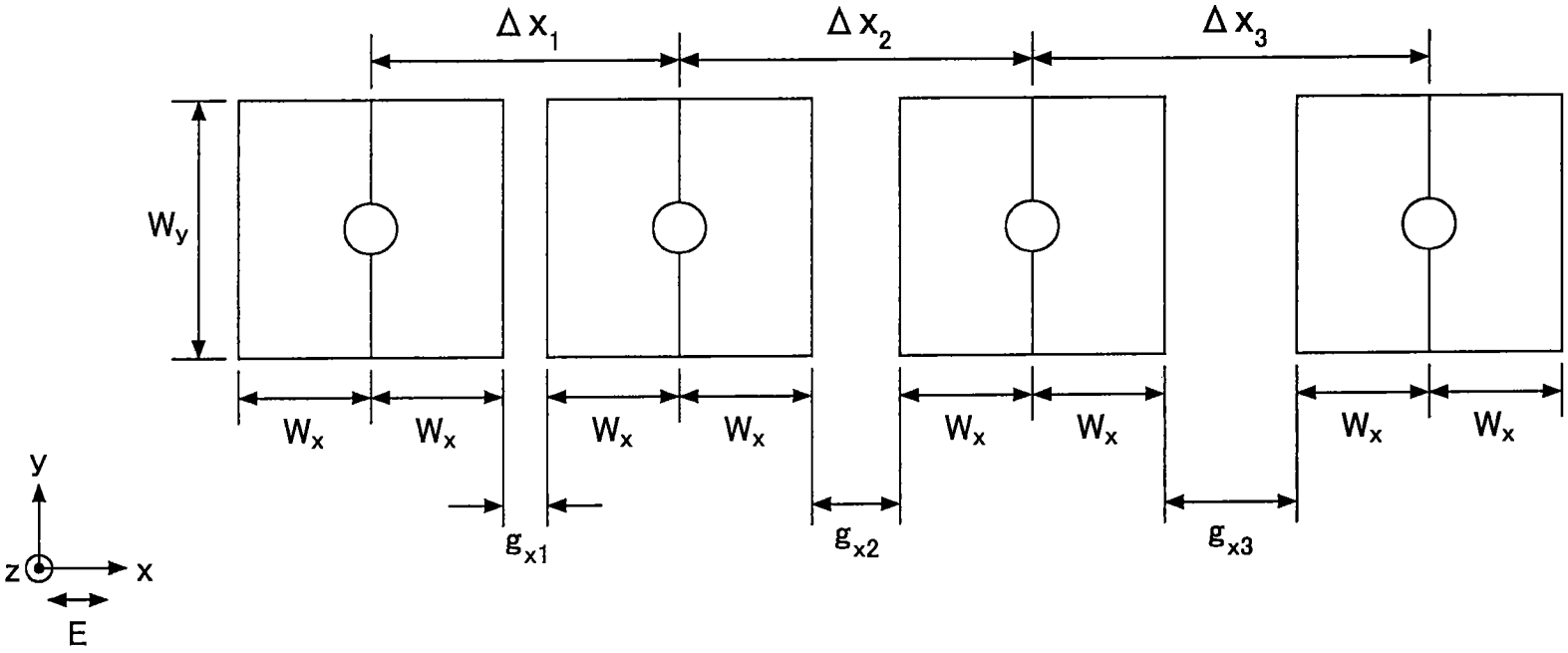
FIG. 10 is a view for illustrating another exemplary patch for vertical control.
Figure 11:
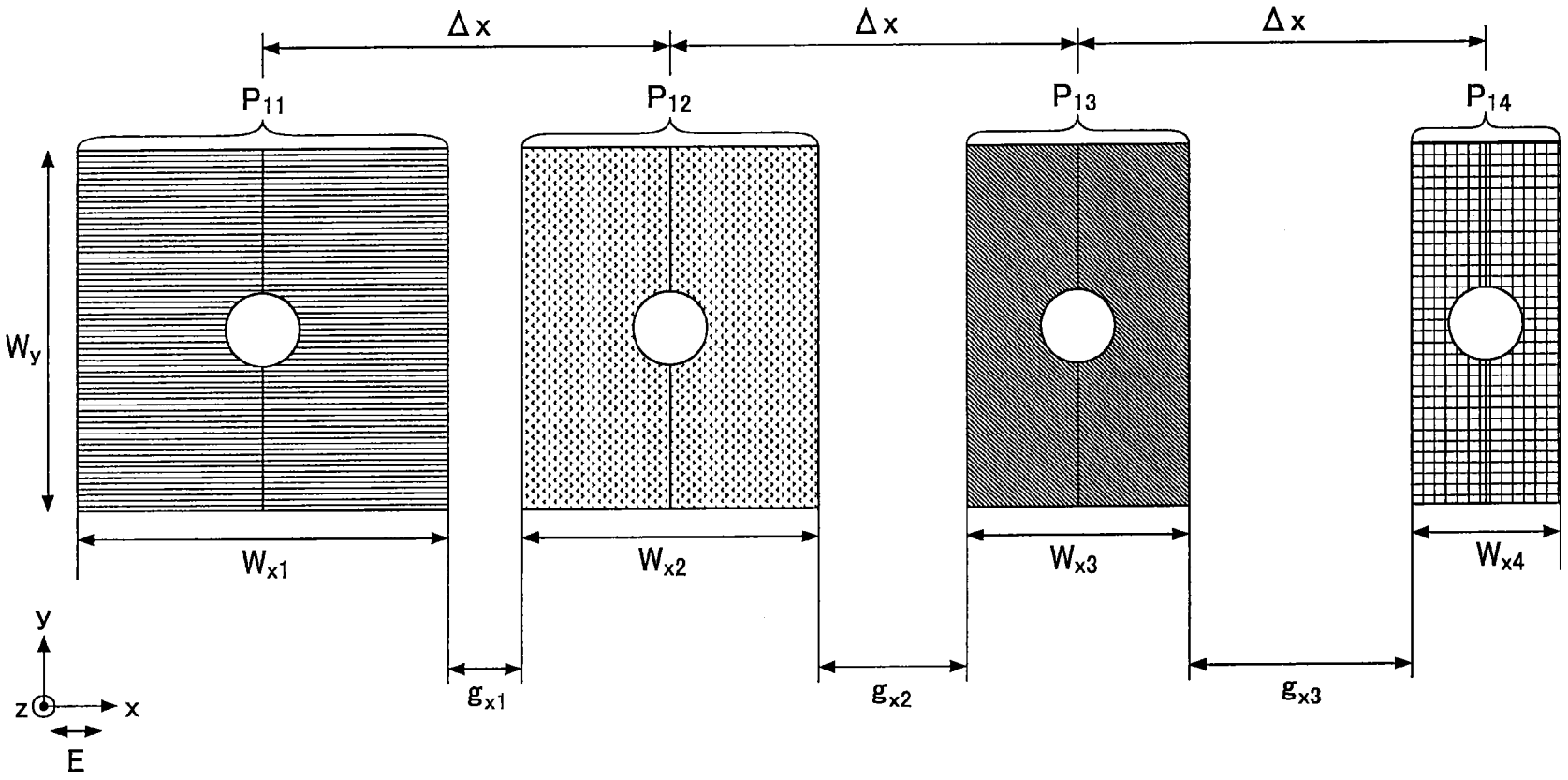
FIG. 11 is a view for illustrating another exemplary patch for vertical control.

By the way, if an electric wave, whose amplitude direction is the y-axis direction, enters a reflectarray in an arrangement as illustrated in FIGS. 4 and 5, the reflection wave will incline to a direction where the reflection phase is changing on the zx plane, that is, in a vertical direction or a lateral direction (x-axis direction) with respect to the y-axis direction. Such control of the reflection wave is referred to as "horizontal control" for convenience. However, the present invention is not limited to the horizontal control. For example, instead of the arrangement as illustrated in FIGS. 4 and 5, a reflectarray can be formed to have a structure as illustrated in FIG. 8 to reflect an electric wave, the amplitude direction of whose electric field is the x-axis direction, in parallel to the electric field direction, that is, to incline the electric wave in the longitudinal direction (x-axis direction). Such control of the reflection wave is referred to as "vertical control" for convenience. In the vertical control, the patch size and the gap can be determined in several manners. For example, as illustrated in FIG. 9, the element interval Δx may be uniform, and individual patches may be asymmetry. Also, as illustrated in FIG. 10, individual patches may be symmetry, and the element interval may not be uniform. Also, as illustrated in FIG. 11, the element interval Δx may be uniform, and individual patches may be designed to be symmetric. These are simply illustrative, and the patch size and the gap may be determined in any appropriate manner.

<2. Dual Polarized Single Band>

Figure 12:
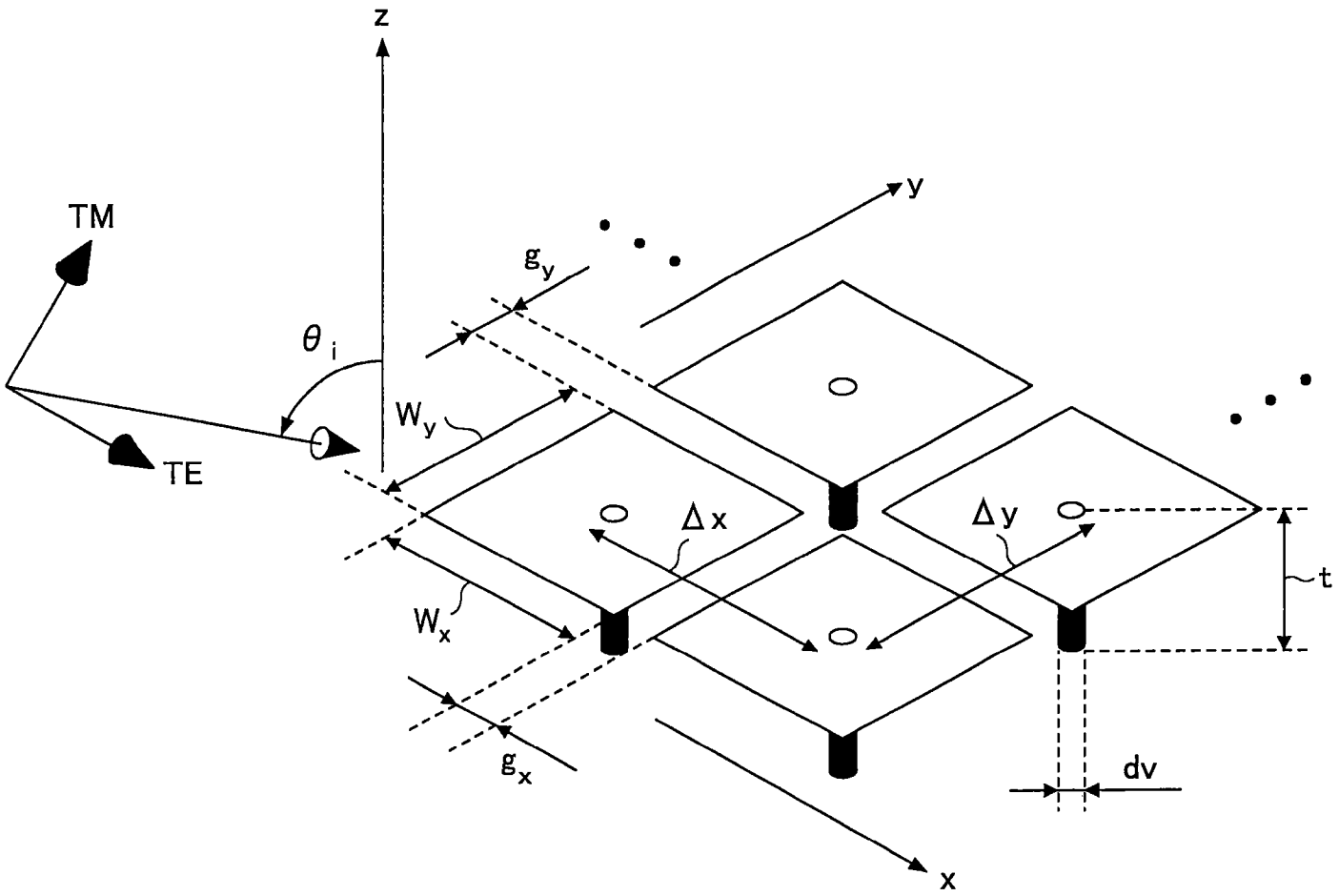
FIG. 12 is a view for illustrating two mutually orthogonally polarized waves entering a reflectarray.

When an electric wave having a x-axis directional electric field component enters a reflectarray for vertical control as illustrated in FIGS. 8-11 along the z-axis, for example, the electric wave reflects to the zx plane by a desired reflection angle. As stated above, the reflection phase of an element is determined based on the capacitance C and the inductance L of the element, and particularly the capacitance C is determined based on a space or a gap between patches. In the case of the vertical control, as illustrated in FIGS. 8-11, the x-axis directional gap gx is set to various values corresponding to various reflection phase values, and the y-axis directional gap gy is kept constant. From this fact, it is said that when an electric wave having a x-axis directional electric field component is reflected to a desired direction, the x-axis directional gap gx strongly affects the reflection wave. As illustrated in FIG. 12, if an electric wave travelling in the yz plane enters a reflectarray defined in the xy plane, the electric wave having the x-axis directional electric field component is a TE (Transverse Electric) wave or a horizontally polarized wave. In this case, "horizontally polarized wave" herein is an electric wave having an electric field component in parallel to an incident plane or the ground (xy plane).

When an electric wave having a y-axis directional electric field component enters a reflectarray along the z-axis for horizontal control as illustrated in FIGS. 4 and 5, the electric wave reflects to the zx plane in a desired reflection angle. As stated above, the reflection phase of an element is determined based on the capacitance C and the inductance L of the element, and particularly the capacitance C is determined based on a space or a gap between patches. In the case of horizontal control, as illustrated in FIGS. 4 and 5, the y-axis directional gap gy is set to various values corresponding to various reflection phase values, and the x-axis directional gap gx is kept constant. From this fact, it is said that when an electric wave having the y-axis directional electric field component is reflected in a desired direction, the y-axis directional gap gy strongly affects the reflection wave. As illustrated in FIG. 12, if an electric wave travelling in the yz plane enters a reflectarray defined in the xy plane, the electric wave having the y-axis directional electric field component is a TM (Transverse Magnetic) wave or a vertically polarized wave. In this case, "vertically polarized wave" herein is an electric wave having a vertical electric field component to an incident plane or the ground (xy plane).

From the above consideration, it can be understood that the x-axis directional gap gx is designed to reflect the TE wave in a desired direction and the y-axis directional gap gy is designed to reflect the TM wave in a desired direction in order to reflect the TE wave and the TM wave arriving from the same direction in the respective desired directions. The desired direction of the TE wave and the desired direction of the TM wave may be the same or different. The frequencies of the TE wave and the TM wave may be the same or different. The case where the TE wave and the TM wave have different frequencies is described in <3. Dual polarized multiband> as set forth.

Figure 13:
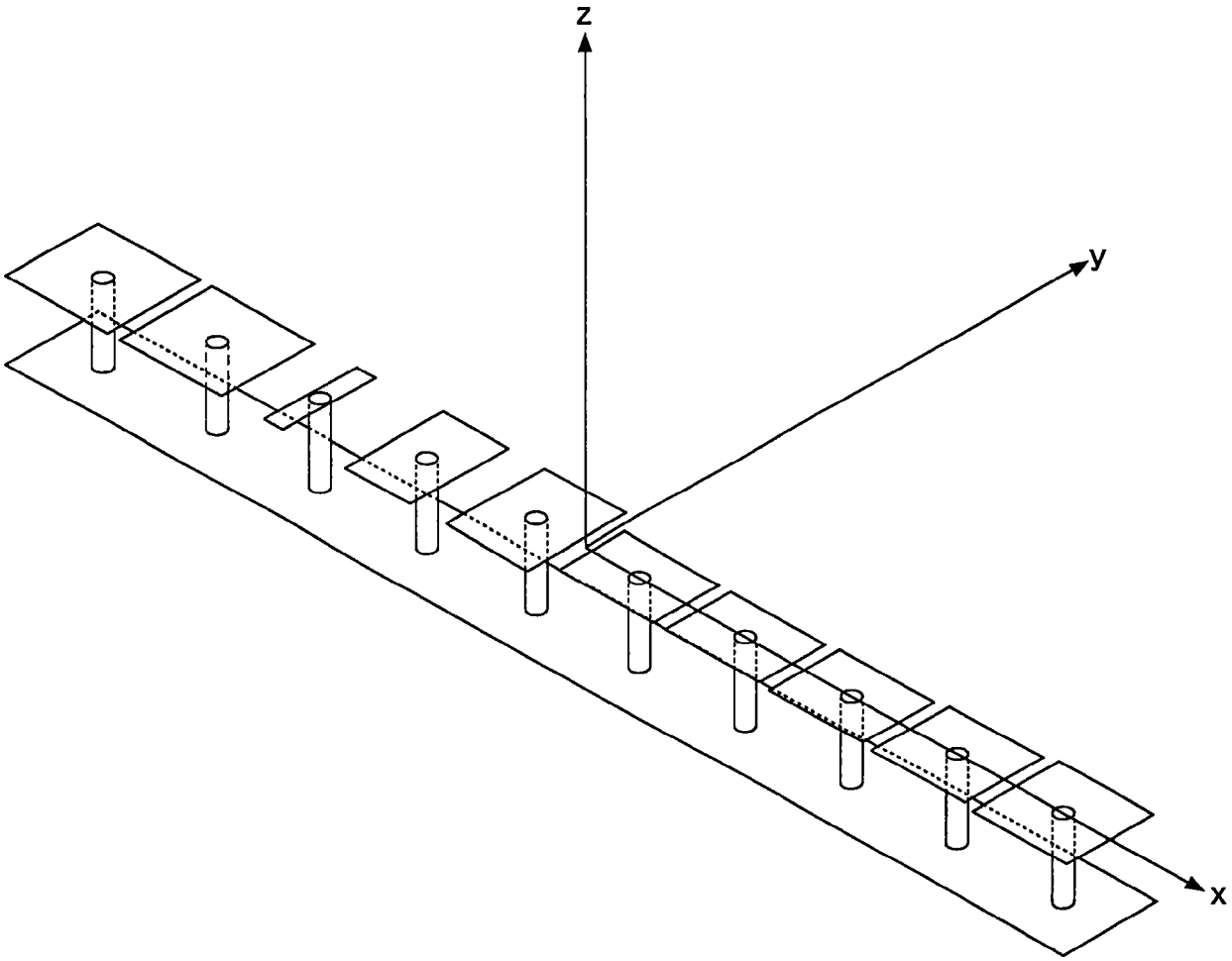
FIG. 13 is a view for illustrating an element sequence of reflectarrays corresponding to one cycle for reflecting a TE wave and a TM wave in an identical direction.
Figure 14:
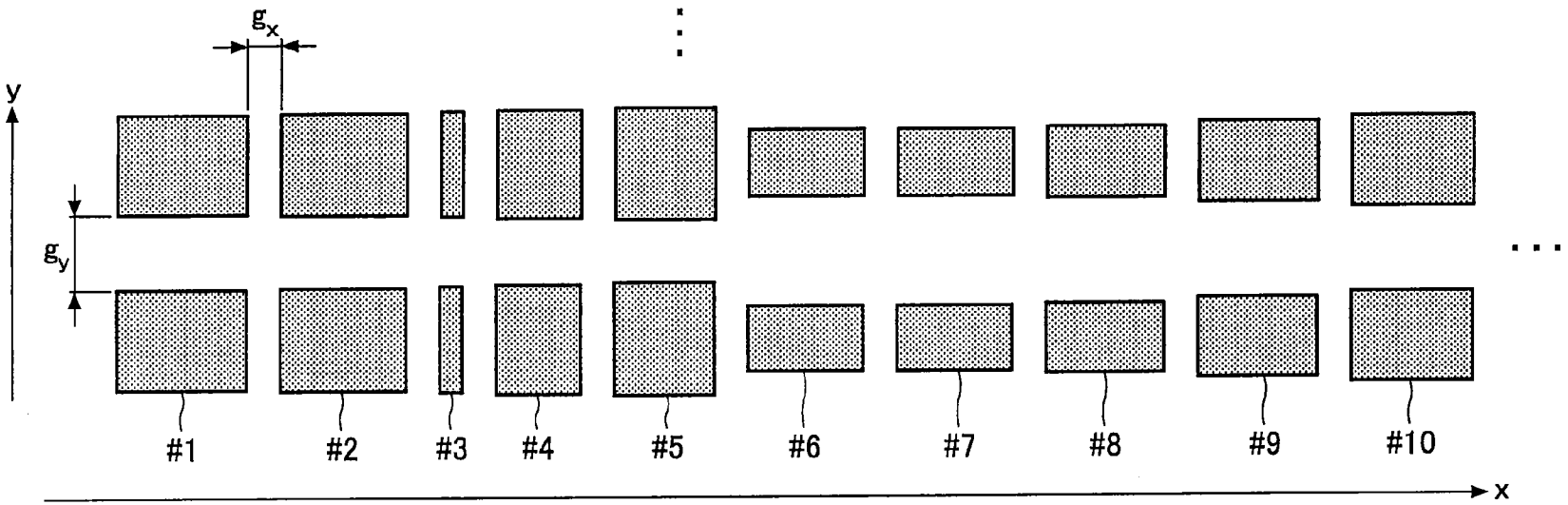
FIG. 14 is a plan view for illustrating two element sequences corresponding to one cycle aligned in the Y-axis direction.

FIG. 13 illustrates an element sequence corresponding to one cycle of a reflectarray for reflecting a TE wave and a TM wave to a uniform direction. In the actual reflectarray, the multiple element sequences corresponding to one cycle as illustrated are arranged in the x-axis and y-axis directions. FIG. 14 illustrates a plan view of two element sequences aligned in the y-axis direction in a reflectarray where many element sequences each corresponding to one cycle as illustrated in FIG. 13 are arranged.

FIG. 15 illustrates various parameter values of each of ten elements as illustrated in FIGS. 13 and 14. Specifically, specific numerical values are illustrated for the size of the y-axis directional gap gy, the reflection phase corresponding to the gap gy (namely, the reflection phase to a TM wave), the size of the x-axis directional gap gx, the reflection phase corresponding to the gap gx (namely, the reflection phase to a TE wave), the y-axis directional patch size Wy and the x-axis directional patch size Wx. The phase difference between reflection waves by respective adjacent elements is 36 degrees ($2\pi/10$ radians). In general, it is preferable that the reflection phase difference by each pair of adjacent elements is a divisor of integral multiples of 360 (for example, 36 degrees) from the standpoint where a reflectarray is arranged by providing a certain element sequence corresponding to one cycle on the xy plane iteratively. However, it is not essential that the reflection phase difference is necessarily equal to an exact divisor of integral multiples of 360, and it is sufficient that the reflection phase difference is substantially equal to the divisor. For example, 27 is not the exact divisor of 360, but since the range of 360 degrees of the reflection phase can be substantially covered by arranging 13 elements with variations of the reflection phase difference by 27 degrees, the reflection phase difference of 27 degrees may be used.

Figure 16A:
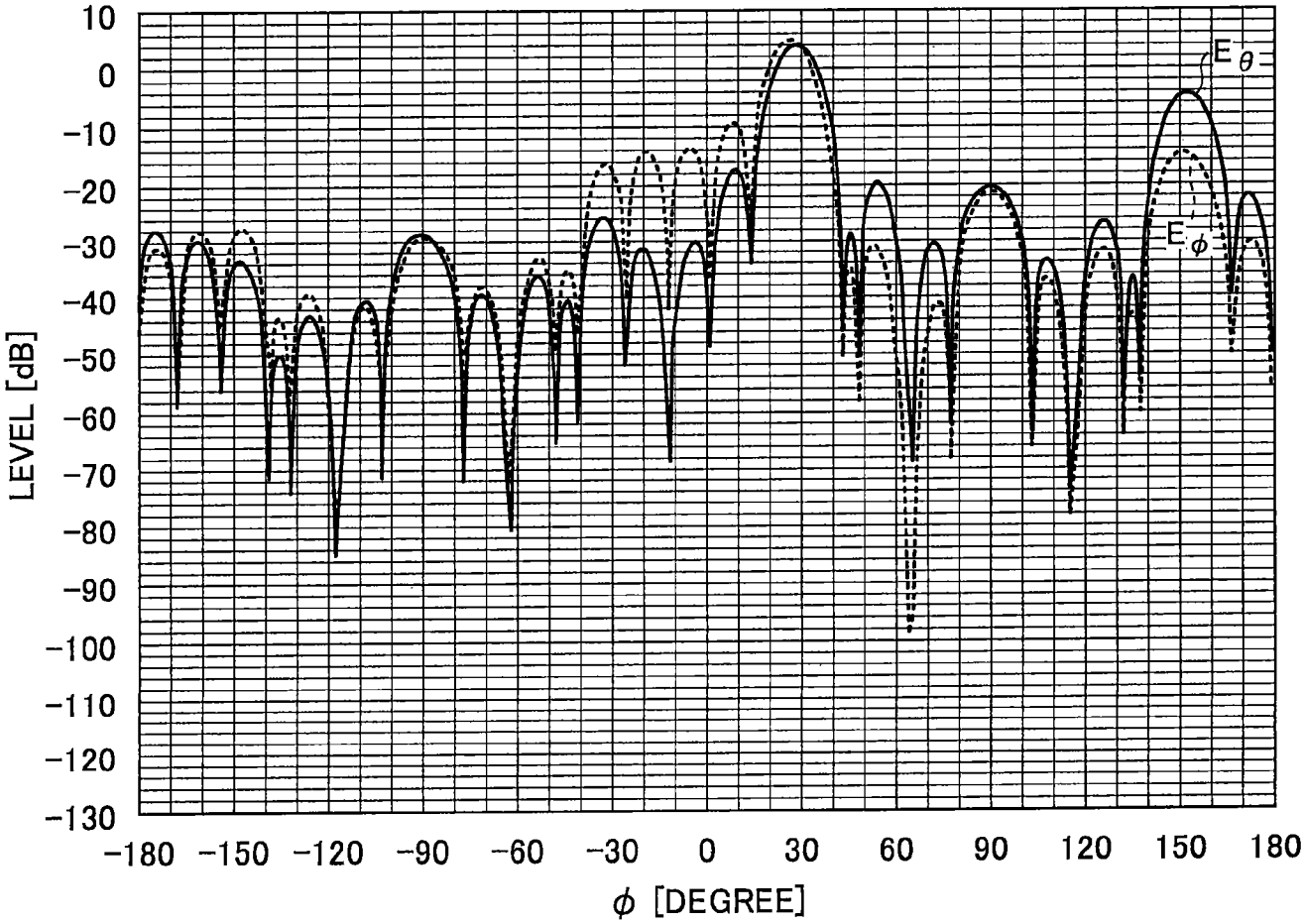
FIG. 16A is a view for illustrating simulation results for element sequences in FIGS. 13-15 ($\theta$=48 degrees)
Figure 16B:
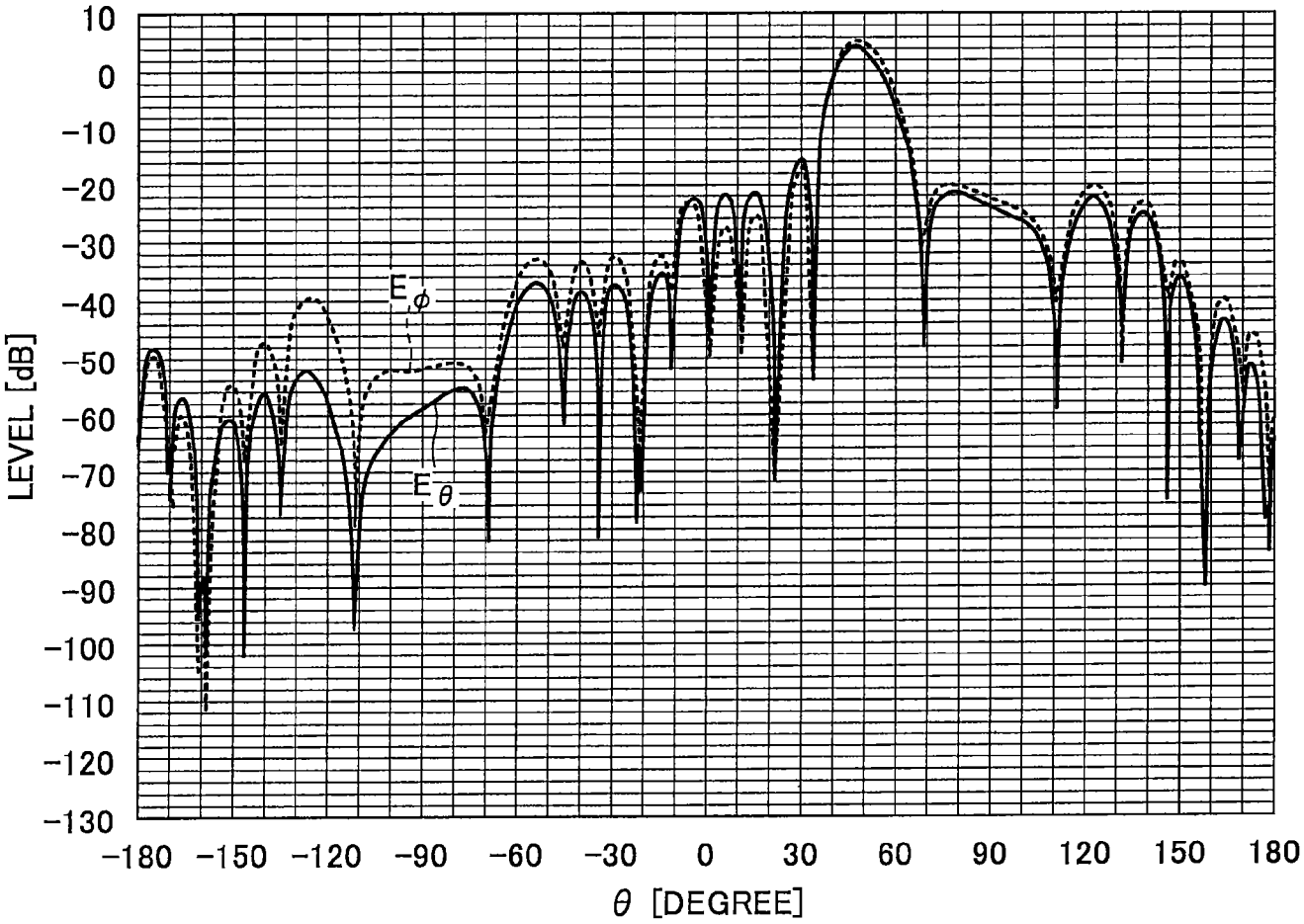
FIG. 16B is a view for illustrating simulation results for element sequences in FIGS. 13-15 ($\phi$=27 degrees)
Figure 17A:
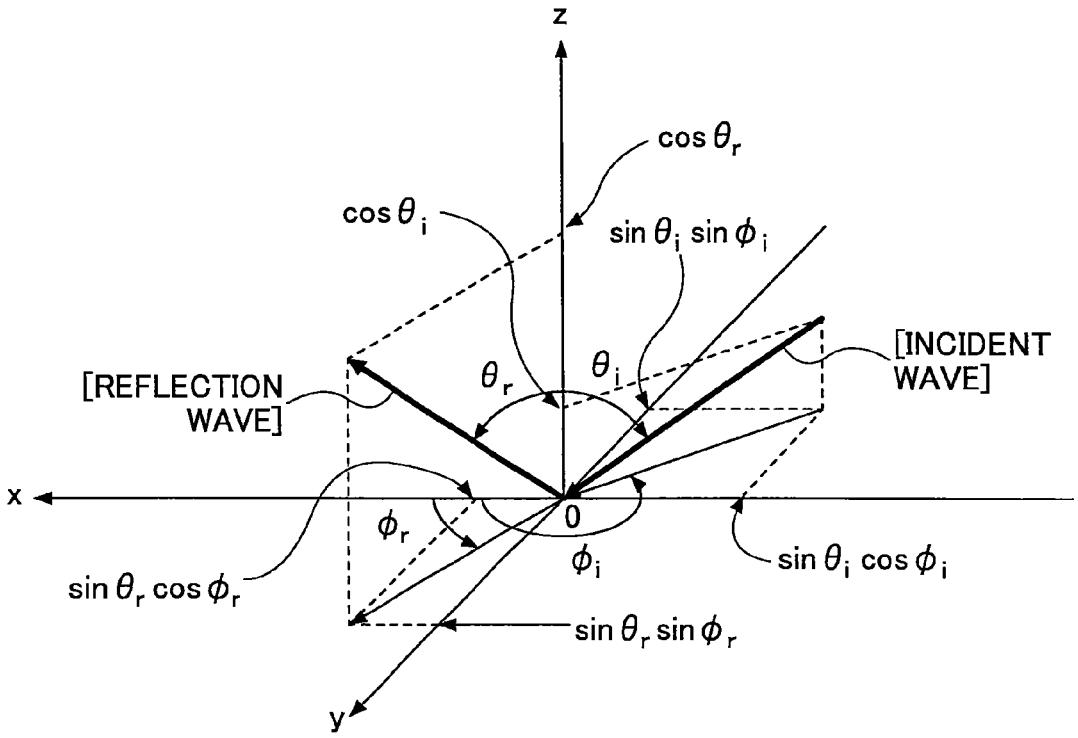
FIG. 17A is a view for illustrating an incident direction and a reflection direction of an electric wave.

FIG. 16A illustrates simulation results on a reflectarray formed of the element sequences as illustrated in FIGS. 13-15. For any of the TE wave and the TM wave, the incident direction of an electric wave is ($\theta_i$, $\phi_i$)=(20 degrees, 270 degrees), and a desired reflection direction is ($\theta_r$, $\phi_r$)=(48 degrees, 27 degrees). Here, as illustrated in FIG. 17A, $\theta_i$ and $\theta_r$ are deflection angles between an incident wave and the z-axis and between a reflection wave and the z-axis, respectively, and $\phi_i$ and $\phi_r$ are deflection angles between an incident wave and the x-axis and between a reflection wave and the x-axis, respectively. In the illustration, $E_\theta$ represents an electric field component with respect to the θ direction of a reflected electric wave, and $E_\phi$ represents an electric field component with respect to the ϕ direction of the reflected electric wave. The illustrated simulation results indicate scattering cross section (dB) in a surface of θ=48 degrees. Any electric field component indicates strong peaks at the desired direction ϕ=27 degrees. FIG. 16B also illustrates similar simulation results but differs from FIG. 16A in that it indicates scattering cross section of an electric wave in a surface of ϕ=27 degrees. As illustrated, any electric field component indicates strong peaks at the desired direction θ=48 degrees. As illustrated in FIGS. 16A and 16B, this reflectarray can reflect a TE wave and a TM wave arriving from ($\theta_i$, $\phi_i$)=(20 degrees, 270 degrees) to the uniform desired direction of ($\theta_r$, $\phi_r$)=(48 degrees, 27 degrees).

In examples as illustrated in FIGS. 13-16, both the number of elements corresponding to one cycle for reflection of a TE wave to a desired direction and the number of elements corresponding to one cycle for reflection of a TM wave to a desired direction are equal to 10, but it is not essential to implementation. The number $N_{TE}$ of elements corresponding to one cycle for reflection of the TE wave and the number $N_{TM}$ of elements corresponding to one cycle for reflection of the TM wave may be different. For example, the number $N_{TE}$ of elements corresponding to one cycle for reflection of the TE wave may be equal to 10, and the number $N_{TM}$ of elements corresponding to one cycle for reflection of the TM wave may be equal to 20. In this case, the phase difference of the reflection waves by respective adjacent elements is 36 degrees (360/10) for the TE wave and 18 degrees (360/20) for the TM wave.

In this manner, by designing the x-axis directional gap gx for reflecting the TE wave and the y-axis directional gap gy for reflecting the TM wave independently, it is possible to reflect the TE wave and the TM wave to the same direction or in different directions as desired.

Note that the x-axis direction and the y-axis direction are simply relative directions under definition of a two-dimensional plane.

Figure 17B:
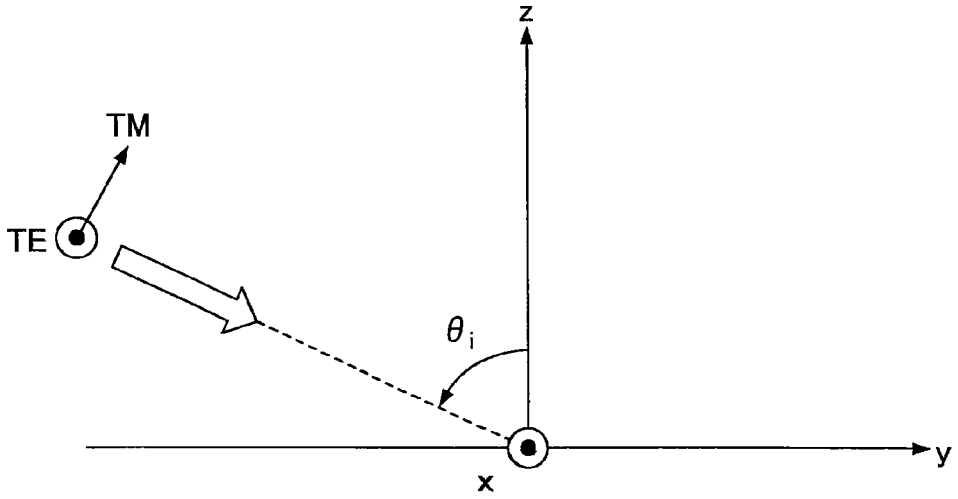
FIG. 17B is a view for illustrating a relationship between an incident direction and a coordinate axis of a polarized wave ($\phi_i$=270 degrees)
Figure 17C:
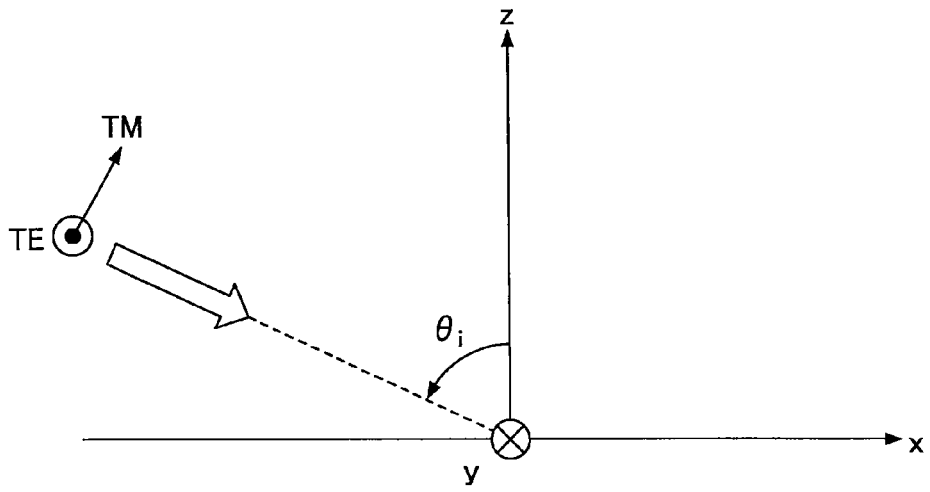
FIG. 17C is a view for illustrating relationship between an incident direction and a coordinate axis of a polarized wave ($\phi_i$=180 degrees)

FIG. 17B illustrates that a TE wave and a TM wave are incoming from the direction $\phi_i$=270 degrees to a reflectarray. The reflectarray is in the xy plane. In this case, the TE wave has a variable electric field component with respect to the x-axis direction, and the TM wave has a variable electric field component with respect to the y-axis and z-axis directions. Accordingly, the reflectarray can be formed by designing the x-axis directional gap gx for reflecting the TE wave and the y-axis directional gap gy for reflecting the TM wave. This is the same as the above example. However, in the example as illustrated in FIG. 17C, the TE wave and the TM wave are incoming from the direction $\phi_i$=180 degrees to the reflectarray. In this case, the TE wave has a variable electric field component with respect to the y-axis direction, and the TM wave has a variable electric field component with respect to the x-axis and z-axis directions. In this case, the reflection wave of the TE wave is strongly affected by the y-axis directional gap gy, and the reflection wave of the TM wave is strongly affected by the x-axis directional gap gx. Accordingly, in the example as illustrated in FIG. 17C, it is necessary to design the y-axis directional gap gy for reflecting the TE wave and the x-axis directional gap gx for reflecting the TM wave. Accordingly, more generally, a gap g1 of one of the two mutually orthogonal axial directions is designed to reflect one of two mutually orthogonal polarized waves, and a gap g2 of the other axial direction is designed to reflect the other polarized wave, which can reflect the two polarized waves to respective desired directions.

<3. Dual Polarized Multiband>

Next, in a case where two polarized waves have different frequencies (multiband case), a reflectarray for reflecting them to a uniform desired direction or different desired directions is considered. As stated above, a reflection phase of a mushroom structure (element) is equal to 0 at a certain resonant frequency, and the reflection phase in reflection of an electric wave having the certain resonant frequency by the element can be appropriately set by adjusting capacitance C and/or inductance L. In designing the reflectarray, it is necessary to appropriately set the reflection phase of individual elements by the capacitance C and/or the inductance L such that an electric wave having a resonant frequency can be reflected to a desired direction.

<<3.1. Dual Resonant>>

In the case where a TM wave is incoming to a reflectarray by an incoming angle $\theta_i$ with respect to the z-axis as illustrated in FIG. 12, a reflection phase (arg(Γ)) of a reflection wave can be represented as follows.

$$\Gamma = \frac{\frac{\varepsilon_{zz}^{TM}}{\gamma_{TM}}\coth(\gamma_{TM}t) + \frac{\varepsilon_{zz}^{TM} - \varepsilon_h}{k}\cot(kt) + \frac{\eta_0}{jk_0}Z_g^{-1} - \frac{1}{jk_z}}{\frac{\varepsilon_{zz}^{TM}}{\gamma_{TM}}\coth(\gamma_{TM}t) + \frac{\varepsilon_{zz}^{TM} - \varepsilon_h}{k}\cot(kt) + \frac{\eta_0}{jk_0}Z_g^{-1} + \frac{1}{jk_z}} \tag{5}$$

$$\gamma_{TM} = \sqrt{k_p^2 + k_t^2 - k^2} \tag{6}$$

where the resonant frequency $r_f$ is represented as $$r_f = f_p/\sqrt{\in_r} = (k_p c)/\sqrt{\in_r} \tag{7}$$

$f_p$ represents a plasma frequency. $\in_r$ represents a relative permittivity of a dielectric substrate lying between a patch and a ground plate. c represents light speed. Plasma frequency $f_p$ satisfies a relationship to plasma wave number $k_p$ as follows, $$f_p = k_p c/(2\pi) \tag{8}$$

The plasma wave number $k_p$ satisfies a relationship to element interval Δx as follows, $$(k_p\Delta x)^2 = \frac{2\pi}{1n\left(\frac{\Delta x}{2\pi(dv/2)}\right) + 0.5275}. \tag{9}$$

where dv represents a diameter of a via. In the above formula (5), $\in_{zz}$ indicates an effective permittivity of a metal medium along a via and is represented in formula (10) below. $\in_h$ indicates a relative permittivity of a substrate composing a mushroom, $\eta_0$ indicates an impedance of a free space. $k_0$ indicates a wave number of the free space, and k indicates a wave number of a mushroom medium and is represented in formula (11) below. $k_z$ indicates a z-component of a wave number vector (wave vector) and is represented in formula (12) below, $$\varepsilon_{zz} = \varepsilon_h\left(1 - \frac{k_p^2}{k^2 - q_z^2}\right) \tag{10}$$

$$k = k_0\sqrt{\varepsilon_h} \tag{11}$$

-continued $$k_z = \sqrt{k_0^2 - k_t^2} \tag{12}$$

where $Z_g$ in formula (5) indicates a surface impedance and satisfies a relationship below, $$Z_g = -j\frac{\eta_{eff}}{2\alpha} \tag{13}$$

where $\eta_{eff}$ indicates an effective impedance represented in formula (14) below, and α is a grid parameter represented in formula (15) below.

$$\eta_{eff} = \sqrt{\mu_0/\varepsilon_0\varepsilon_{eff}} \tag{14}$$

$$\alpha = \frac{k_{eff}\Delta_v}{\pi}1n\left(\sin^{-1}\left(\frac{\pi g}{2\Delta_v}\right)\right) \tag{15}$$

As illustrated in FIG. 12, similar calculation can be applied for the case where a TE wave is incoming to a reflectarray by an incident angle $\theta_i$ with respect to the z-axis. Note that surface impedance $Z^{TE}$ as represented below must be used, $$Z^{TE} = \frac{j\omega\mu\frac{\tan(\beta t)}{\beta}}{1 - 2k_{eff}\alpha\frac{\tan(\beta t)}{\beta}\left(1 - \frac{2}{\varepsilon_r + 1}\sin^2\theta\right)}. \tag{16}$$

Figure 18:
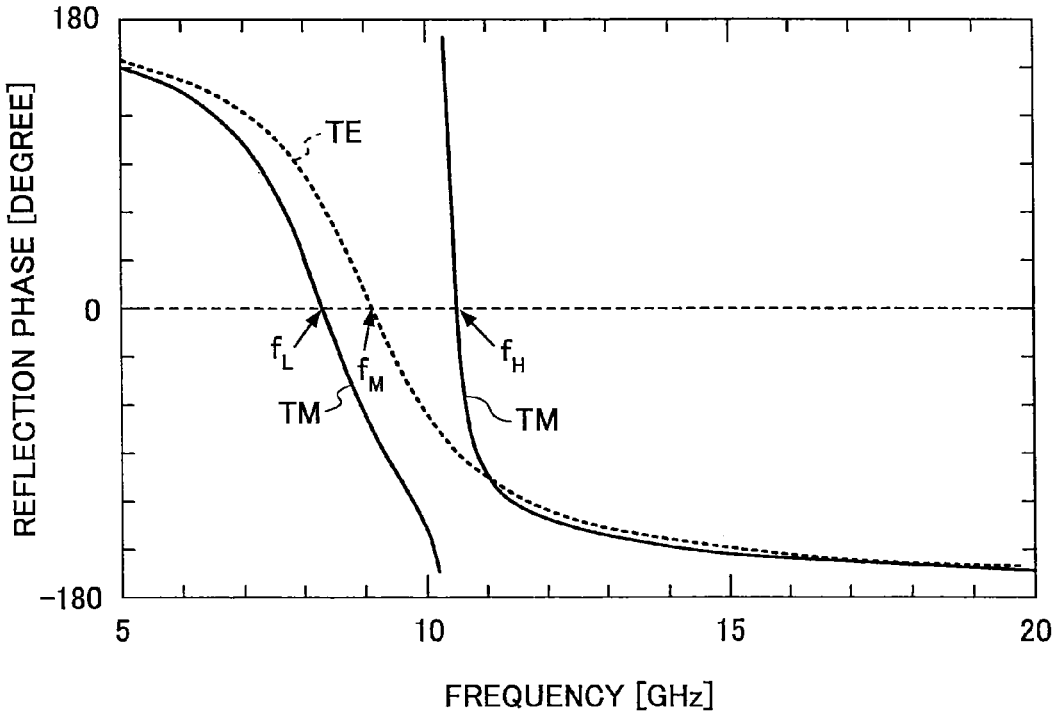
FIG. 18 is a view for illustrating a reflection phase of a reflection wave as a function of frequency in a case where a TE wave and a TM wave are entering a reflectarray having elements aligned in an equal interval in the x and y-axis directions.

FIG. 18 illustrates a reflection phase of a reflection wave as a function of frequency in the case where a TE wave and a TM wave are incoming to a reflectarray having elements aligned in an equal interval in the x-axis and y-axis directions. In simulation, it is assumed that the substrate relative permittivity $\in_r$ is 4.5, the height t of a via (that is, the distance between a ground plate and a patch) is 1.52 mm, the x-axis directional element interval $\Delta_x$ is 4.1 mm, and the y-axis directional element interval $\Delta_y$ is 4.1 mm. Any of incident directions of the TE wave and the TM wave is ($\theta_i$, $\phi_i$)=(20 degrees, 270 degrees). As illustrated, in the case of the TE wave, when the frequency increases from 5 GHz, the reflection phase will gradually decrease from 150 degrees and become 0 at the frequency of 9 GHz ($f_M$). As the frequency further increases, the reflection phase will decrease. In the case of the TM wave, when the frequency increases from 5 GHz, the reflection phase will rapidly decrease from 150 degrees and become 0 at the frequency of 8.25 GHz ($f_L$). As the frequency increases, the reflection phase will decrease. When the frequency exceeds 10 GHz, the reflection phase will reach about −180 degrees. As the frequency further increases, the reflection phase will become +180 degrees and decreases rapidly. When the frequency is 11 GHz ($f_H$), the reflection phase will become 0. Then, as the frequency further increases, the reflection phase will decrease. In this manner, in the TM wave case, there are two frequencies ($f_L$, $f_H$) where the reflection phase is 0 degree. Such a decrease is referred to as dual resonance or spurious resonance. As stated above, the reflection phase of a mushroom structure (element) is 0 at the resonant frequency, and an electric wave at the resonant frequency can be reflected in a desired direction by adjusting capacitance C and/or inductance L of multiple elements forming a reflectarray.

Accordingly, by using the frequency $f_L$, $f_M$ and $f_H$ resulting in the reflection phase of 0 degree as frequencies of different polarized waves, a reflectarray for reflecting the polarized waves of different frequencies in respective desired directions can be implemented. In other words, it is possible to reflect two polarized waves in multiple bands to respective desired directions by designing an x-axis directional gap gx for appropriate reflection of a TE wave of a first frequency and a y-axis directional gap gy for appropriate reflection of a TM wave of a second frequency. As described in <2. Dual polarized wave single band>, if an electric wave having an x-axis directional electric field component is reflected to a desired direction, the x-axis directional gap gx dominantly affects the reflection wave. On the other hand, if an electric wave having a y-axis directional electric field component is reflected to a desired direction, the y-axis directional gap gy dominantly affects the reflection wave. The multiband case is similar in terms of this point. In an example as described below, it is assumed that the frequency of a TE wave (first frequency) is $f_L$=8.25 GHz and the frequency of a TM wave (second frequency) is $f_H$=11 GHz, but it is not essential.

Figure 19:
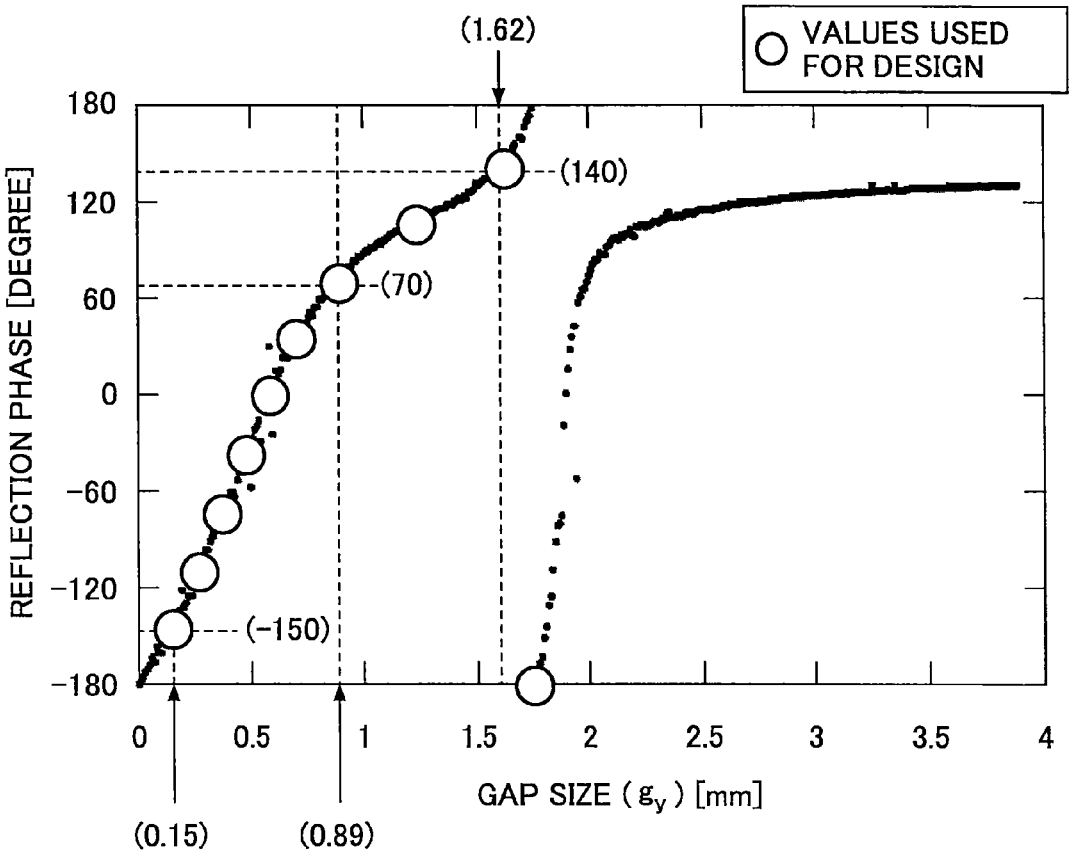
FIG. 19 is a view for illustrating a relationship between a y-axis directional gap size and reflection phase of an element.
Figure 20:
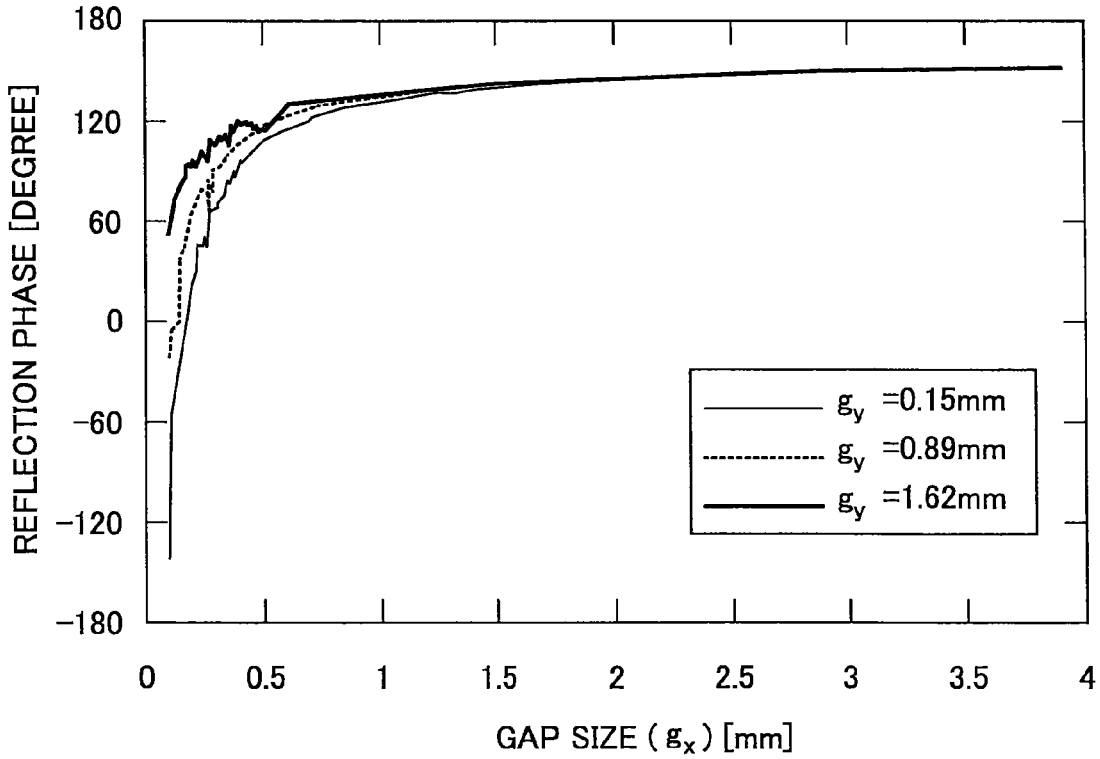
FIG. 20 is a view for illustrating a relationship between a x-axis directional gap size and reflection phase of an element.

FIG. 19 illustrates a relationship between the y-axis directional gap size gy and the reflection phase of a mushroom structure element. In FIG. 19, the electric wave is a TM wave, and the incident angle $\theta_i$ is 20 degrees. The illustrated graph is simply illustrative, and other graphs would be drawn for other parameter values. FIG. 20 illustrates a relationship between the x-axis directional gap size gx and the reflection phase of a mushroom structure element. In FIG. 20, the electric wave is a TE wave, and the incident wave $\theta_i$ is 20 degrees. The illustrated graph is simply illustrative, and other graphs would be drawn for other parameter values. In implementing a reflectarray, it is necessary to design the x-axis directional gap gx to reflect the TE wave of a first frequency $f_L$ appropriately and the y-axis directional gap gy to reflect the TM wave of a second frequency $f_H$ appropriately.

One example of a scheme for determining the gap sizes gx and gy and the reflection phase may be as follows. First, the reflection phase to be implemented for a TM wave at a certain element is determined, and the y-axis directional gap size gy value corresponding to the reflection phase is derived in the graph in FIG. 19. Then, in FIG. 20, a graph corresponding to the case where the y-axis directional gap size is gy is used to determine the x-axis directional gap size gx and the reflection phase. By repeating this procedure, the gap sizes gx and gy of individual elements can be determined. For example, in the case where the reflection phase to the TM wave is set to −150 degrees, it can be seen in FIG. 19 that the y-axis directional gap size gy is 0.15 mm. In FIG. 20, a graph corresponding to the case where the y-axis directional gap size gy is 0.15 mm is used to determine the x-axis directional gap size gx and the reflection phase. In the case where the reflection phase to a TM wave is set to +70 degrees, it can be seen in FIG. 19 that the y-axis directional gap size gy is 0.89 mm. In FIG. 20, a graph corresponding to the case where the y-axis directional gap size gy is 0.89 mm is used to determine the x-axis directional gap size gx and the reflection phase. In the case where the reflection phase to a TM wave is set to +140 degrees, it can be seen in FIG. 19 that the y-axis directional gap size gy is 1.62 mm. In FIG. 20, a graph corresponding to the case where the y-axis directional gap size gy is 1.62 mm is used to determine the x-axis directional gap size gx and the reflection phase. Such a scheme of determining the gap sizes gx and gy and the reflection phase is simply illustrative, and the gap sizes gx and gy and the reflection phase may be determined in any appropriate manner.

<<3.2. Periodic Boundary>>

If a reflectarray is formed such that the gap sizes gx and gy between element patches change along the x-axis direction and the reflection phase of a TE wave and a TM wave gradually changes along the a-axis direction, it is difficult to change the reflection phase in the y-axis direction. Accordingly, it is desirable to form a reflectarray by forming an element sequence corresponding to one cycle forming the reflectarray from multiple elements aligned in line in the x-axis direction and arranging a large number of the resulting element sequences. In this manner, by setting a periodic boundary in the element sequences, it is possible to significantly simplify designing the reflectarray.

A condition for setting the periodic boundary is derived below.

It is assumed that an incident direction and a reflection direction of an electric wave are set as illustrated in FIG. 17A. In the illustrated example, the incident wave arrives from the direction of $\theta=\theta_i$ and $\phi=\phi_i$ in (rθφ)-polar coordinates and the reflection wave travels toward the direction of $\theta=\theta_r$ and $\phi=\phi_r$. The origin corresponds to one element in a reflectarray. An incident unit vector $u_i$ along the travelling direction of the incident wave can be written as $$u_i=(u_{ix},u_{iy},u_{iz})(\sin\theta_i\cos\phi_i,\ \sin\theta_i\sin\phi_i,\ \cos\theta_i) \quad (17).$$

A reflection unit vector $u_r$ along the travelling direction of the reflection wave can be written as $$u_r=(u_{rx},u_{ry},u_{rz})=(\sin\theta_r\cos\phi_r,\ \sin\theta_r\sin\phi_r,\ \cos\theta_r) \quad (18).$$

Figure 21:
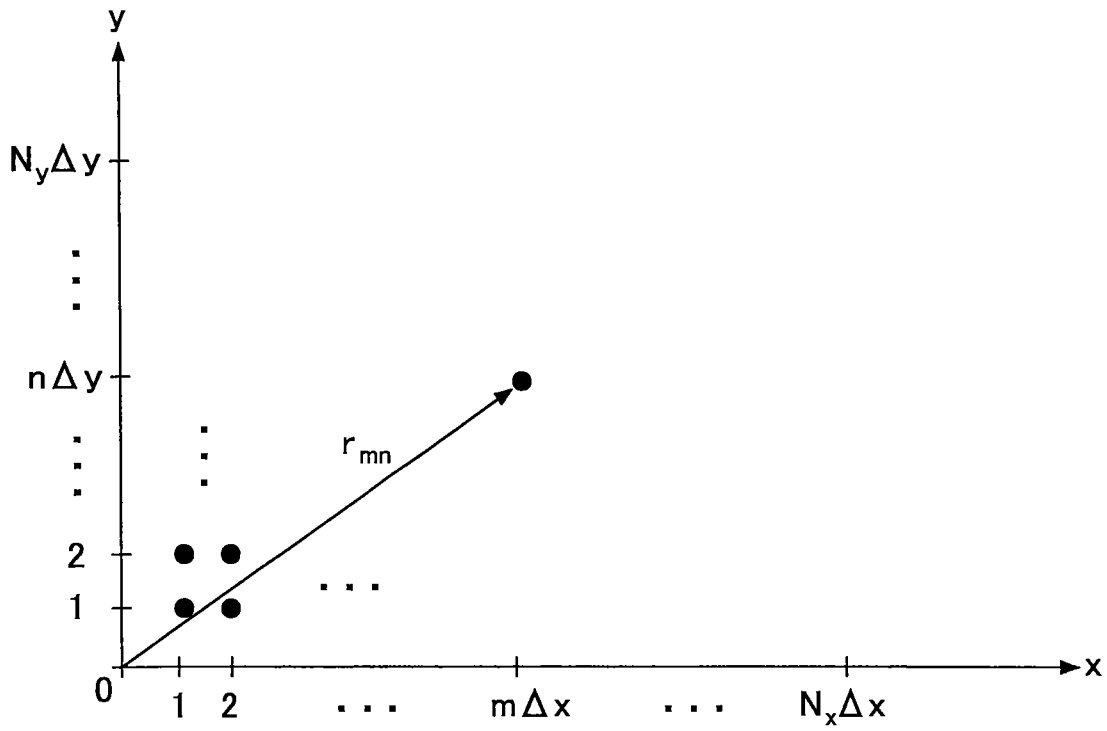
FIG. 21 is a view for illustrating that a central coordinate of each of multiple elements composing a reflectarray is at ($m\Delta x$, $n\Delta y$, 0)

As illustrated in FIG. 21, it is assumed that the center coordinates of each of multiple elements composing a reflectarray are at (mΔx, nΔy, 0). Here, m=0, 1, 2, . . . , $N_x$ and n=0, 1, 2, . . . , $N_y$, and $N_x$ is the maximum value of m and $N_y$ is the maximum value of n. A position vector $r_{mn}$ of an element at the m-th in the x-axis direction and the n-th in the y-axis direction (referred to as the mn-th element for convenience) can be written as follows, $$r_{mn}(m\Delta x,n\Delta y,0) \quad (19).$$

In this case, reflection phase $\alpha_{mn}(f)$ to be implemented at the mn-th element can be written as follows, $$\alpha_{mn}(f)=(2\pi f/c)(r_{mn}\cdot u_i-r_{mn}\cdot u_r)+2\pi N \quad (20),$$

where "·" represents an inner product of vectors. C represents light speed, f represents a frequency of an electric wave (f=c/λ), and λ represents a wavelength of an electric wave. By substituting formulae (17)-(19) into formula (20), the reflection phase $\alpha_{mn}(f)$ to be implemented at the mn-th element can be written as follows, $$\alpha_{mn}(f)=(2\pi f/c)(m\Delta x\sin\theta_i\cos\phi_i+n\Delta y\sin\theta_i\sin\phi_i-m\Delta x\sin\theta_r\cos\phi_r-n\Delta y\sin\theta_r\sin\phi_r)=(2\pi f/c)m\Delta x(\sin\theta_i\cos\phi_i-\sin\theta_r\cos\phi_r)+(2\pi f/c)n\Delta y(\sin\theta_i\sin\phi_i-\sin\theta_r\sin\phi_r) \quad (21),$$

where it is assumed that 2πN=0 without loss of generality. Here, $\alpha_{mn}$ (f) can be set to any value by formula (21). However, in order to arrange a reflectarray by providing a certain element sequence corresponding to one cycle on a xy-plane in an iterative manner, it is preferable that a difference ($\alpha_{mn}(f)-\alpha_{m-1n}(f)$ or $\alpha_{mn}(f)-\alpha_{mn-1}(f)$) of the reflection phase by each of adjacent elements be an divisor of integral multiples of 360 (for example, 36 degrees).

In general, the reflection phase $\alpha_{mn}(f)$ to be implemented at the mn-th element depends on Δx and Δy with reference to formula (21). However, assuming that ($\sin\theta_i \sin\phi_i - \sin\theta_r \sin\phi_r$) multiplied to $\Delta y$ is identically equal to 0 in formula (21), the reflection phase $\alpha_{mn}(f)$ does not depend on $\Delta y$ any more. In this case, the reflection phase $\alpha_{mn}(f)$ gradually changes in the x-axis direction but can be kept constant in the y-axis direction. In this manner, by causing the reflection phase to be implemented at individual elements to change in the x-axis direction but to be kept constant in the y-axis direction, the reflectarray can be simply implemented.

If ($\sin\theta_i \sin\phi_i - \sin\theta_r \sin\phi_r$) multiplied to $\Delta y$ is equal to 0, the formula $$\sin\theta_i \sin\phi_i = \sin\theta_r \sin\phi_r \tag{22}$$

holds. This means that the magnitude of the y component of the incident unit vector $u_i$ of an incident wave is equal to the magnitude of the y component of the reflection unit vector $u_r$ of the reflection wave in FIG. 17A. In other words, if the y components of the incident unit vector and the reflection unit vector are the same, the reflection phase to be implemented at individual elements can be changed in the x-axis direction and made constant in the y-axis direction. Formula (22) can be also written as follows, $$\sin\theta_r = \sin\theta_i \sin\phi_i / \sin\phi_r \tag{23}$$

$$\theta_r = \arcsin(\sin\theta_i \sin\phi_i / \sin\phi_r) \tag{24}$$

Accordingly, a deflection angle $\theta_r$ from the z-axis of the reflection wave can be uniquely determined based on a deflection angle $\phi_r$ from the x-axis of the reflection wave. If formulae (22)-(24) are satisfied, the reflection phase $\alpha_{mn}(f)$ to be implemented at the mn-th element can be written as follows, $$\alpha_{mn}(f) = (2\pi f/c)m\Delta x(\sin\theta_i \cos\phi_i - \sin\theta_r \cos\phi_r) = (2\pi f/c)m\Delta x[\sin\theta_i \cos\phi_i - (\sin\theta_i \sin\phi_i/\sin\phi_r)\cos\phi_r] \tag{25}$$

Accordingly, the reflection phase $\alpha_{mn}(f)$ to be implemented at the mn-th element can be uniquely determined based on the deflection angle $\phi_r$ from the x-axis of the reflection wave.

As one example, it is assumed that the deflection angle $\phi_i$ of an incident wave from the x-axis is 270 degrees. In this case, since $\sin\phi_i = -1$ and $\cos\phi_i = 0$, equations as set forth hold, $$\theta_r = \arcsin(-\sin\theta_i/\sin\phi_r) \tag{26}$$

$$\alpha_{mn}(f) = (2\pi f/c)m\Delta x[(\sin\theta_i/\sin\phi_r)\cos\phi_r] \tag{27}$$

In this manner, by causing formula (25) or (27) to be satisfied, the reflection phase of a TE wave and a TM wave can gradually change along the x-axis direction, but the reflection phase can be kept unchanged along the y-axis direction. As a result, an element sequence corresponding to one cycle forming a reflectarray can be formed of multiple elements aligned in line in the x-axis direction, and it is possible to significantly simplify designing the reflectarray by setting such a periodic boundary.

<<3.3. Reflection Direction>>

The reflection phase $\alpha_{mn}(f)$ of the mn-th element depends on frequency f with reference to formulae (21), (25) and (27) (specifically, $\alpha_{mn}(f) \propto f$). Accordingly, the reflection phase $\alpha_{mn}(f_L)$ of the element at a first frequency $f_L$ and the reflection phase $\alpha_{mn}(f_H)$ of the element at a second frequency $f_H$ are not the same in general. As a result, generally speaking, the reflection direction of a TE wave of the first frequency $f_L$ with a reflectarray and the reflection direction of a TM wave of the second frequency $f_H$ with the reflectarray are independently controlled.

A condition to cause a TE wave and a TM wave to be incident from the same direction and to be reflected to a desired identical direction ($\theta_r$, $\phi_r$) is considered below.

By utilizing analysis results in the above-stated <<3.2 Periodic boundary>>, one cycle of a reflectarray can be formed by aligning multiple elements in line in the x-axis direction such that the reflection phase of a TE wave and a TM wave gradually changes along the x-axis direction but the reflection phase remains unchanged along the y-axis direction. Here, a difference of the reflection phase between adjacent elements may take different values depending on the frequency.

The difference $\Delta\alpha_x(f)$ between the reflection phase $\alpha_{mn}(F)$ by the mn-th element at coordinates ($m\Delta x$, $n\Delta y$, 0) and the reflection phase $\alpha_{m-1n}(f)$ by the (m−1)n-th element at coordinates ($(m-1)\Delta x$, $n\Delta y$, 0) can be written based on formula as follows, $$\Delta\alpha_x(f) = \alpha_{mn}(f) - \alpha_{m-1n}(f) = (2\pi f/c)m\Delta x(\sin\theta_i \cos\phi_i - \sin\theta_r \cos\phi_r) + (2\pi f/c)n\Delta y(\sin\theta_i \sin\phi_i - \sin\theta_r \sin\phi_r) - (2\pi f/c)(m-1)\Delta x(\sin\theta_i \cos\phi_i - \sin\theta_r \cos\phi_r) - (2\pi f/c)n\Delta y(\sin\theta_i \sin\phi_i - \sin\theta_r \sin\phi_r) = (2\pi f/c)\Delta x(\sin\theta_i \cos\phi_i - \sin\theta_r \cos\phi_r) \tag{28}$$

Accordingly, if the incident direction ($\theta_i$, $\theta_i$) and the desired direction ($\theta_r$, $\phi_r$) of a TE wave and a TM wave are the same, the reflection phase difference $\Delta\alpha_x(f_L)$ to the TE wave of the first frequency $f_L$ and the reflection phase difference $\Delta\alpha_x(f_H)$ to the TM wave of the second frequency $f_H$ can be written as follows, respectively, $$\Delta\alpha_x(f_L) = (2\pi f_L/c)\Delta x(\sin\theta_i \cos\phi_i - \sin\theta_r \cos\phi_r) \tag{29}$$

$$\Delta\alpha_x(f_H) = (2\pi f_H/c)\Delta x(\sin\theta_i \cos\phi_i - \sin\theta_r \cos\phi_r) \tag{30}$$

By calculating a ratio between formula (29) and formula (30), we can obtain $$\Delta\alpha_x(f_L) : \Delta\alpha_x(f_H) = f_L : f_H \tag{31}$$

In other words, if the ratio between the reflection phase difference $\Delta\alpha_x(f_L)$ to the TE wave of the first frequency $f_L$ and the reflection phase difference $\Delta\alpha_x(f_H)$ to the TM wave of the second frequency $f_H$ is the same as the ratio between the first frequency $f_L$ and the second frequency $f_H$, the TE wave and the TM wave can be reflected to the same desired direction ($\theta_r$, $\phi_r$).

For example, in this example, the first frequency is $f_L$=8.25 GHz and the second frequency is $f_H$=11 GHz. Accordingly, if the reflection phase difference $\Delta\alpha_x(f_H)$ of adjacent elements in the TM wave case is 36 degrees, the reflection phase difference $\Delta\alpha_x(f_L)$ of adjacent elements in the TE wave case will be about 27 degrees=36×8.25/11. Although 27 is not strictly a divisor of 360, the reflection phase range of 360 degrees can be substantially covered by arranging 13 elements whose reflection phase differences change in increments of 27 degrees. It is assumed that the incident direction of the TE wave and the TM wave are ($\theta_i$, $\phi_i$)=(20 degrees, 270 degrees), and the desired direction of a reflection wave is ($\theta_r$, $\phi_r$)=(48 degrees, 27 degrees). If the reflection phase difference is 36 degrees, the number of elements required to cover the reflection phase range of 360 degrees is 10=360/36. If the reflection phase difference is 27.3 degrees, the number of element required to cover the reflection phase range of 360 degrees is about 13=360/27. In this case, one cycle of a reflectarray is formed of 40 elements aligned in line in the x-axis direction, and the cycle is formed to include 3 cycles of 13 elements for reflecting the TE wave and 4 cycles of 10 element for reflecting the TM wave.

Figure 22:
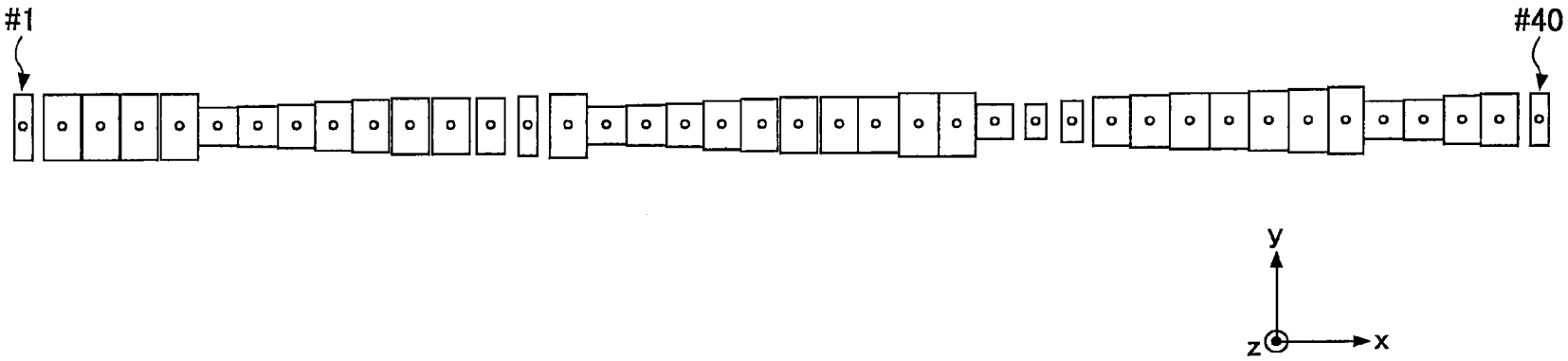
FIG. 22 is a plan view of an element sequence corresponding to one cycle formed of 40 elements.

FIG. 22 illustrates a plan view of an element sequence corresponding to one cycle of such 40 elements. By arranging the multiple element sequences in the x-axis and the y-axis directions, a reflectarray can be formed. FIG. 23 illustrates various parameter values for each of the 40 elements as illustrated in FIG. 22. Specifically, specific numerical values are illustrated for a phase to a TM wave, a size of y-axis directional gap gy, a phase of a TE wave, a size of x-axis directional gap gx, the y-axis directional patch size Wy and the x-axis directional patch size Wx. As illustrated, respective phase differences of reflection waves by adjacent elements is 36 degrees for the TM wave case and 27 degrees for the TE wave case.

Figure 24:
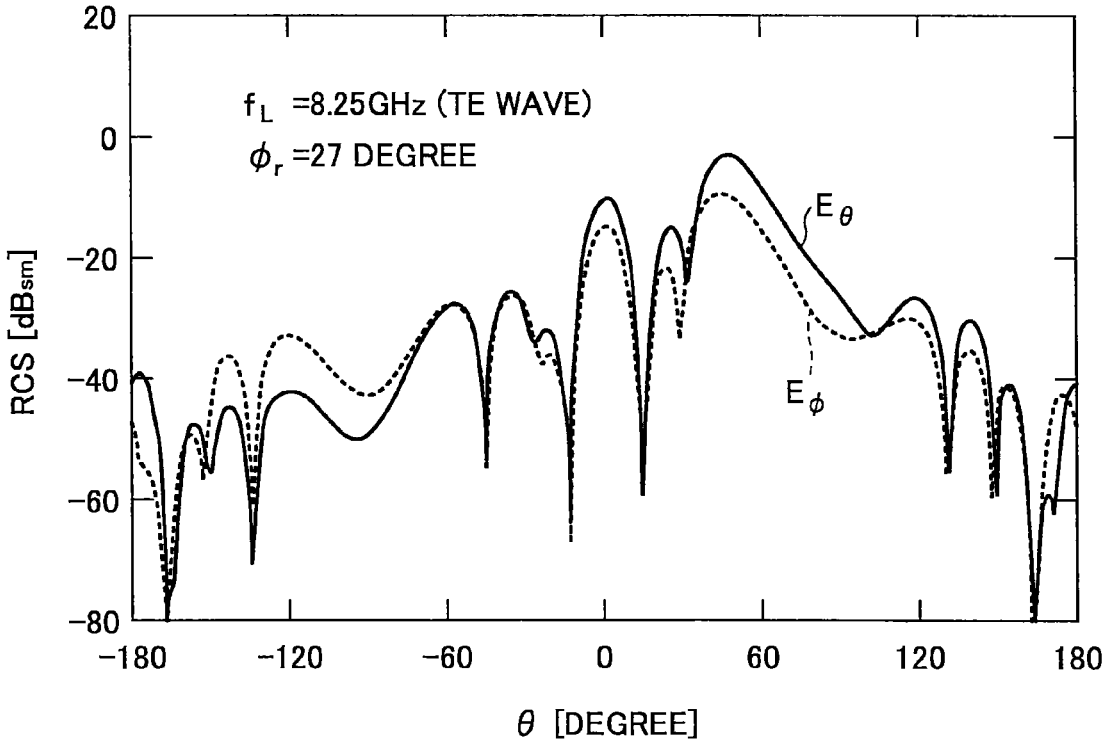
FIG. 24 is a view for illustrating simulation results of a radar reflection cross section of a TE wave reflected by a reflectarray.

FIG. 24 illustrates simulation results indicative of a radar cross section (RCS) ($dB_{sm}$) to a reflectarray including a large number of element sequences corresponding to one cycle as illustrated in FIGS. 22 and 23. Incident and reflection electric waves are TE waves of 8.25 GHz. The horizontal axis of the graph indicates deflection angle θ from the z-axis. The incident direction of the TE wave is ($\theta_i$, $\phi_i$)-(20 degrees, 270 degrees), and the desired direction of the reflection wave is ($\theta_r$, $\phi_r$)=(48 degrees, 27 degrees). $E_\theta$ indicates an electric field component of the reflection wave in the θ direction, and $E_\phi$ indicates an electric field component of the reflection wave in the ϕ direction. The illustrated RCS is the value in a surface of deflection angle from x-axis $\phi=\phi_r=27$ degrees (desired direction). Any electric field component indicates strong peaks at the desired direction $\theta=\theta_r=48$ degrees.

Figure 25:
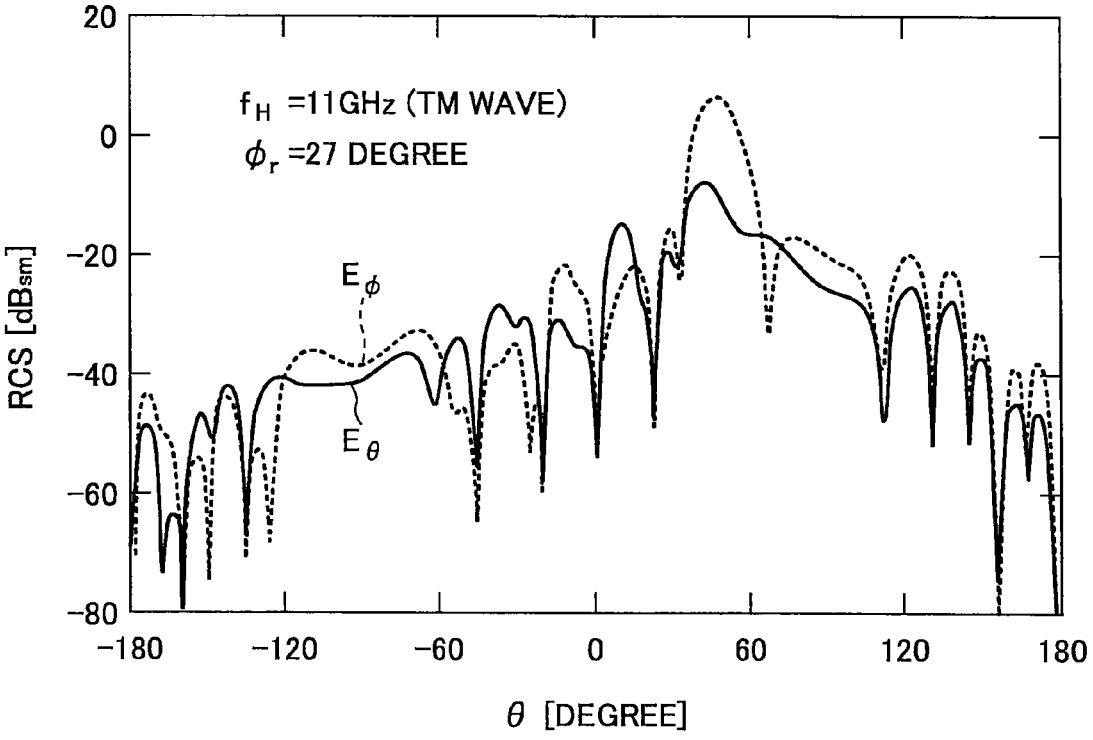
FIG. 25 is a view for illustrating simulation results of a radar reflection cross section of a TM wave reflected by a reflectarray.
Figure 26:
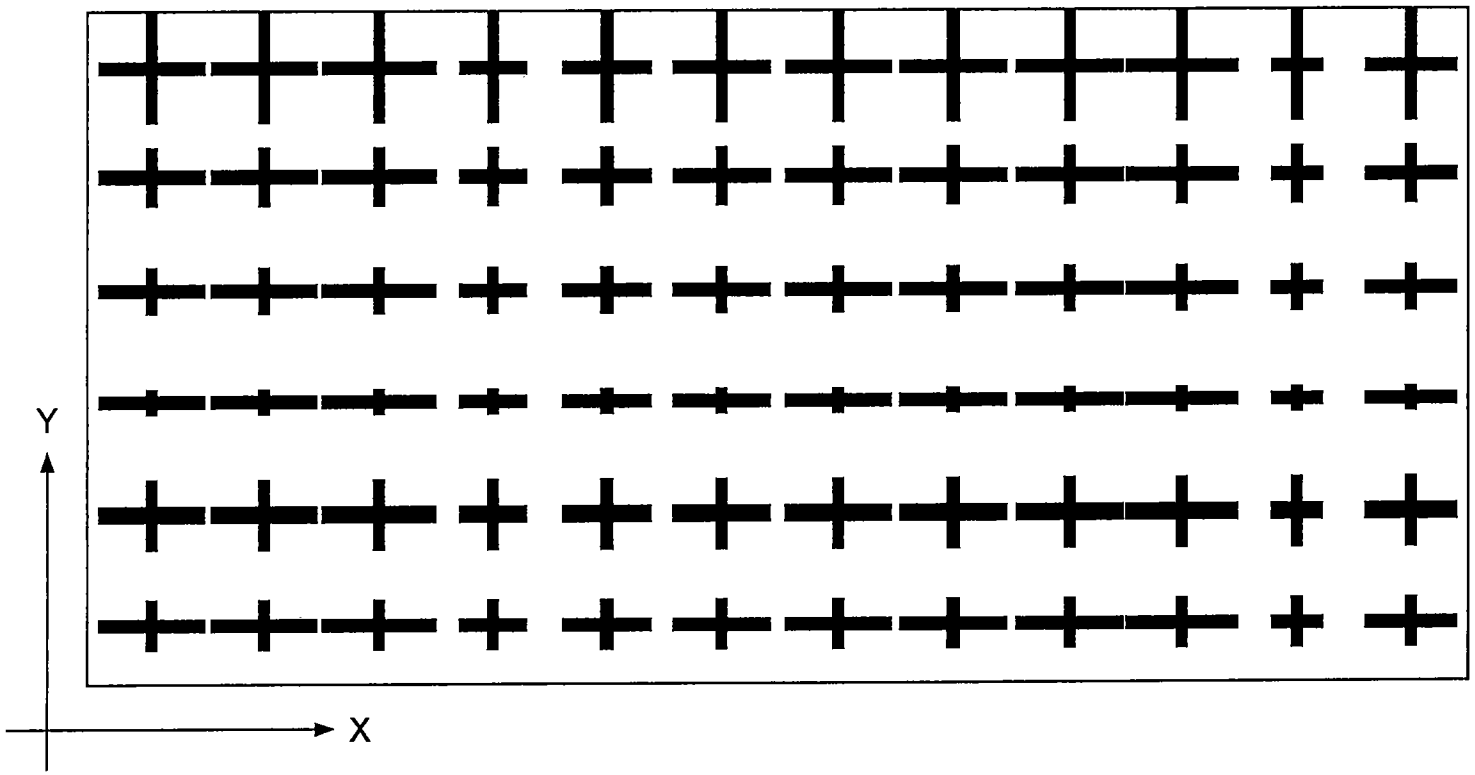
FIG. 26 is a schematic view of a reflectarray for a conventional cross dipole antenna.

FIG. 25 also illustrates simulation results indicative of a radar cross section RCS ($dB_{sm}$) to a reflectarray including a large number of element sequences corresponding to one cycle as illustrated in FIGS. 22 and 23, but FIGS. 24-25 are different in that the incident and reflection waves are TM waves of 11 GHz. Similar to FIG. 24, any electric field component indicates strong peaks at the desired direction $\theta=\theta_r=48$ degrees.

As illustrated in FIGS. 24 and 25, according to the reflectarray of the embodiments, if a TE wave of the first frequency $f_L$ and a TM wave of the second frequency $f_H$ arrive from the same incident direction, they can be reflected to an identical desired direction.

<4. Variations>

In the above description in <<3.2 Periodic boundary>>, by satisfying formula (22), the reflection phase $\alpha_{mn}(f)$ to be implemented at an element changes gradually in the x-axis direction and is made constant in the y-axis direction. However, the implementation is not limited to it. Conversely, the reflection phase $\alpha_{mn}(f)$ to be implemented at an element can change gradually in the y-axis direction and be made constant in the x-axis direction. In this case, a coefficient ($\sin\theta_i \cos\phi_i - \sin\theta_r \cos\phi_r$) of Δx must be identically 0 in formula (21). In this case, the following equation holds, $$\sin\theta_i \cos\phi_i = \sin\theta_r \cos\phi_r \quad (32).$$

This means that the x component of an incident unit vector $u_i$ of an incident wave and the x component of a reflection unit vector $u_r$ of a reflection wave are the same in FIG. 17A. In the case where the x components of the incident unit vector and the reflection unit vector are the same, the reflection phase to be implemented at individual elements can be caused to change in the y-axis direction and remain constant in the x-axis direction. Formula (32) can be also written as follows, $$\sin\theta_r = \sin\theta_i \cos\phi_i / \cos\phi_r \quad (33)$$

$$\theta_r = \arcsin(\sin\theta_i \cos\phi_i / \cos\phi_r) \quad (34).$$

Accordingly, the deflection angle $\theta_r$ of the reflection wave from the z-axis can be uniquely determined from the deflection angle $\phi_r$ of the reflection wave from the x-axis. In this case, the reflection phase $\alpha_{mn}(f)$ to be implemented at the mn-th element can be written as follows, $$\begin{aligned}\alpha_{mn}(f) &= (2\pi f/c)n\Delta y(\sin\theta_i\sin\phi_i - \sin\theta_r\sin\phi_r) \\ &= (2\pi f/c)n\Delta y[\sin\theta_i\sin\phi_i - (\sin\theta_i\cos\phi_i/\cos\phi_r)\sin\phi_r].\end{aligned} \quad (35)$$

Accordingly, the reflection phase $\alpha_{mn}(f)$ to be implemented at the mn-th element can be uniquely determined from the deflection angle $\phi_r$ of the reflection wave from the x-axis.

Furthermore, the difference $\Delta\alpha_y(f)$ between the reflection phase $\alpha_{mn}(f)$ by the mn-th element at the coordinates (mΔx, nΔy, 0) and the reflection phase $\alpha_{mn-1}(f)$ by the m(n−1)-th element at coordinates (mΔx, (n−1)Δy, 0) can be written from formula (21) as follows, $$\begin{aligned}\Delta\alpha_y(f) &= \alpha_{mn}(f) - \alpha_{mn-1}(f) \\ &= (2\pi f/c)m\Delta x(\sin\theta_i\cos\phi_i - \sin\theta_r\cos\phi_r) + \\ &\quad (2\pi f/c)n\Delta y(\sin\theta_i\sin\phi_i - \sin\theta_r\sin\phi_r) - \\ &\quad (2\pi f/c)m\Delta x(\sin\theta_i\cos\phi_i - \sin\theta_r\cos\phi_r) - \\ &\quad (2\pi f/c)(n-1)\Delta y(\sin\theta_i\sin\phi_i - \sin\theta_r\sin\phi_r) \\ &= (2\pi f/c)\Delta y(\sin\theta_i\sin\phi_i - \sin\theta_r\sin\phi_r).\end{aligned} \quad (36)$$

Accordingly, if the incident direction ($\theta_i$, $\phi_i$) and the desired direction ($\theta_r$, $\phi_r$) of a TE wave and a TM wave are the same, the reflection phase difference $\Delta\alpha_y(f_L)$ to the TE wave of a first frequency $f_L$ and the reflection phase difference $\Delta\alpha_y(f_H)$ to the TM wave of a second frequency $f_H$ can be written as follows, $$\Delta\alpha_y(f_L) = (2\pi f_L/c)\Delta y(\sin\theta_i \sin\phi_i - \sin\theta_r \sin\phi_r) \quad (37)$$

$$\Delta\alpha_y(f_H) = (2\pi f_H/c)\Delta y(\sin\theta_i \sin\phi_i - \sin\theta_r \sin\phi_r) \quad (38)$$

By calculating a ratio between formula (37) and formula (38), we can obtain $$\Delta\alpha_y(f_L):\Delta\alpha_y(f_H) = f_L:f_H \quad (39)$$

Accordingly, if the ratio between the reflection phase difference $\Delta\alpha_y(f_L)$ to the TE wave of the first frequency $f_L$ and the reflection phase difference $\Delta\alpha_y(f_H)$ to the TM wave of the second frequency $f_H$ is the same as a ratio between the first frequency $f_L$ and the second frequency $f_H$, the TE wave and the TM wave can be reflected to the same desired direction ($\theta_r$, $\phi_r$).

In combination of the above description and <<3.2 Periodic boundary>>, it can be said that the reflection phase by an arbitrary element (mn) in multiple elements composing a reflectarray differs from the reflection phase by an element adjacent to the mn-th element with respect to a first axis (x-axis or y-axis) direction by a predefined value but is equal to the reflection phase by an element adjacent to that element with respect to a second axis (y-axis or x-axis) direction. Furthermore, it can be also said that the magnitude of the second axis directional component of the incident unit vector $u_i$ is equal to the magnitude of the second axis directional component of the reflection unit vector $u_r$. Furthermore, if the ratio between the reflection phase difference $\Delta\alpha_{x\ or\ y}(f_L)$ to a TE wave of a first frequency $f_L$ and the reflection phase difference $\Delta\alpha_{x\ or\ y}(f_H)$ to a TM wave of a second frequency $f_H$ is equal to the ratio between the first frequency $f_L$ and the second frequency $f_H$, the TE wave and the TM wave can be reflected to the same desired direction $(\theta_r, \phi_r)$.

Next, a reflectarray according to the second embodiment of the present invention is described.

At the outset, a multiband reflectarray formed of reflection elements having mushroom structures is described.

Figure 28:
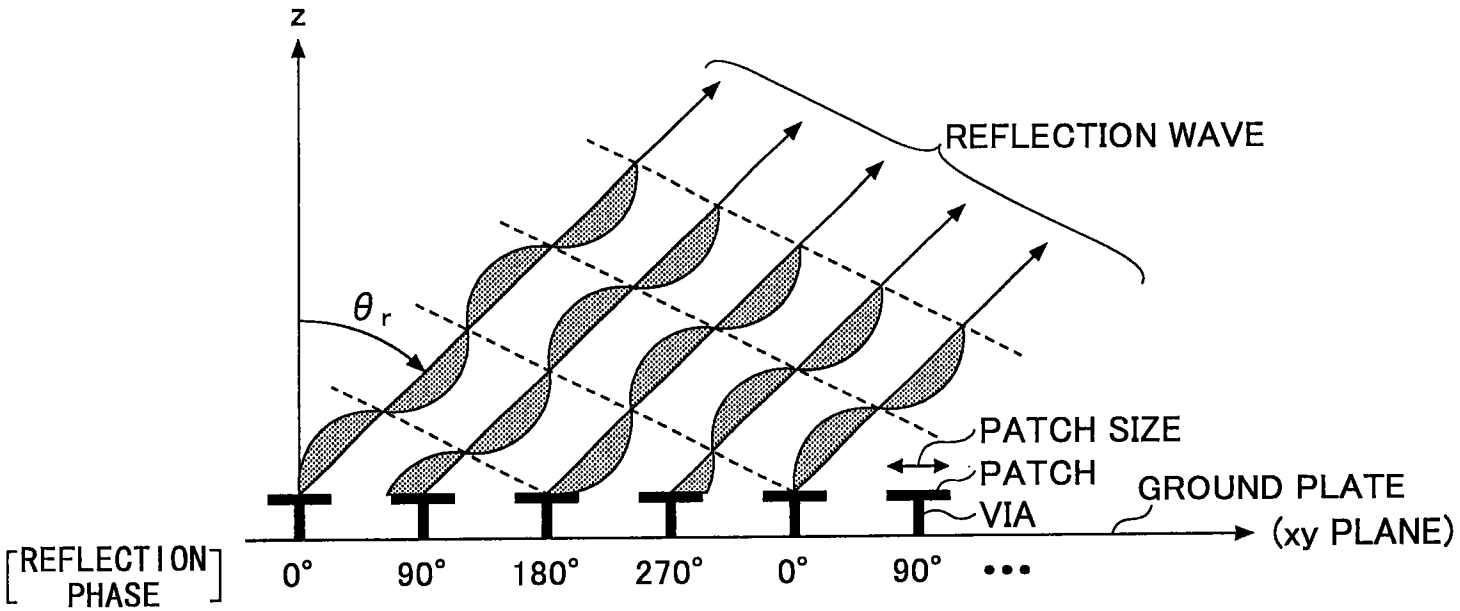
FIG. 28 is an illustrative view for illustrating a principle of a reflectarray us ing mushroom structures.

FIG. 28 illustrates an illustrative view for illustrating a fundamental principle of a reflectarray. As illustrated, it is assumed that the phase of a reflection wave by each of multiple elements aligned on a ground plate gradually changes between adjacent elements. In the illustrated example, the phase difference of reflection waves by adjacent elements is 90 degrees. Since electric waves travel toward a direction vertical to an equiphase surface (illustrated in dotted lines), it is possible to form a reflectarray by adjusting the reflection phase from individual elements appropriately and arranging the elements on a plane and to reflect an incident wave in a desired direction.

The phase $\alpha_{mn}$ provided to the mn-th element in designing a reflectarray formed by a M×N array is represented in formula (40) using a position vector $r_{mn}$, an incident directional unit vector $u_i$ and a reflection directional unit vector $u_r$ (Non-Patent Document 2). In other words, if reflection phase $\alpha_{mn}$ is given to the mn-th element as formulated in formula (40), a surface orthogonal to the reflection directional unit vector $u_r$ will be an equiphase surface, and the reflection wave travels toward the direction of $u_r$.

$$\alpha_{mn}=k_f(r_{mn}\cdot u_i-r_{mn}\cdot u_r)+2\pi N \tag{40}$$

In formula (40), $k_f$ is a wave number at an operating frequency f and is represented in formula (41)

$$k_f=\frac{2\pi}{\lambda}=\frac{2\pi}{\text{wavelength at frequency } f}. \tag{41}$$

From formula (40), the phase difference between the mn-th element and the adjacent (m−1)n-th element with respect to the x direction is provided in formula (42), and the phase difference between adjacent elements with respect to the y direction is provided in formula (43).

$$\Delta\alpha_{mx}=\alpha_{mn}-\alpha_{m-1n} \tag{42}$$

Also, the phase difference between the mn-th element and the adjacent m(n−1)-th element with respect to the y direction is provided in formula (42), and the phase difference between adjacent element with respect to the y direction is provided in formula (43).

$$\Delta\alpha_{ny}=\alpha_{mn}-\alpha_{mn-1} \tag{43}$$

A plane spanned by the incident direction determined by the unit vector $u_i$ and the reflection direction determined by the unit vector $u_r$ is derived as a plane defined by two straight lines. This is referred to as a reflection surface. If an electric field is orthogonal to the reflection surface, it is referred to as a TE wave, and if the electric field is parallel to the reflection surface, it is referred to as a TM wave.

At the outset, the principle of reflection of a TE incidence and a TM incidence to an identical direction is described. Letting the phase difference to the TE incidence $\Delta\alpha_{mxTE}$ and $\Delta\alpha_{nyTE}$ and the phase differences to the TM incidence $\Delta\alpha_{mxTM}$ and $\Delta\alpha_{nyTM}$, it can be understood that when formulae (44) and (45) hold, incident waves from the same direction can be reflected to the same direction for the TE wave and the TM wave.

$$\Delta\alpha_{mxTE}=\Delta\alpha_{mxTM} \tag{44}$$

$$\Delta\alpha_{nyTE}=\Delta\alpha_{nyTM} \tag{45}$$

Next, the principle of reflection of incident waves incoming from the same direction at a first frequency and a second frequency to an identical direction is described.

Letting the first frequency and the second frequency $f_1$ and $f_2$, respectively, if an incident directional vector $u_i$ and a position vector $r_{mn}$ of the two frequencies are the same each other, in order to reflect both the two frequencies to the direction of the same reflection direction vector $u_r$, $$\alpha_{mnf_1}=k_{f1}(r_{mn}\cdot u_1-r_{mn}\cdot u_r)+2\pi N \tag{46}$$

$$\alpha_{mnf_2}=k_{f2}(r_{mn}\cdot u_i-r_{mn}\cdot u_r)\pm 2\pi N \tag{47}$$

just have to hold.

By transforming formulae (46) and (47), it can be seen that the phase ratio just has to be equal to the wave number ratio. Then, according to formulae (42) and (43), if the phase ratio is the same, the ratio of phase differences will be also the same. In other words, the equation $$\begin{aligned}\frac{\alpha_{mnf_1}}{\alpha_{mnf_2}}&=\frac{k_{f_1}}{k_{f_2}}\\&=\frac{\alpha_{mnf_1}-\alpha_{m(n-1)f_1}}{\alpha_{mnf_2}-\alpha_{m(n-1)f_2}}\\&=\frac{\Delta\alpha_{mnf_1}}{\Delta\alpha_{mnf_2}}\\&=\frac{\alpha_{mnf_1}-\alpha_{(m-1)nf_1}}{\alpha_{mnf_2}-\alpha_{(m-1)nf_2}}\\&=\frac{\Delta\alpha_{nxf_1}}{\Delta\alpha_{nxf_2}}\\&=\frac{f_1}{f_2}.\end{aligned} \tag{48}$$

just has to hold. Formula (48) means that the y directional phase difference ratio together with the x directional phase difference ratio will be equal to the frequency ratio.

Next, a relationship between frequencies and TM and TE incidence is described. Here, if a first frequency is TM incidence and the second frequency is TM incidence, in order to reflect them to an identical direction, formula (49) just has to hold, $$\frac{\Delta\alpha_{mnf_1TM}}{\Delta\alpha_{mnf_2TM}}=\frac{\Delta\alpha_{nxf_1TM}}{\Delta\alpha_{nxf_2TM}}=\frac{f_1}{f_2}. \tag{49}$$

Also, if the first frequency is the TE incidence and the second frequency is the TE incidence, in order to reflect them to an identical direction, formula (50) just has to hold, $$\frac{\Delta\alpha_{mnf_1TE}}{\Delta\alpha_{mnf_2TE}}=\frac{\Delta\alpha_{nxf_1TE}}{\Delta\alpha_{nxf_2TE}}=\frac{f_1}{f_2}. \tag{50}$$

Also, if the first frequency is the TE incidence and the second frequency is the TM incidence, in order to reflect them in an identical direction, formula (51) just has to hold, $$\frac{\Delta\alpha_{myf_1TE}}{\Delta\alpha_{myf_2TM}} = \frac{\Delta\alpha_{nxf_1TE}}{\Delta\alpha_{nxf_2TM}} = \frac{f_1}{f_2}. \quad (51)$$

Also, if the first frequency is the TM incidence and the second frequency is the TE incidence, in order to reflect them in an identical direction, formula (52) just has to hold, $$\frac{\Delta\alpha_{myf_1TM}}{\Delta\alpha_{myf_2TE}} = \frac{\Delta\alpha_{nxf_1TM}}{\Delta\alpha_{nxf_2TE}} = \frac{f_1}{f_2}. \quad (52)$$

In other words, if a reflection direction in a reflectarray operating at a first frequency for TE incidence is caused to be the same as a reflection direction in the reflectarray operating at a second frequency for TM incidence, the ratio between a phase obtained at the first frequency for the TE incidence and a phase obtained at the second frequency for the TM incidence just has to be equal to the wave number ratio.

In order to describe an operating principle of a H-shaped mushroom of the present invention, an operating principle of a conventional mushroom structure is first described.

Figure 29:
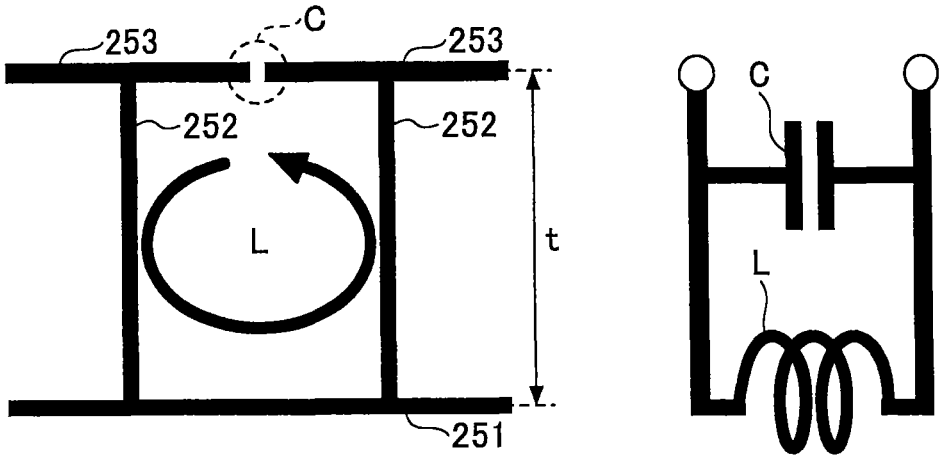
FIG. 29 is an equivalent circuit diagram of a mushroom structure element.
Figure 30:
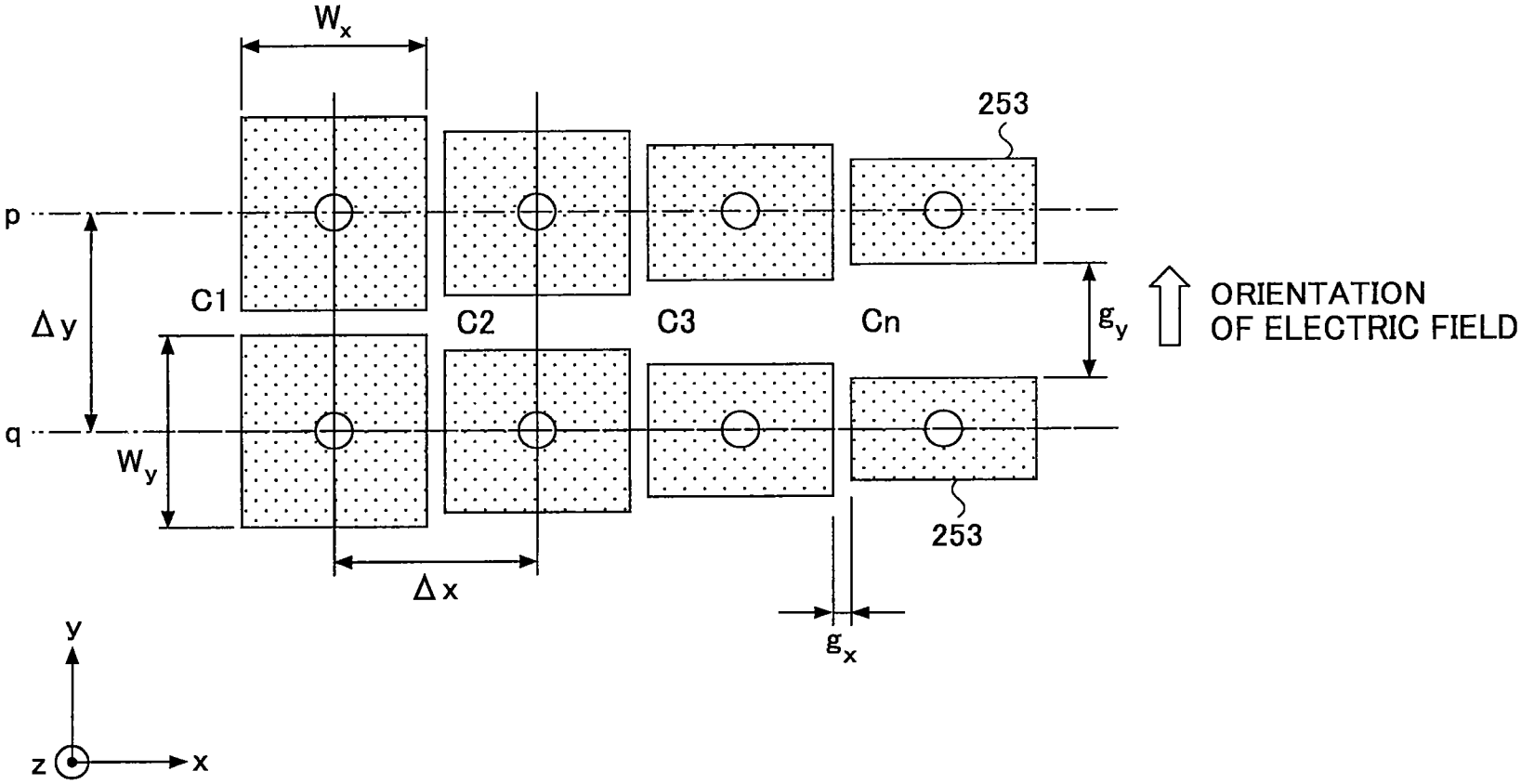
FIG. 30 is an enlarged plan view of a reflectarray with conventional mushroom structures.

FIG. 29 illustrates an equivalent circuit of a mushroom structure. Due to a gap between patches 253 of aligned mushroom structures in FIG. 29, capacitance C arises. Accordingly, if mushrooms are arranged to have different gap sizes by using patches 253 of mushroom structure aligned along line p and patches of mushroom structure aligned along line q in FIG. 29, different capacitances C1, . . . , Cn will be aligned along line q. Furthermore, due to vias 252 of mushroom structures aligned along line p and vias 252 of mushroom structures aligned along line q, inductance L arises. Accordingly, the equivalent circuit of adjacent mushroom structures will be a circuit as illustrated in the right side in FIG. 29. In other words, the inductance L and the capacitance C are connected in parallel in the equivalent circuit. The capacitance C is represented in formulae (53) and (54), $$C_x = \frac{\varepsilon_0(1+\varepsilon_r)w_y}{\pi}\operatorname{arccosh}\left(\frac{\Delta x}{gapx}\right) = \frac{\varepsilon_0(1+\varepsilon_r)w_y}{\pi}\operatorname{arccosh}\left(\frac{\Delta x}{\Delta x - w_x}\right) \quad (53)$$

$$C_y = \frac{\varepsilon_0(1+\varepsilon_r)w_x}{\pi}\operatorname{arccosh}\left(\frac{\Delta y}{gapy}\right) = \frac{\varepsilon_0(1+\varepsilon_r)w_x}{\pi}\operatorname{arccosh}\left(\frac{\Delta y}{\Delta y - w_y}\right). \quad (54)$$

Formula (53) represents capacitance arising when an electric field is parallel to the x direction, and formula (54) represents capacitance arising when an electric field is parallel to the y direction. As illustrated in Non-Patent Document 5, capacitance of a mushroom structure can be changed by changing the gap value. As can be seen in formulae (53) and (54), however, when the x directional gap changes, the x directional patch size will change, which may affect the y directional capacitance. In other words, some problem may arise in that the capacitance values cannot be determined for the x direction and the y direction independently.

In formulae (53) and (54), $\in_0$ represents a permittivity of a vacuum, and $\in_r$ represents a relative permittivity of a material lying between patches. In the above example, the element interval is the via interval Δy in the y-axis direction. The gap gy is a space between adjacent patches, and gy=Δy−Wy holds in the above example. Wy represents the length of a patch with respect to the y-axis direction. In other words, the argument of arccos h function represents the ratio between an element interval and a gap. Also, the inductance L, the surface impedance Zs and the reflection coefficient Γ are represented in formulae (55), (56) and (57), respectively, $$L=\mu t \quad (55)$$

$$Z_s=j\omega L/(1-\omega^2 LC). \quad (56)$$

$$\Gamma=(Z_s-\eta)/(Z_s+\eta)=|\Gamma|\exp(j\phi). \quad (57)$$

In formulae (53) and (54), $\in_0$ represents a permittivity of a vacuum, and $\in_r$ represents a relative permittivity of a material lying between patches. Wy represents the length of a patch with respect to the y-axis direction, and Wx represents the length of a patch with respect to the x-axis direction. In other words, the argument of arccos h function represents the ratio between an element interval and a gap. In formula (55), μ represents a permeability of a material lying between vias, and t represents the height of patch 253 (distance from the ground plate 251 to the patch 253). In formula (56), ω represents an angular frequency, and j represents an imaginary unit. In formula (57), η represents a free space impedance, and ϕ represents a phase difference.

In general, the reflection phase of a mushroom structure (element) becomes 0 at a certain resonant frequency. Adjustment of capacitance C and/or inductance L of an element may displace the resonant frequency, which can adjust the reflection phase value. In designing a reflectarray having mushroom structures as elements, the reflection phase of individual elements must be appropriately set by the capacitance C and/or the inductance L such that an electric wave of the resonant frequency can be reflected to a desired direction.

Figure 27:
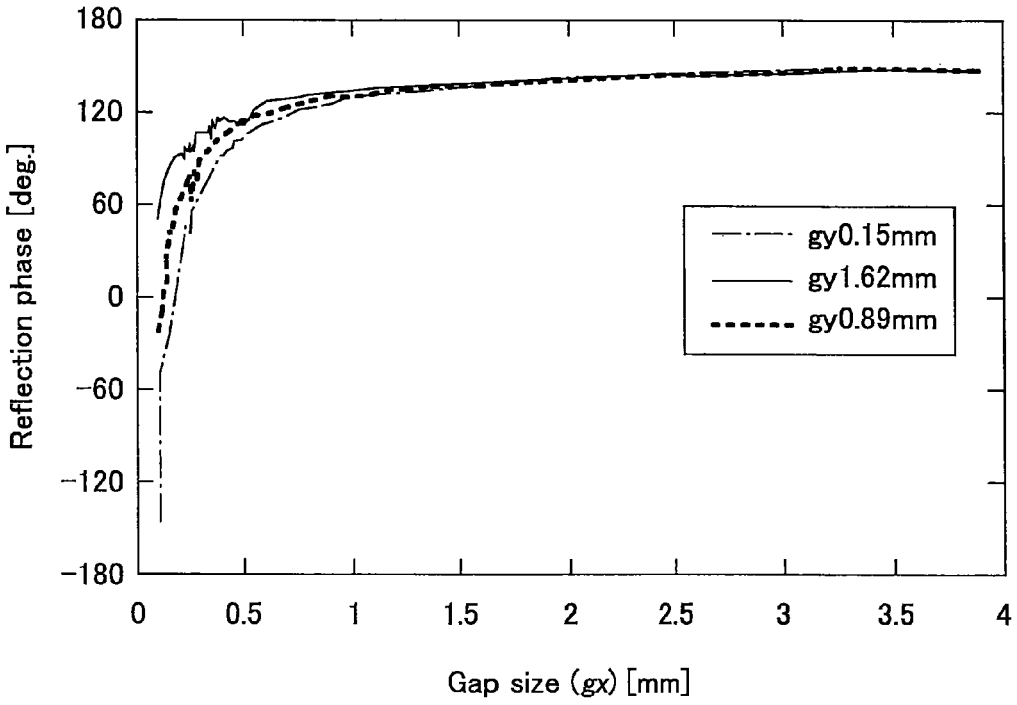
FIG. 27 is a view for illustrating a reflection phase for a gap $g_x$ between mushrooms in the X direction when a gap $g_y$ between mushrooms in the Y direction changes.

In a dual polarized multiband reflectarray using a reflection element having a mushroom structure, when the x directional gap changes, not only reflection phase of an electric wave having an electric field in parallel to the x direction but also the reflection phase of an electric wave having an electric field in parallel to the y direction will change (Non-Patent Document 7). Also, when the y directional gap changes, not only the reflection phase of an electric wave having an electric field in parallel to the y direction but also the reflection phase of an electric wave having an electric field in parallel to the x direction will change (FIG. 27). In other words, in a dual polarized multiband reflectarray using a reflection element having a conventional mushroom structure, it is difficult to change the reflection phase of TE incidence and the reflection phase of TM incidence independently. This may be because the change of the x directional gap will change the length of a patch with respect to the y directional gap and accordingly change the capacitance value as shown in the above-stated formulae (53) and (54).

In a reflection element having a H-shaped mushroom structure as stated below, it is possible to eliminate the problem of a dual polarized multiband reflectarray using a reflection element having such a mushroom structure.

Figure 31A:
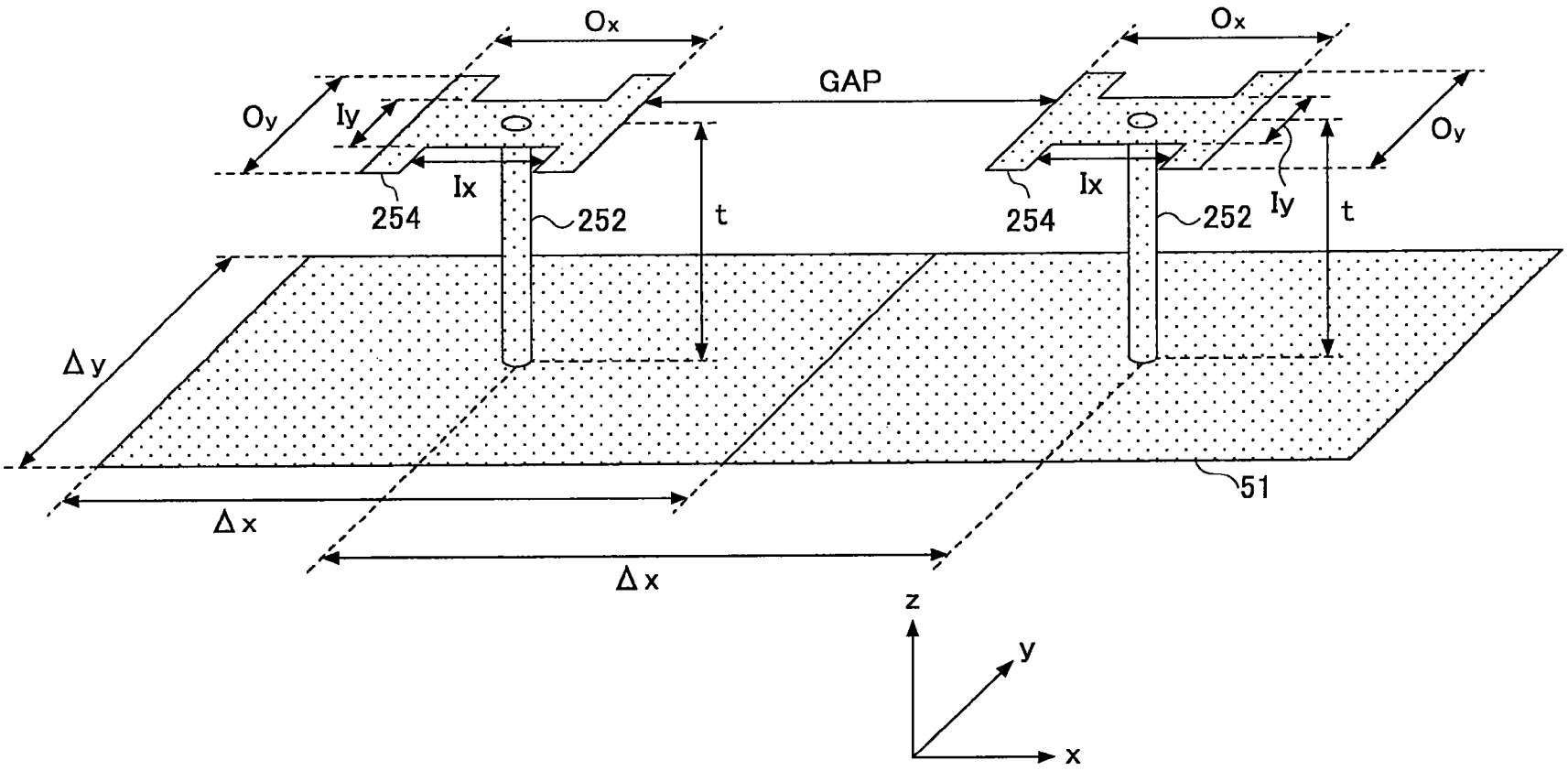
FIG. 31A is a view for illustrating a H-shaped mushroom element according to one embodiment of the present invention.
Figure 31B:
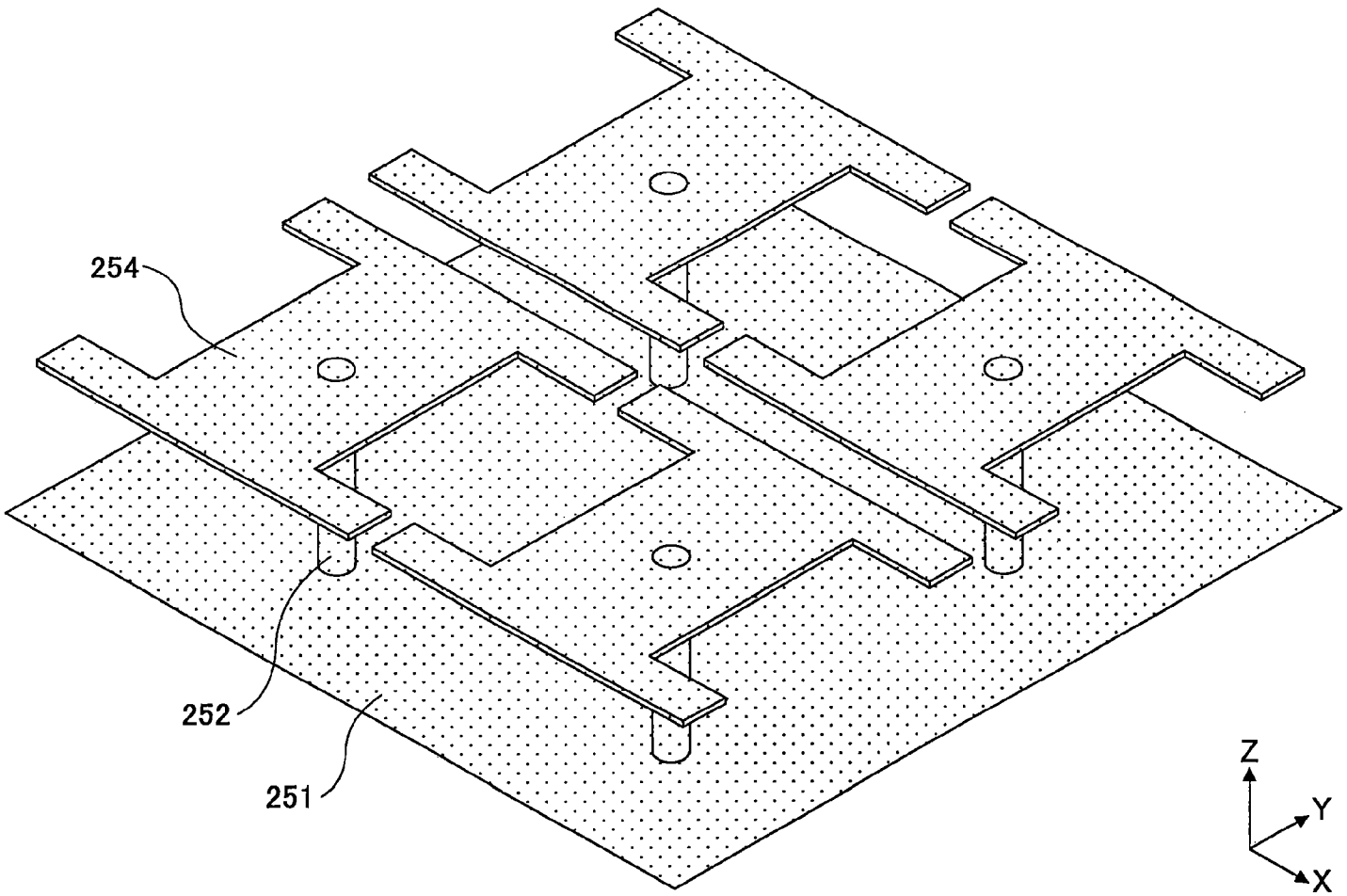
FIG. 31B is a view for illustrating a H-shaped mushroom element according to one embodiment of the present invention.
Figure 32:
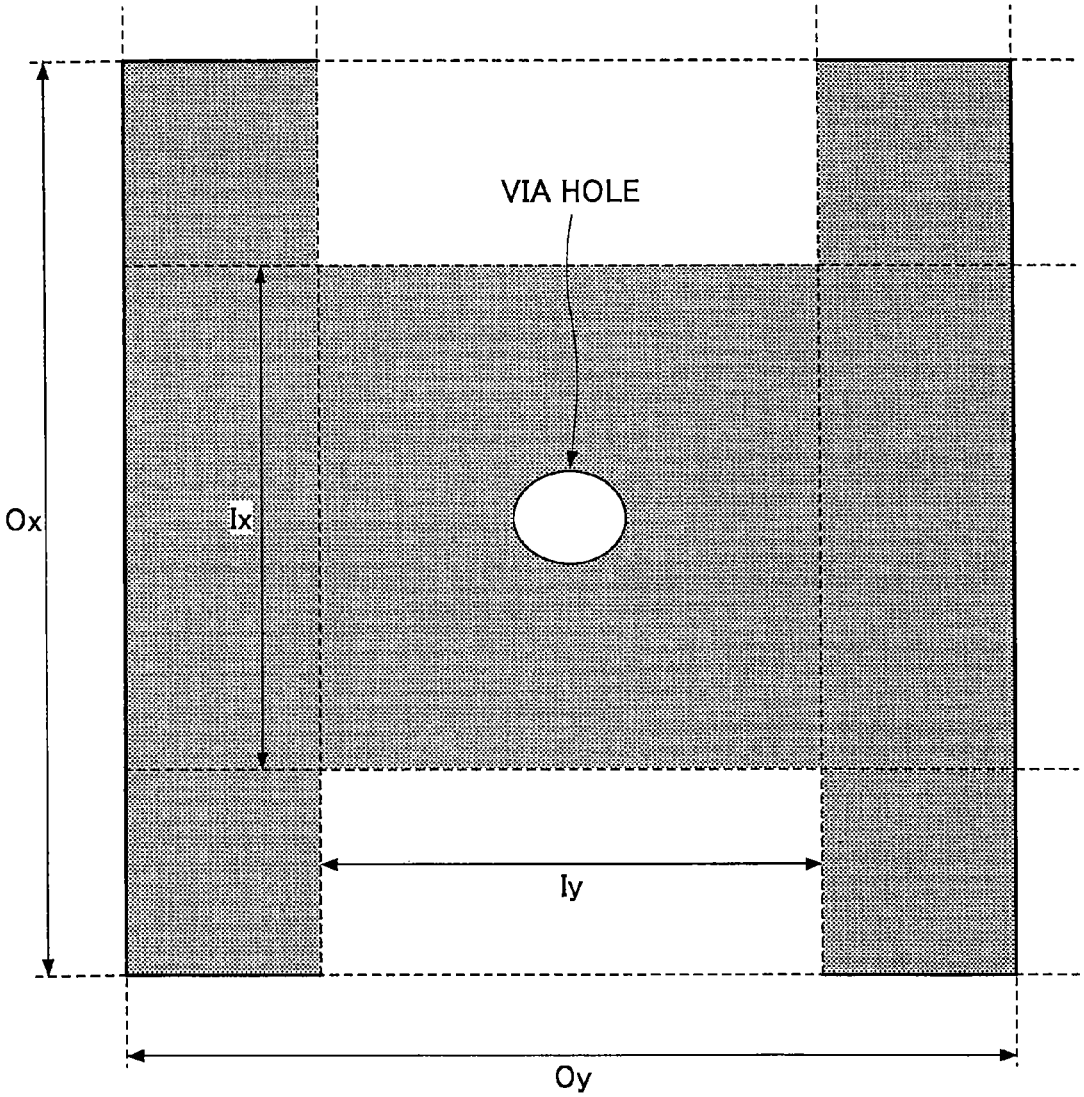
FIG. 32 is a plan view of a H-shaped mushroom structure according to one embodiment of the present invention.

Next, a reflection element having a H-shaped mushroom structure according to one embodiment of the present invention is described. FIGS. 31A and 31B are views of illustrating a structure of the H-shaped mushroom element according to one embodiment of the present invention. As illustrated in FIG. 31A, a H-shaped mushroom element according to one embodiment of the present invention has a ground plate 251, a via 252 and a H-shaped patch 254. Typically, as illustrated in FIG. 31B, each H-shaped mushroom element has a via 252 and a H-shaped patch 254, and the multiple H-shaped mushroom elements are arranged in an array on the ground plate 251. In an embodiment as illustrated in FIG. 32, the H-shaped patch 254 is formed of three rectangular parts including two rectangular outer patches in an identical size and one rectangular inner patch, and the two outer patches are coupled to the inner patch to sandwich the inner patch such that the H-shaped patch 254 are symmetric with respect to a first direction (x direction) defined by one side of the rectangle and a second direction (y direction) orthogonal to the first direction.

In the illustrated H-shaped patch 254, the length of the outer patch with respect to the x direction is Ox, and the length of the H-shaped patch with respect to the y direction is Oy. Also, the length of the inner patch with respect to the x direction is Ix, and the length of the inner patch with respect to the y direction is Iy. Typically, the H-shaped patch has a H shape as illustrated in FIGS. 31 and 32, but the H-shaped patch of the present invention is not limited to it. For example, the two outer patches may have different sizes. In this case, the H-shaped patch may be asymmetric with respect to the first direction and the second direction. Also, the above-stated first and second directions may not be necessarily orthogonal.

The H-shaped patch 254 according to the above-stated embodiment is formed of three rectangular parts including two rectangular outer patches in the same size and one rectangular inner patch, and is an arbitrarily shaped patch where the two outer patches are coupled to the inner patch to sandwich the inner patch such that the H-shaped patch is symmetric with respect to a first direction defined by one side of the rectangle and a second direction orthogonal to the first direction. For example, respective patches of reflection elements as illustrated in FIGS. 33-37 have shapes as defined in this manner, and any of the patches is a H-shaped patch. Also, Ox>Ix holds in a typical H-shaped patch, but not limited to it, Ox≤Ix may hold. A reflectarray according to embodiments of the present invention is formed by arranging multiple H-shaped mushroom elements having the above-stated H-shaped patches in an array.

Next, a multiband reflectarray formed of H-shaped mushroom elements according to a first embodiment of the present invention is described. In the multiband reflectarray according to the first embodiment, H-shaped mushroom elements are arranged by changing the length of Oy for incidence of an electric field in parallel to the y direction and changing only the Ix value while keeping the length of Ox to be constant for incidence of an electric field in parallel to the x direction. Here, upon considering that Ox corresponds to an area of a condenser forming x directional capacitance, that is, Wx in formula (53), variation of Ix does not change the Ox value. Accordingly, capacitance arising between adjacent gaps in the y direction can be caused to be constant, and even if the x directional gap changes, the capacitance value can be kept constant. In other words, it is possible to change the reflection phase value with respect to the x-direction without affecting capacitance with respect to the y-direction by changing the Ix value if the electric field is oriented to the x-direction and the Oy value if the electric field is oriented to the y-direction.

In other words, the reflection phase to a second directional deflection wave can change by changing the gap value between inner patches arising between inner patches in the second direction while keeping the gap value between first outer patches and the gap value between second outer patches to be constant, which arise between the first directional outer patches and between the second directional outer patches in adjacent H-shaped elements. In this case, capacitance arising between adjacent H-shaped elements with respect to the first direction will be determined based on the magnitude of the gap between first outer patches, and capacitance arising between adjacent H-shaped element with respect to the second direction will be determined based on the magnitude of the gap between second outer patches.

The H-shaped patch can be rephrased below. Namely, the H-shaped patch is formed of four outer vertices of the H-shaped patch formed of two rectangular outer patches and four inner vertices of the inner patch, and in order to change the reflection phase of an incident electric field in parallel to the first direction, the length of the inner patch with respect to the first direction as determined by positions of the four vertices of the inner patch is determined while keeping positions of the four vertices of the outer patch and the size of the outer patch to be constant. Also, in order to change the reflection phase of an incident electric field in parallel to the second direction, the length of the inner patch with respect to the second direction as determined by the four vertices of the outer patch in the H-shaped patch with respect to the second direction is determined.

Figure 38:
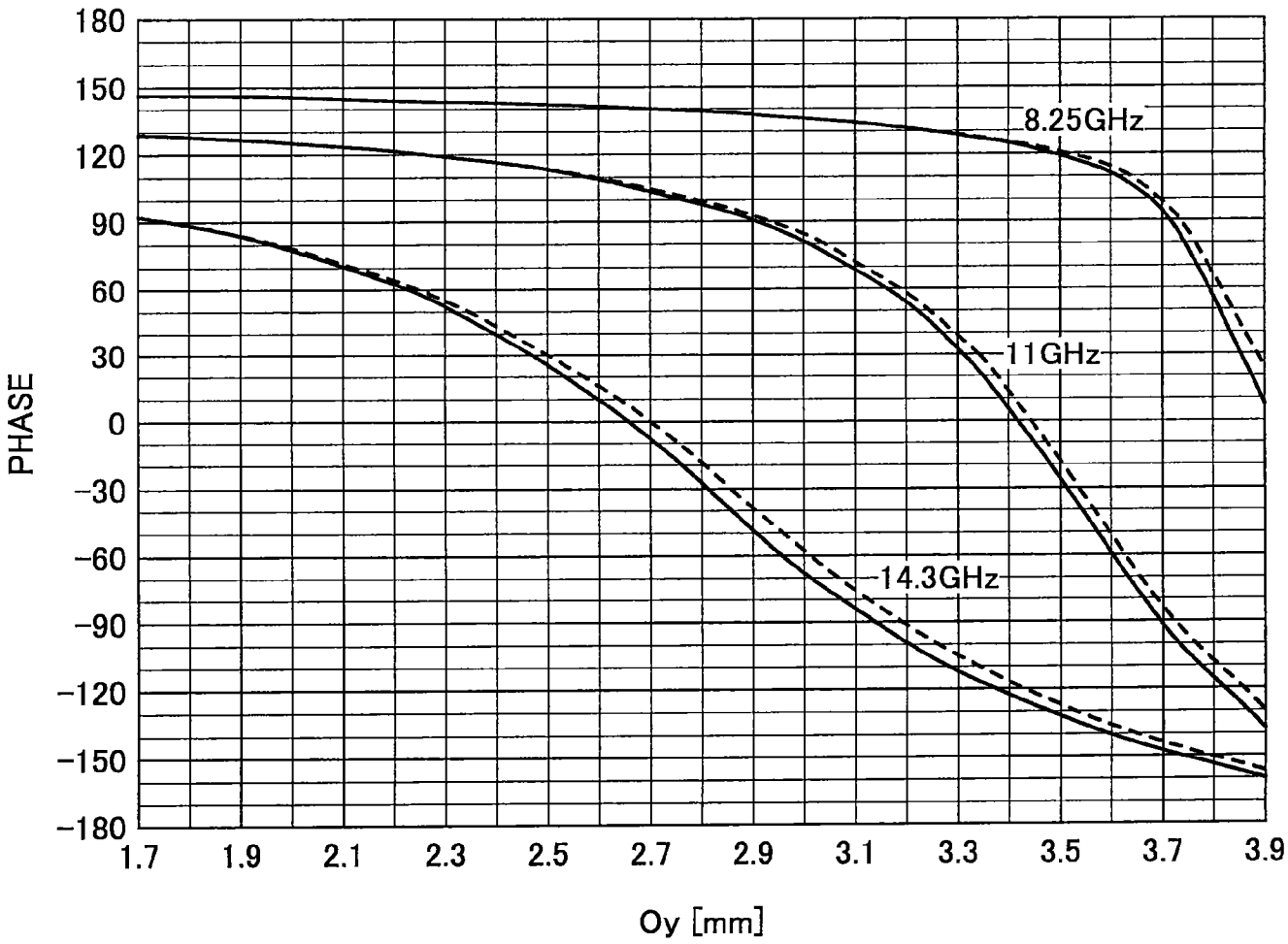
FIG. 38 is a view for illustrating a relationship between the reflection phase and the length of an outer patch by changing the length of an inner patch for cases of three frequencies according to the first embodiment of the present invention.

FIG. 38 is a view for illustrating the relationship between the reflection phase and the length of the outer patch according to the first embodiment of the present invention. In the illustrated graph, simulation results regarding the relationship between Oy and the reflection phase of an incident electric field in parallel to the y direction are illustrated for three bands 8.25 GHz, 11 GHz and 14.3 GHz. For example, for 8.25 GHz, a simulation result on Ix=2.8 mm as illustrated in a solid line and a simulation result on Ix=2.8 mm as illustrated in a dotted line are almost overlapping curves, and it can be understood that the relationship between the reflection phase and Oy does not depend on the length Ix of an inner patch with respect to the x direction. In other words, a desired reflection phase can be obtained for an electric field incoming in parallel to the y direction (TM incidence) by changing only the length Oy of the outer patch with respect to the y direction. Similarly, for the simulation results on 11 GHz and 14.3 GHz, a simulation result on Ix=2.8 mm as illustrated in a solid line and a simulation result on Ix=2.8 mm as illustrated in a dotted line are almost overlapping curves, which means that the relationship between the reflection phase and Oy does not depend on the length Ix of an inner patch with respect to the x direction.

Figure 39:
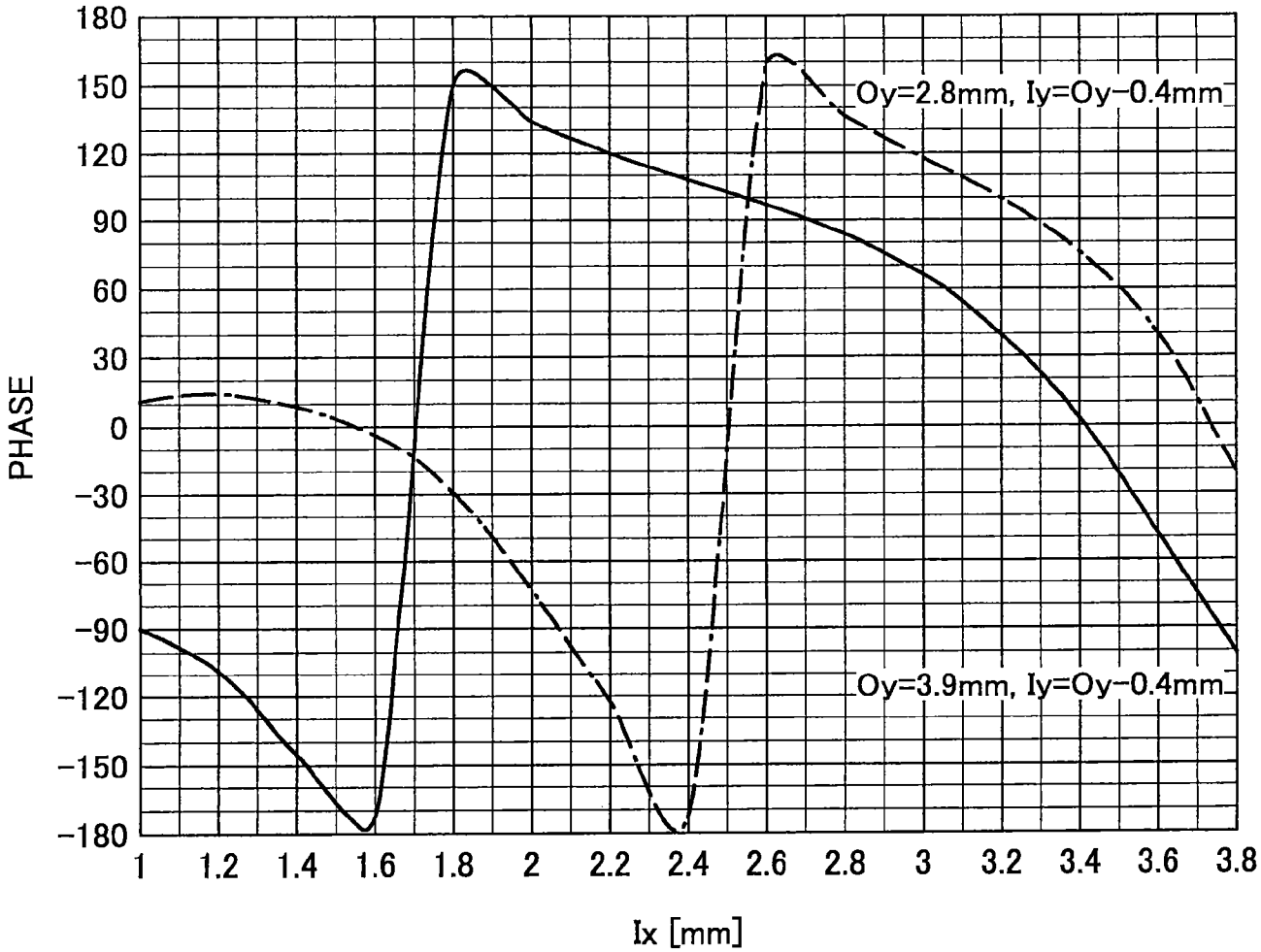
FIG. 39 is a view for illustrating a relationship between the reflection phase and the length of an inner patch by changing the length of an outer patch for a case of a first frequency according to the first embodiment of the present invention.

FIG. 39 is a view for illustrating the relationship between the reflection phase and the inner patch according to the first embodiment of the present invention. In the illustrated graph, simulation results on the relationship between Iy and the reflection phase of an electric field incoming in parallel to the x direction are illustrated for respective cases where the length Oy of the outer patch with respect to the y direction is 2.8 mm and 3.9 mm and the length Iy of the inner patch is 2.4 mm and 3.5 mm (Iy=Oy−0.4 mm). Upon the length Oy of the outer patch with respect to the y direction is determined, the Iy value is also determined. At this time, it can be seen that the reflection phase value can change by nearly 360 degrees by changing Ix. Here, it is assumed that the incident direction is (θ=20 degrees, ϕ=0 degree). As a result, it is possible to change the reflection phase of TE (Transverse Electric wave) incidence separately from the reflection phase of TM (Transverse Magnetic wave) incidence.

In Table 1 in FIG. 40, some design values for a reflectarray formed of H-shaped mushroom elements according to the first embodiment of the present invention is illustrated.

Figure 41:
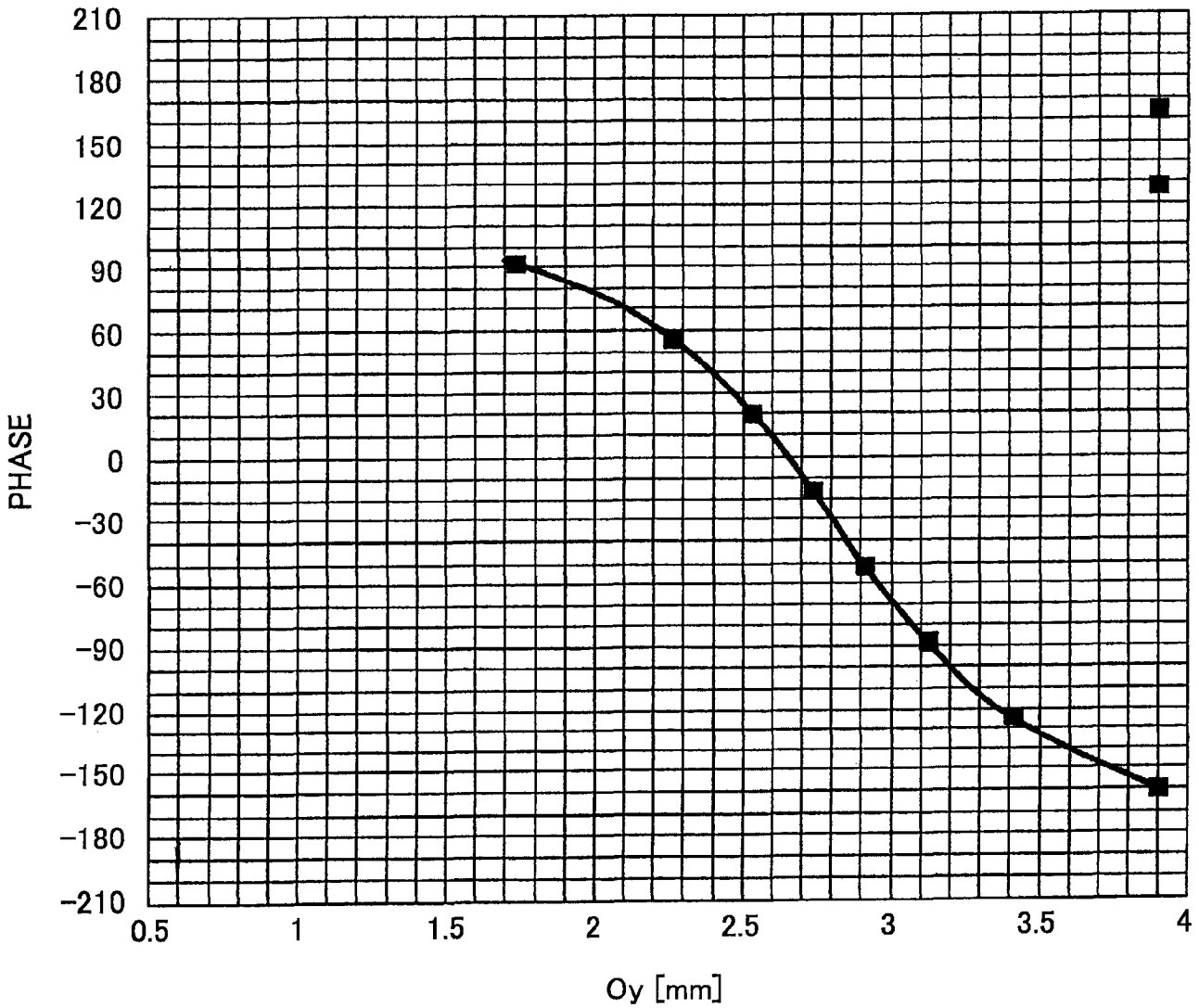
FIG. 41 is a view for illustrating selected Oy values.
Figure 42:
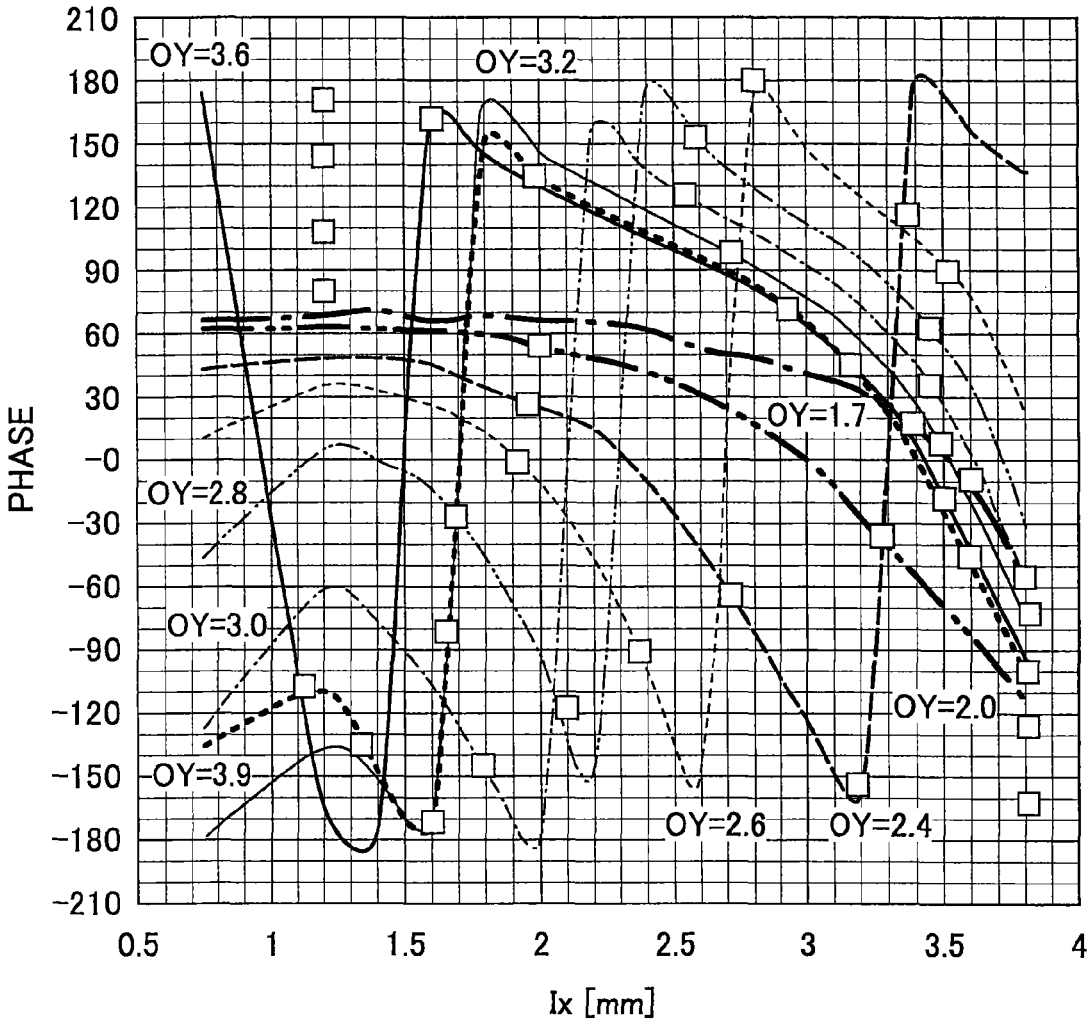
FIG. 42 is a view for illustrating selected Ix values.

From FIGS. 38 and 39, Oy and Ix values are determined to satisfy Table 1. FIG. 41 illustrates selected Oy values, and FIG. 42 illustrates selected Ix values.

Figure 33:
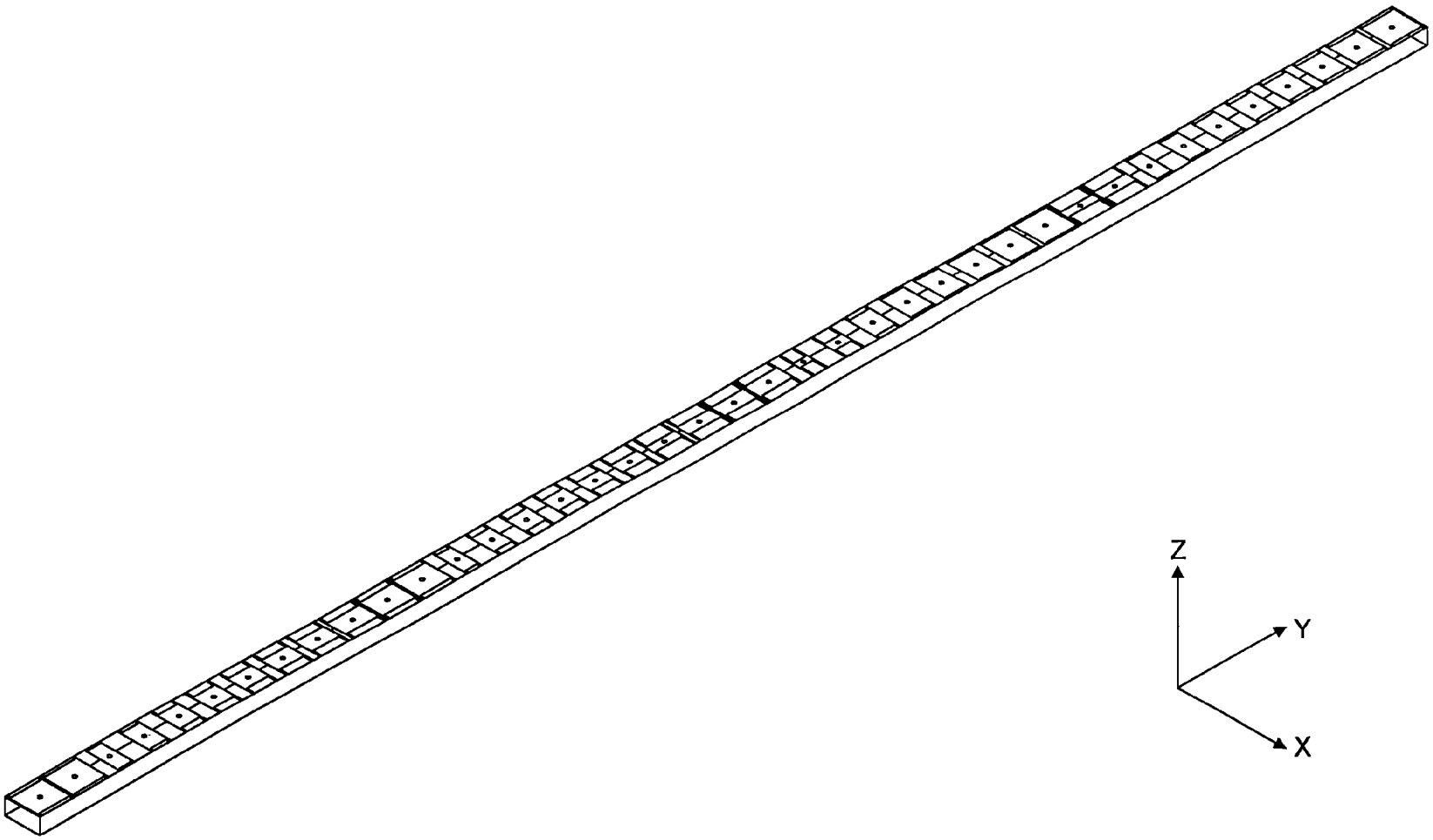
FIG. 33 is a structural view of a reflectarray corresponding to one cycle formed of H-shaped mushroom elements according to a first embodiment of the present invention.

FIG. 33 is an overall view of a reflectarray formed of H-shaped mushroom elements as determined to have an arrangement from FIGS. 38 and 39 to obtain the reflection phase based on the design values in Table 1 according to the first embodiment of the present invention. Also, FIGS. 34-37 are enlarged views of reflectarrays formed of the H-shaped mushroom structures. As illustrated in FIG. 33 and lower portions in FIGS. 34-37, a multiband reflectarray according to the first embodiment is formed by arranging various H-shaped mushroom elements in size in an array. In upper portions in FIGS. 34-37, enlarged views of different portions of the multiband reflectarray in FIG. 33 are illustrated.

Figure 34:
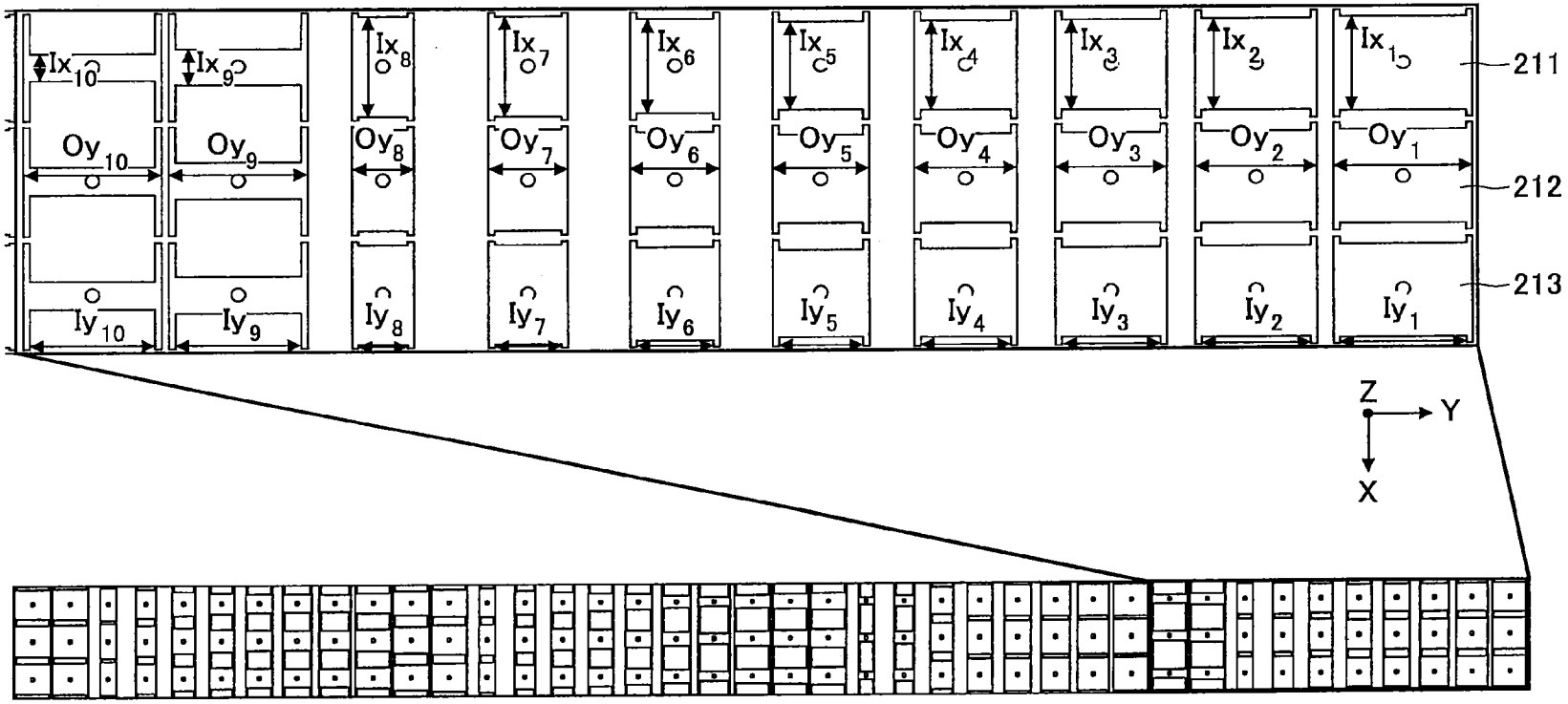
FIG. 34 is an enlarged view of a portion of an arrangement where three reflectarrays having H-shaped mushroom elements in FIG. 33 are aligned according to the first embodiment of the present invention.

In the first portion as illustrated in FIG. 34, a total of 30 H-shaped mushroom elements, consisting of 3 elements in the x direction and 10 elements in the y direction, are arranged in an array, and a set of 10 H-shaped mushroom elements 211 having different sizes $Oy_1$-$Oy_{10}$ and $Ix_1$-$Ix_{10}$ and a uniform size Ox are arranged in the y direction. Also, the same sets of H-shaped mushroom elements 212 and 213 are arranged in the array in the x direction.

Since the mushroom elements having the uniform Ox are used in the formed reflectarray, capacitance arising between adjacent gaps with respect to the y direction can be made constant, and by using the above-stated formulae (43) and (44) or others to derive respective sizes of $Oy_1$-$Oy_{10}$ and respective sizes of $Ix_1$-$Ix_{10}$ independently, it is possible to launch an electric field incoming in parallel to the y direction at a desired reflection phase and an electric field incoming in parallel to the x direction at a desired reflection phase.

Figure 35:
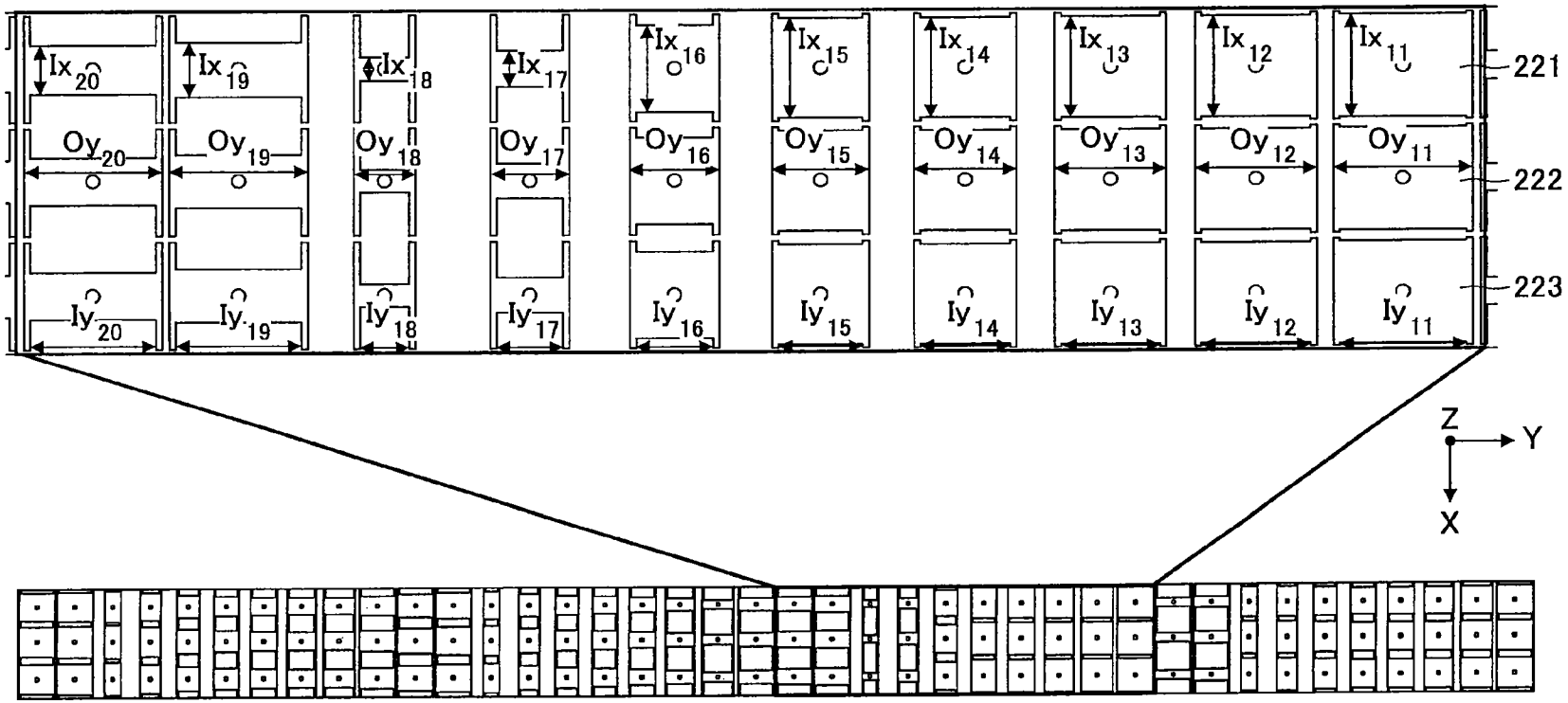
FIG. 35 is an enlarged view of a portion of an arrangement where three reflectarrays having H-shaped mushroom elements in FIG. 33 are aligned according to the first embodiment of the present invention.

In the second portion as illustrated in FIG. 35, similar to the first portion, a total of 30 H-shaped mushroom elements, consisting of 3 elements in the x direction and 10 elements in the y direction, are arranged in an array, and a set of 10 H-shaped mushroom elements 221 having different sizes $Oy_{11}$-$Oy_{20}$ and $Ix_{11}$-$Ix_{20}$ and the uniform size Ox are arranged in the y direction. Also, the same sets of H-shaped mushroom elements 222 and 223 are arranged in the array in the x direction.

Since the mushroom elements having the uniform Ox are used in the formed reflectarray, capacitance arising between adjacent gaps with respect to the y direction can be made constant, and by using the above-stated formulae (43) and (44) or others to derive respective sizes of $Oy_{11}$-$Oy_{20}$ and respective sizes of $Ix_{11}$-$Ix_{20}$ independently, it is possible to launch an electric field incoming in parallel to the y direction at a desired reflection phase and an electric field incoming in parallel to the x direction at a desired reflection phase.

Figure 36:
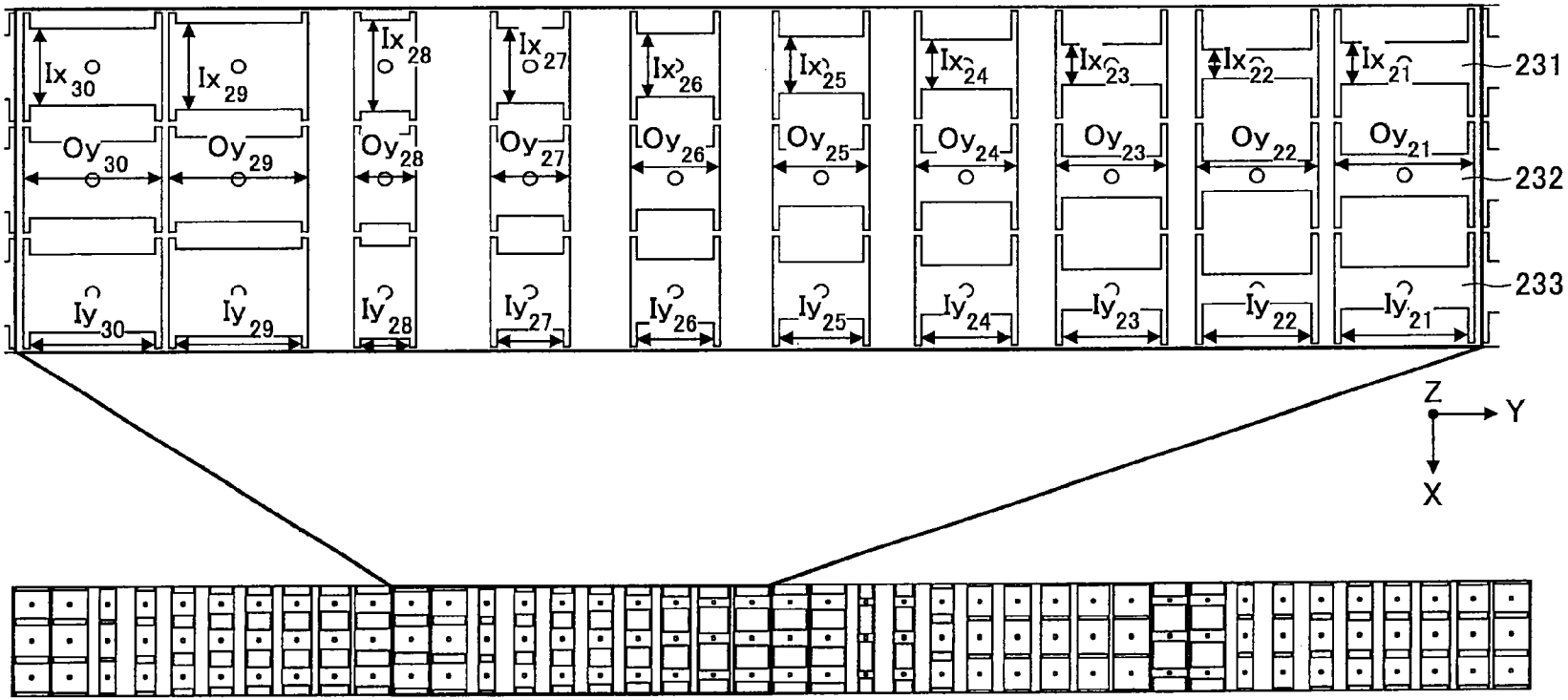
FIG. 36 is an enlarged view of a portion of an arrangement where three reflectarrays having H-shaped mushroom elements in FIG. 33 are aligned according to the first embodiment of the present invention.

In the third portion as illustrated in FIG. 36, similar to the first portion, a total of 30 H-shaped mushroom elements, consisting of 3 elements in the x direction and 10 elements in the y direction, are arranged in an array, and a set of 10 H-shaped mushroom elements 231 having different sizes $Oy_{21}$-$Oy_{30}$ and $Ix_{21}$-$Ix_{30}$ and the uniform size Ox are arranged in the y direction. Also, the same sets of H-shaped mushroom elements 232 and 233 are arranged in the array in the x direction.

Since the mushroom elements having the uniform Ox are used in the formed reflectarray, capacitance arising between adjacent gaps with respect to the y direction can be made constant, and by using the above-stated formulae (43) and (44) or others to derive respective sizes of $Oy_{21}$-$Oy_{30}$ and respective sizes of $Ix_{21}$-$Ix_{30}$ independently, it is possible to launch an electric field incoming in parallel to the y direction at a desired reflection phase and an electric field incoming in parallel to the x direction at a desired reflection phase.

Figure 37:
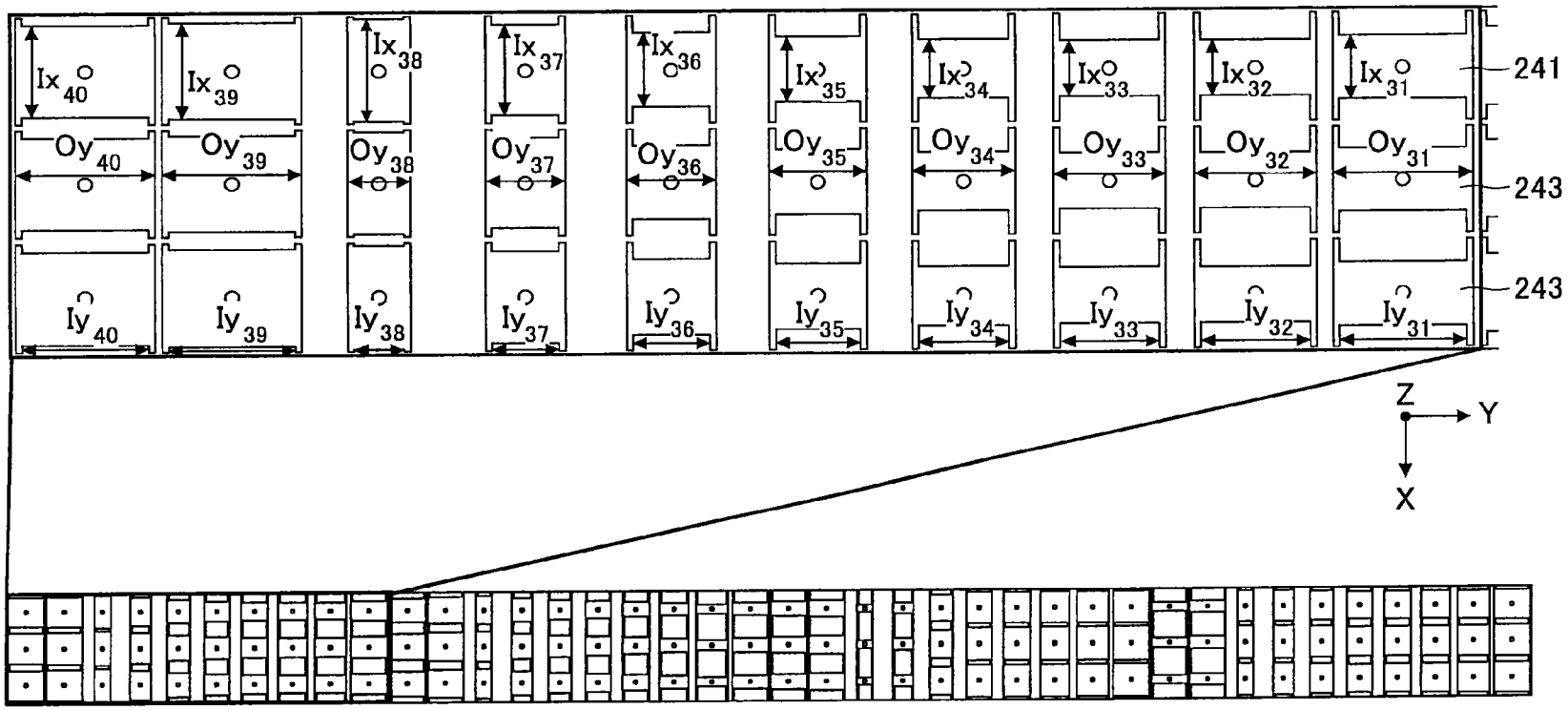
FIG. 37 is an enlarged view of a portion of an arrangement where three reflectarrays having H-shaped mushroom elements in FIG. 33 are aligned according to the first embodiment of the present invention.

In the fourth portion as illustrated in FIG. 37, similar to the first portion, a total of 30 H-shaped mushroom elements, consisting of 3 elements in the x direction and 10 elements in the y direction, are arranged in an array, and a set of 10 H-shaped mushroom elements 241 having different sizes $Oy_{31}$-$Oy_{90}$ and $Ix_{31}$-$Ix_{40}$ and the uniform size Ox are arranged in the y direction. Also, the same sets of H-shaped mushroom elements 242 and 243 are arranged in the array in the x direction.

Since the mushroom elements having the uniform Ox are used in the formed reflectarray, capacitance arising between adjacent gaps with respect to the y direction can be made constant, and by using the above-stated formulae (43) and (44) or others to derive respective sizes of $Oy_{31}$-$Oy_{40}$ and respective sizes of $Ix_{31}$-$Ix_{40}$ independently, it is possible to launch an electric field incoming in parallel to the y direction at a desired reflection phase and an electric field incoming in parallel to the x direction at a desired reflection phase.

Figure 43:
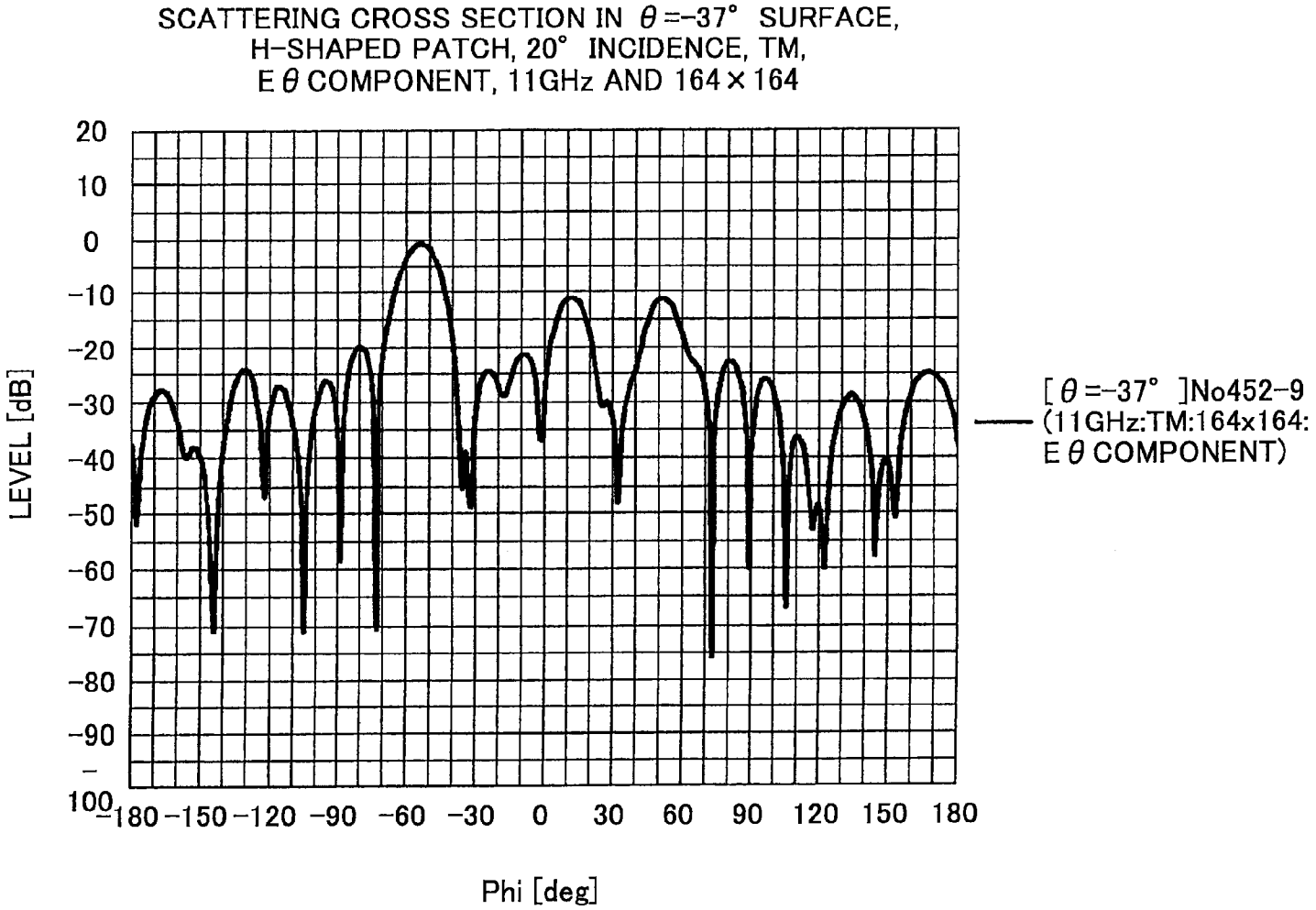
FIG. 43 is a view for illustrating a scattering cross section upon entering a reflectarray under a design condition in Table 1.
Figure 44:
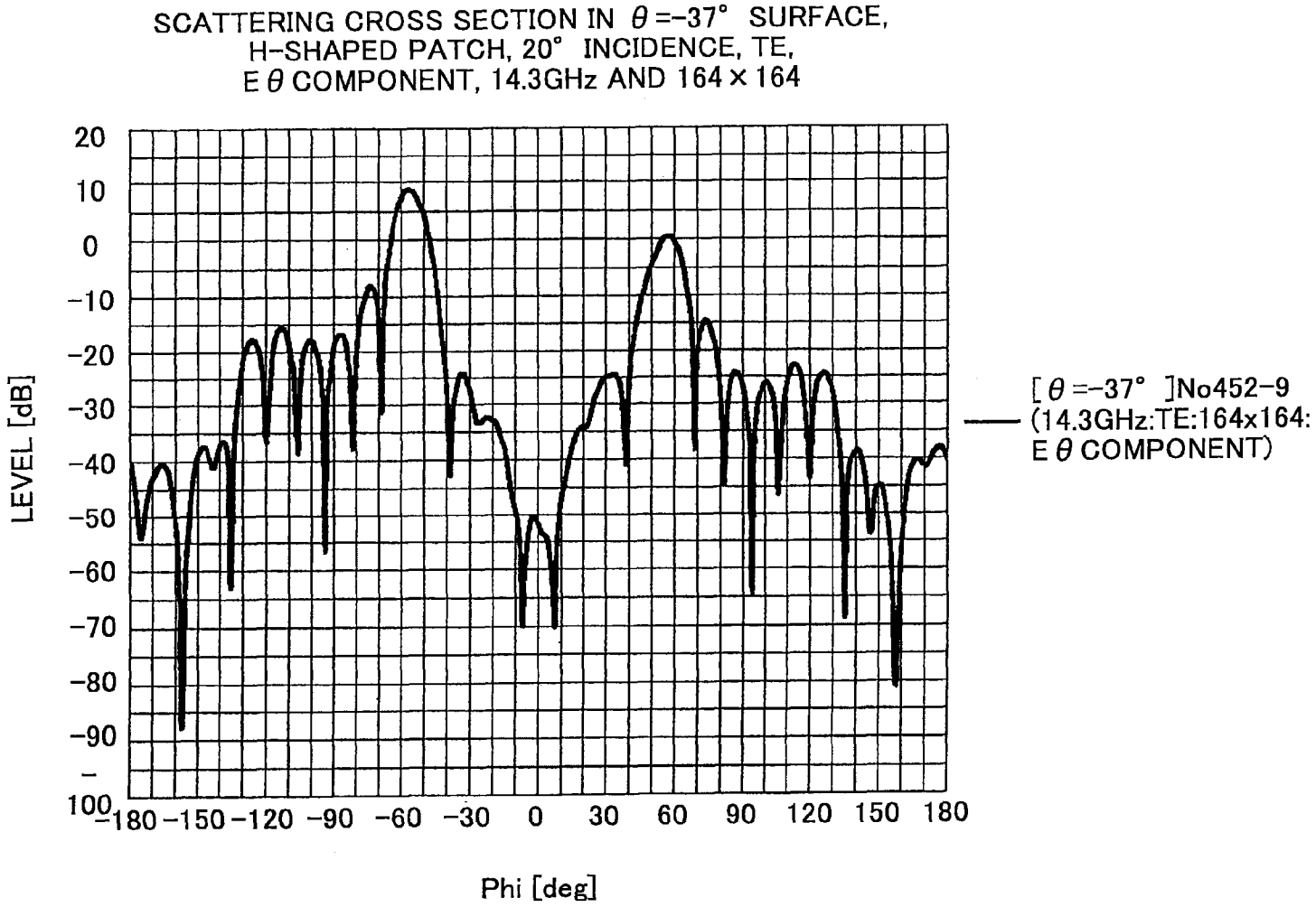
FIG. 44 is a view for illustrating a scattering cross section upon entering a reflectarray under a design condition in Table 1.

FIGS. 43 and 44 illustrate a scattering cross section at incidence timings to the reflectarray under the design condition of Table 1. FIG. 43 illustrates Eθ component of TM incidence 11 GHz under fixed θ=−37 degrees, and it can be seen that there is a peak in the direction of desired ϕ=−56 degrees. Also, FIG. 44 illustrates Eθ component of TE incidence 14.3 GHz under fixed θ=−37 degrees, and it can be seen that there is a peak in the direction of desired ϕ=−56 degrees.

Figure 45:
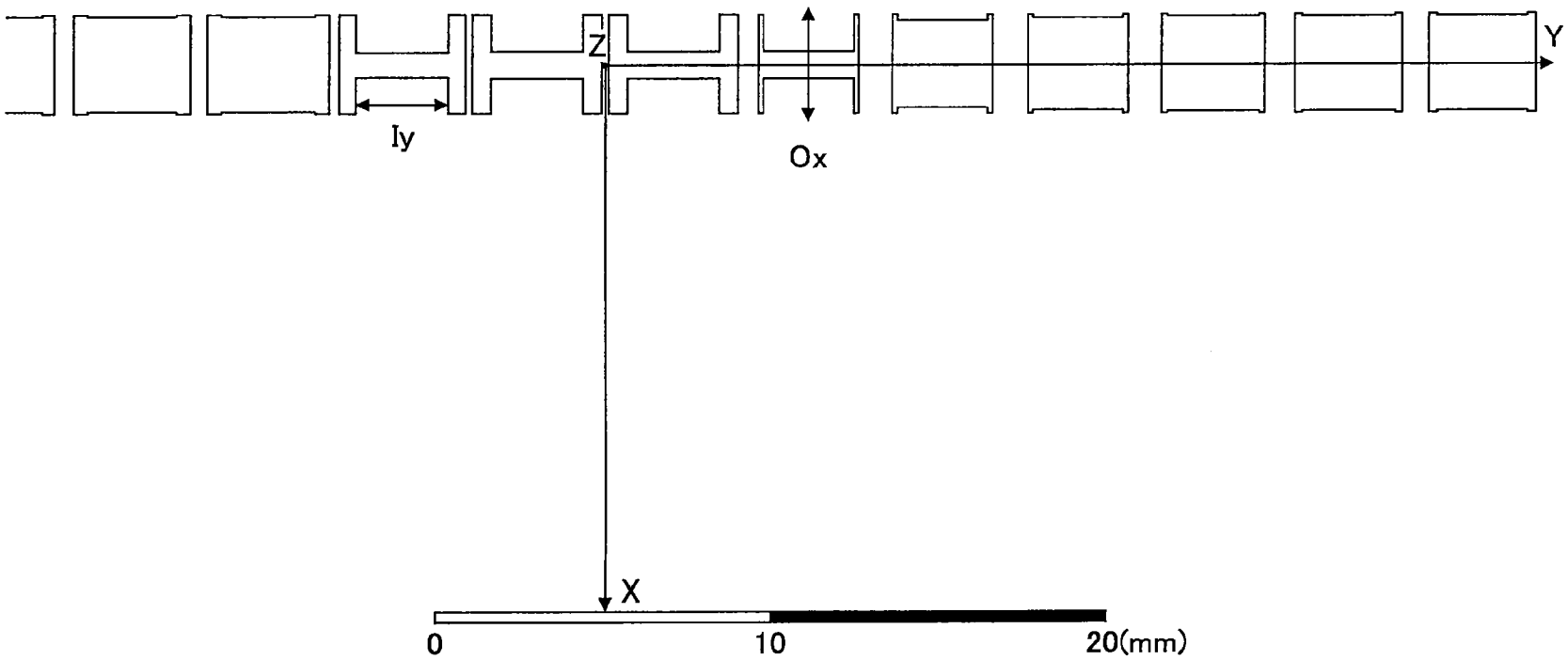
FIG. 45 is a view for illustrating a structure of a reflectarray according to a second embodiment of the present invention.

Next, a multiband reflectarray formed of H-shaped mushroom elements according to the second embodiment of the present invention is described. FIG. 45 is an enlarged view of a reflectarray formed of H-shaped mushroom elements according to the second embodiment of the present invention.

Although Iy varies in size in the multiband reflectarray according to the first embodiment, the size Iy is fixed in a multiband reflectarray according to the second embodiment, as illustrated in FIG. 45.

Figure 46:
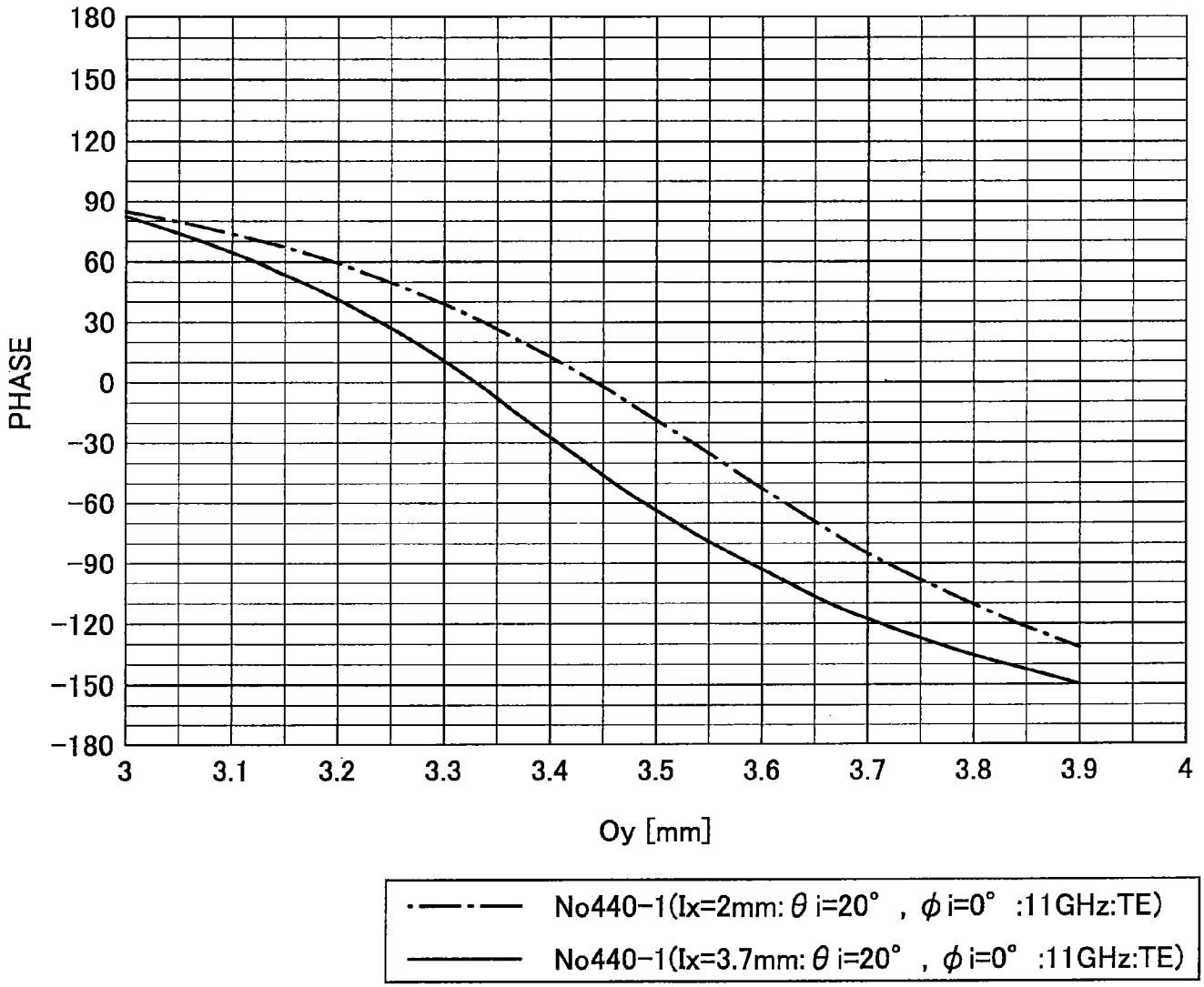
FIG. 46 is a view for illustrating variations of reflection phase characteristics of a multiband reflectarray with TE incident H-shaped mushroom elements over Oy according to the second embodiment of the present invention.

FIG. 46 is a view for illustrating changes of reflection phase characteristics of a multiband reflectarray formed of TE incidence H-shaped mushroom element over Oy according to the second embodiment of the present invention. As illustrated in FIG. 46, in the case where Oy changes under the fixed Iy, even if the length of Ix changes to 2 mm and 3.7 mm, almost similar simulation results are obtained for the reflection phase value. In other words, for incidence of an electric field in parallel to the y direction, the reflection phase can be determined from the length of Oy without depending on the length of Ix.

Figure 47:
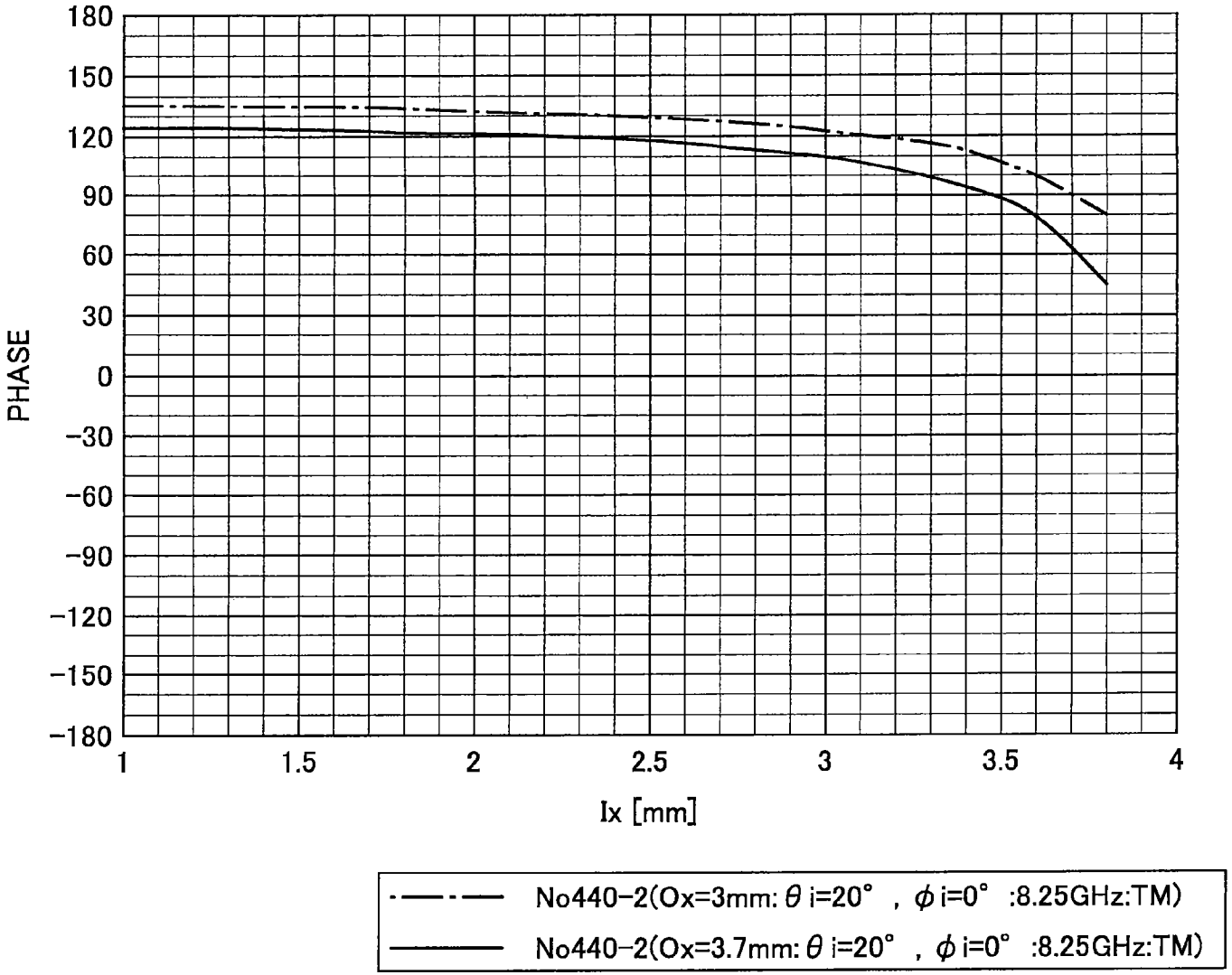
FIG. 47 is a view for illustrating variations of reflection phase characteristics of a multiband reflectarray with TM incident H-shaped mushroom elements over Ix according to the second embodiment of the present invention.

FIG. 47 is a view for illustrating changes of the reflection phase characteristics of a multiband reflectarray formed of TM incident H-shaped mushroom element over Ix according to the second embodiment of the present invention. As illustrated in FIG. 47, in the case where Ix changes under the fixed Ox, even if the length of Oy changes to 3 mm and 3.7 mm, almost similar simulation results are obtained for the reflection phase value. In other words, for incidence of an electric field in parallel to the x direction, the reflection phase can be determined from the length of Ix without depending on the length of Oy.

Figure 48:
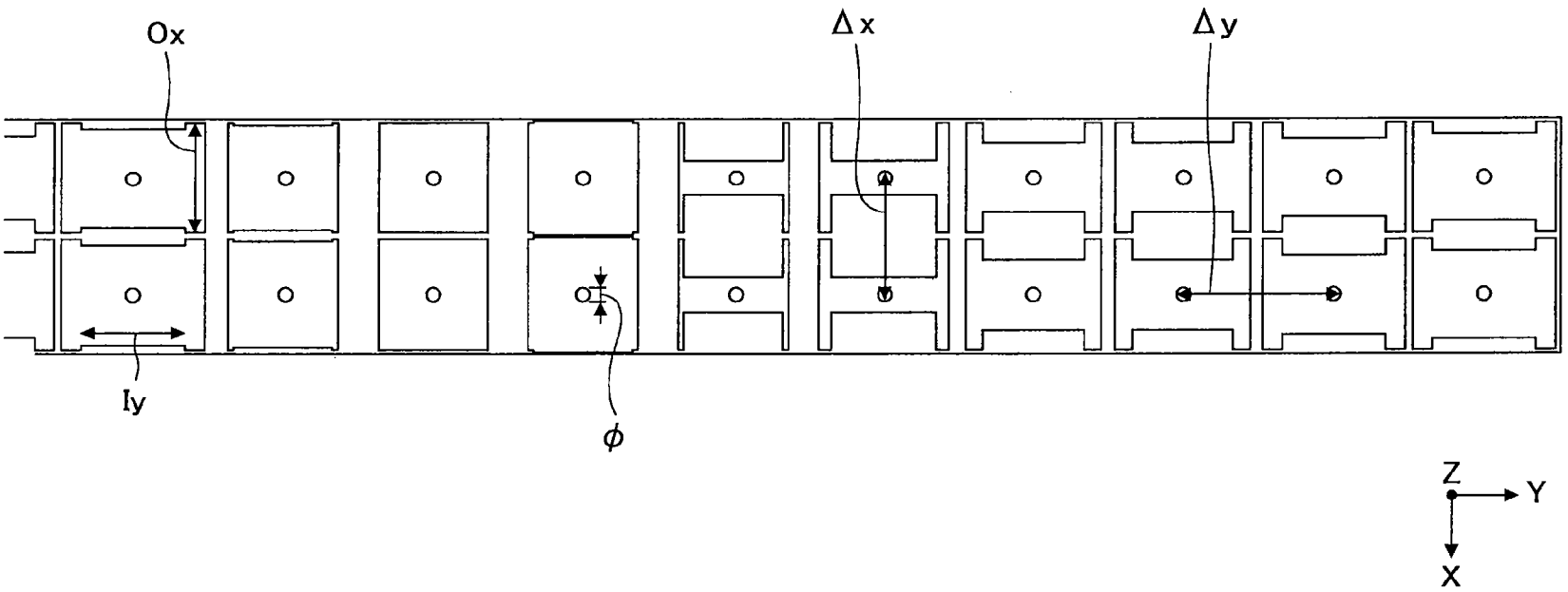
FIG. 48 is an enlarged view of a reflectarray with H-shaped mushroom elements according to a third embodiment of the present invention.

Next, a multiband reflectarray formed of H-shaped mushroom elements according to the third embodiment of the present invention is described. FIG. 48 is an enlarged view of a reflectarray formed of H-shaped mushroom elements according to the third embodiment of the present invention. In the multiband reflectarray according to the third embodiment, the H-shaped mushroom elements are arranged such that the length of Ix changes under the fixed length of Ox for incidence of an electric field in parallel to the x direction and the length of Oy changes under the fixed length of Iy for incidence of an electric field in parallel to the y direction. In other words, each H-shaped mushroom element has uniform sizes of Ox and Iy and different sizes of Ix and Oy.

As illustrated in FIG. 48, similar to the first embodiment, each H-shaped mushroom element has a uniform Ox and different Oy and Ix as well as a uniform Iy. As a result, similar to the first embodiment, the reflection phase of TE incidence can change independently of the reflection phase of TM incidence, and almost overlapping graphs can be used to indicate relationship between Iy and the reflection phase of an electric field incoming in parallel to the x direction as above-stated in conjunction with FIG. 39.

Although certain embodiments of a reflectarray for reflecting two polarized waves have been described, the disclosed invention is not limited to the embodiments, and various variations, modifications, alterations and replacements can be understood by those skilled in the art. Although specific numerical values have been illustratively used in order to facilitate understandings of the present invention, unless specifically stated otherwise, these numerical values are simply illustrative, and other equations leading to similar results may be used. Separation of items in the above description is not essential to the present invention. Some matters described in two or more items may be used in combination as needed, or some matters described in a certain item may be applied to some matters described in another item (only if there is no contradiction). The present invention is not limited to the above embodiments, and various variations, modifications, alterations and replacements should be included in the present invention without deviating from the spirit of the present invention.

This international patent application is based on Japanese Priority Applications No. 2012-219061 filed on Oct. 1, 2012 and No 2013-018926 filed on Feb. 1, 2013, the entire contents of which are hereby incorporated by reference.

LIST OF REFERENCE SYMBOLS

151, 251 ground plate
152, 252 via
153, 253 patch
154, 254 H-shaped patch

The invention claimed is:

1. A reflectarray having multiple elements arranged in an array, wherein each of the elements has a H-shaped patch provided in separation from a ground plate;

the H-shaped patch is formed by four outer vertices defined by two rectangular outer patches and four inner vertices defined by an inner patch;

a length of the inner patch with respect to a first direction is determined to change the reflection phase of an electric field incoming in parallel to the first direction while keeping positions of the four outer vertices and sizes of the outer patches constant, wherein the first direction is determined by positions of the four inner vertices; and a length of the H-shaped patch with respect to a second direction is determined to change the reflection phase of an electric field incoming in parallel to the second direction, wherein the second direction is determined by positions of the four outer vertices of the H-shaped patch.

2. The reflectarray as claimed in claim 1, wherein the length of the inner patch of each of the reflection elements arranged in the second direction is kept constant with respect to the second direction.

3. The reflectarray as claimed in claim 1, wherein the length of the H-shaped patch with respect to the second direction is determined for polarization of an electric field incoming in parallel to the second direction while keeping the length of the inner patch of each of the reflection elements arranged in the second direction constant with respect to the second direction.

4. The reflectarray as claimed in claim 1, wherein a frequency for the incidence in parallel to the second direction and a frequency for the incidence in parallel to the first direction or the incidence in parallel to a third direction different from the first direction and the second direction are different.

5. The reflectarray as claimed in claim 1, wherein the reflection phase for reflection of a first polarized wave by the reflection element is different from the reflection phase for reflection of the first polarized wave by a reflection element adjacent with respect to one direction by a first predefined value ($\alpha_{mn}(f_1)-\alpha_{m-1n}(f_1)$);

the reflection phase for reflection of a second polarized wave by the reflection element is different from reflection phase for reflection of the second polarized wave by a reflection element adjacent with respect to the other direction by a second predefined value ($\alpha_{mn}(f_2)-\alpha_{m-1n}(f_2)$); and a ratio between the first predefined value and the second predefined value is equal to a ratio between a first frequency ($f_1$) and a second frequency ($f_2$).

6. The reflectarray as claimed in claim 5, wherein the first predefined value is equal to a divisor of $360N_1$ degrees ($2\pi N_1$ radians) where $N_1$ is a natural number; and the second predefined value is equal to a divisor of $360N_2$ degrees ($2\pi N_2$ radians) where $N_2$ is a natural number.

7. A reflectarray having multiple reflection elements arranged in an array, wherein each of the reflection elements has a H-shaped patch in separation from a ground plate;

the H-shaped patch has two rectangular outer patches having a uniform size and one rectangular inner patch;

the two outer patches are coupled to the inner patch to sandwich the inner patch such that the H-shaped patch is symmetric with respect to a first direction defined by one side of a rectangle and a second direction orthogonal to the first direction;

a length of the inner patch with respect to the first direction is determined for polarization of an electric field incoming in parallel to the first direction while keeping a length of the outer patches of each of reflection elements with respect to the first direction constant, the reflection elements arranged in the second direction; and a length of the H-shaped patch with respect to the second direction is determined for polarization of an electric field incoming in parallel to the second direction.

* * * * *